US007497547B2

(12) United States Patent
Komatsu

(10) Patent No.: US 7,497,547 B2
(45) Date of Patent: Mar. 3, 2009

(54) NOZZLE CLEANING METHOD, NOZZLE CLEANING DEVICE, LIQUID EJECTION APPARATUS, PRINTING APPARATUS AND COMPUTER-READABLE MEDIUM

(75) Inventor: Shinya Komatsu, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 329 days.

(21) Appl. No.: 11/285,299

(22) Filed: Nov. 23, 2005

(65) Prior Publication Data

US 2006/0157579 A1 Jul. 20, 2006

(30) Foreign Application Priority Data

Nov. 25, 2004 (JP) ..... 2004-340542
Nov. 17, 2005 (JP) ..... 2005-333033

(51) Int. Cl.
*B41J 2/165* (2006.01)
*B41J 29/393* (2006.01)

(52) U.S. Cl. ..... 347/23; 347/19; 347/29; 347/32; 347/33

(58) Field of Classification Search ..... 347/23, 347/24, 29, 30, 32, 33, 19
See application file for complete search history.

(56) References Cited

U.S. PATENT DOCUMENTS 5,896,143 A * 4/1999 Matsui et al. ..... 347/24
6,652,056 B2 * 11/2003 Shioya ..... 347/12
6,719,400 B2 * 4/2004 Inui et al. ..... 347/23

FOREIGN PATENT DOCUMENTS

JP 2000-233520 A 8/2000
JP 2002-79693 A 3/2002

* cited by examiner

*Primary Examiner*—Shih-wen Hsieh
(74) *Attorney, Agent, or Firm*—Sughrue Mion, PLLC

(57) ABSTRACT

A nozzle cleaning method has the following steps (A) to (C). (A) A first determination step of determining whether or not there is ejection of a liquid from a liquid ejection nozzle targeted for testing. (B) A second determination step of determining whether or not there is an abnormality in an ejection direction or an ejection condition of a liquid from the liquid ejection nozzle. (C) A cleaning step in which a cleaning process that is different is executed between when a determination is made that there is no ejection of the liquid in the first determination step and when a determination is made that there is an abnormality in the ejection direction or the ejection condition of the liquid in the second determination step on the liquid ejection nozzle that is subjected to determination.

22 Claims, 38 Drawing Sheets

NOZZLE CLEANING METHOD, NOZZLE CLEANING DEVICE, LIQUID EJECTION APPARATUS, PRINTING APPARATUS AND COMPUTER-READABLE MEDIUM

CROSS-REFERENCE TO RELATED APPLICATIONS

The present application claims priority upon Japanese Patent Application No. 2004-340542 filed on Nov. 25, 2004 and Japanese Patent Application No. 2005-333033 filed on Nov. 17, 2005, which are herein incorporated by reference.

BACKGROUND

1. Technical Field

The invention relates to nozzle cleaning methods, nozzle cleaning devices, liquid ejection apparatuses, printing apparatuses, and computer-readable media.

2. Description of the Related Art

Inkjet printers are known as an example of printing apparatuses that carry out printing by ejecting ink onto various media such as paper, cloth, and film. These inkjet printers perform color printing by ejecting color inks such as cyan (C), magenta (M), yellow (Y), and black (K) to form dots on the medium. Ink ejection is carried out using nozzles.

However, with these inkjet printers, a nozzle may become clogged due to sticking of ink or the like such that ink is not ejected properly. Dots cannot be formed adequately on the medium when ink is not ejected properly from the nozzle in this way and problems may occur such as being unable to print images clearly.

Accordingly, various methods have long been proposed for testing whether or not ink ejection is functioning properly. As one of these, a detection method has been proposed (see JP-A-2000-233520) in which ink ejected from a nozzle is optically detected. In this testing method, the condition of ink ejection from the nozzle is examined by using a photodiode to detect whether or not a beam irradiated from an LED is blocked by the ink ejected from the nozzle. If the result of the test is that an ejection defect is discovered in the nozzle, then a cleaning process is executed on that nozzle. This enables nozzle ejection defects to be solved.

By the way, there are several causes of ejection defects occurring in nozzles. For example, there are causes such as ink ejection being unable to be carried out due to clogging or the like, or the direction in which ink is ejected deviates due to foreign objects adhering to the nozzle opening. However, regardless of there being several causes of nozzle ejection defects such as these, conventionally the cleaning processes executed on a nozzle in which an ejection defect has been discovered are invariably the same. That is, for example, a process may be performed in which extraneous matter adhering to the nozzle opening is removed by wiping or ink may be forcibly discharged from the nozzle. If the ejection defect is still not solved by this, then a process such as suctioning ink from the nozzle is performed. For this reason, considerable time is spent on the cleaning processes and extra ink is ejected, which incurs an increased burden of cost for the user.

SUMMARY

The invention was arrived at in light of the foregoing issues, and it is an object thereof to enable a cleaning process that, when an ejection defect has occurred in a nozzle, does not take much time and can reduce the cost burden for the user.

A primary aspect of the invention is a nozzle cleaning method such as the following.

A nozzle cleaning method, comprising:

a first determination step of determining whether or not there is ejection of a liquid from a liquid ejection nozzle targeted for testing;

a second determination step of determining whether or not there is an abnormality in an ejection direction of a liquid from the liquid ejection nozzle; and a cleaning step of executing a cleaning process that is different between when a determination is made that there is no ejection of the liquid in the first determination step and when a determination is made that there is an abnormality in the ejection direction of the liquid in the second determination step on the liquid ejection nozzle that is subjected to determination.

Furthermore, another primary aspect of the invention is a nozzle cleaning device such as the following.

A nozzle cleaning device, comprising:

a first determination section that determines whether or not there is ejection of a liquid from a liquid ejection nozzle targeted for testing;

a second determination section that determines whether or not there is an abnormality in an ejection direction of a liquid from the liquid ejection nozzle; and a controller that executes a cleaning process that is different between when a determination is made by the first determination section that there is no ejection of the liquid and when a determination is made by the second determination section that there is an abnormality in the ejection direction of the liquid on the liquid ejection nozzle that is subjected to determination.

Furthermore, another primary aspect of the invention is a nozzle cleaning method such as the following.

A nozzle cleaning method, comprising:

a first determination step of determining whether or not there is ejection of a liquid from a liquid ejection nozzle targeted for testing;

a second determination step of determining whether or not there is an abnormality in an ejection condition of a liquid from the liquid ejection nozzle; and a cleaning step of executing a cleaning process that is different between when a determination is made that there is no ejection of the liquid in the first determination step and when a determination is made that there is an abnormality in the ejection condition of the liquid in the second determination step on the liquid ejection nozzle that is subjected to determination.

Furthermore, another primary aspect of the invention is a nozzle cleaning device such as the following.

A nozzle cleaning device, comprising:

a first determination section that determines whether or not there is ejection of a liquid from a liquid ejection nozzle targeted for testing;

a second determination section that determines whether or not there is an abnormality in an ejection condition of a liquid from the liquid ejection nozzle; and a controller that executes a cleaning process that is different between when a determination is made by the first determination section that there is no ejection of the liquid and when a determination is made by the second determination section that there is an abnormality in the ejection condition of the liquid on the liquid ejection nozzle that is subjected to determination.

Furthermore, another primary aspect of the invention is a liquid ejection apparatus such as the following.

A liquid ejection apparatus, comprising:

a nozzle that ejects a liquid;

a first determination section that determines whether or not there is ejection of the liquid from the nozzle;

a second determination section that determines whether or not there is an abnormality in an ejection direction of the liquid from the nozzle; and a controller that executes a cleaning process that is different between when a determination is made by the first determination section that there is no ejection of the liquid and when a determination is made by the second determination section that there is an abnormality in the ejection direction of the liquid on the nozzle that is subjected to determination.

Furthermore, another primary aspect of the invention is a liquid ejection apparatus such as the following.

A liquid ejection apparatus, comprising:

a nozzle that ejects a liquid;

a first determination section that determines whether or not there is ejection of the liquid from the nozzle;

a second determination section that determines whether or not there is an abnormality in an ejection condition of the liquid from the nozzle; and a controller that executes a cleaning process that is different between when a determination is made by the first determination section that there is no ejection of the liquid and when a determination is made by the second determination section that there is an abnormality in the ejection condition of the liquid on the nozzle that is subjected to determination.

Another primary aspect of the invention is a printing apparatus such as the following.

A printing apparatus comprising:

a nozzle that carries out printing by ejecting ink toward a medium;

a first determination section that determines whether or not there is ejection of the ink from the nozzle;

a second determination section that determines whether or not there is an abnormality in an ejection direction of the ink from the nozzle; and a controller that executes a cleaning process that is different between when a determination is made by the first determination section that there is no ejection of the ink and when a determination is made by the second determination section that there is an abnormality in the ejection direction of the ink on the nozzle that is subjected to determination.

Another primary aspect of the invention is a printing apparatus such as the following.

A printing apparatus comprising:

a nozzle that carries out printing by ejecting ink toward a medium;

a first determination section that determines whether or not there is ejection of the ink from the nozzle;

a second determination section that determines whether or not there is an abnormality in an ejection condition of the ink from the nozzle; and a controller that executes a cleaning process that is different between when a determination is made by the first determination section that there is no ejection of the ink and when a determination is made by the second determination section that there is an abnormality in the ejection condition of the ink on the nozzle that is subjected to determination.

Another primary aspect of the invention is a computer-readable medium such as the following.

A computer-readable medium for enabling operation of a nozzle cleaning device comprises the following codes:

a code for determining whether or not there is ejection of a liquid from a liquid ejection nozzle targeted for testing;

a code for determining whether or not there is an abnormality in an ejection direction of a liquid from the liquid ejection nozzle; and a code for executing a cleaning process that is different between when a determination is made that there is no ejection of the liquid in a first determination step and when a determination is made that there is an abnormality in the ejection direction of the liquid in a second determination step on the liquid ejection nozzle that is subjected to determination.

Furthermore, another primary aspect of the invention is a computer-readable medium such as the following.

A computer-readable medium for enabling operation of a nozzle cleaning device comprises the following codes:

a code for determining whether or not there is ejection of a liquid from a liquid ejection nozzle targeted for testing;

a code for determining whether or not there is an abnormality in an ejection condition of a liquid from the liquid ejection nozzle; and a code for executing a cleaning process that is different between when a determination is made that there is no ejection of the liquid in a first determination step and when a determination is made that there is an abnormality in the ejection condition of the liquid in a second determination step on the liquid ejection nozzle that is subjected to determination.

BRIEF DESCRIPTION OF THE DRAWINGS

For a more complete understanding of the invention and the advantages thereof, reference is now made to the following description taken in conjunction with the accompanying drawings.

DETAILED DESCRIPTION OF THE INVENTION

Detailed Description of Preferred Embodiments

Figure 1:
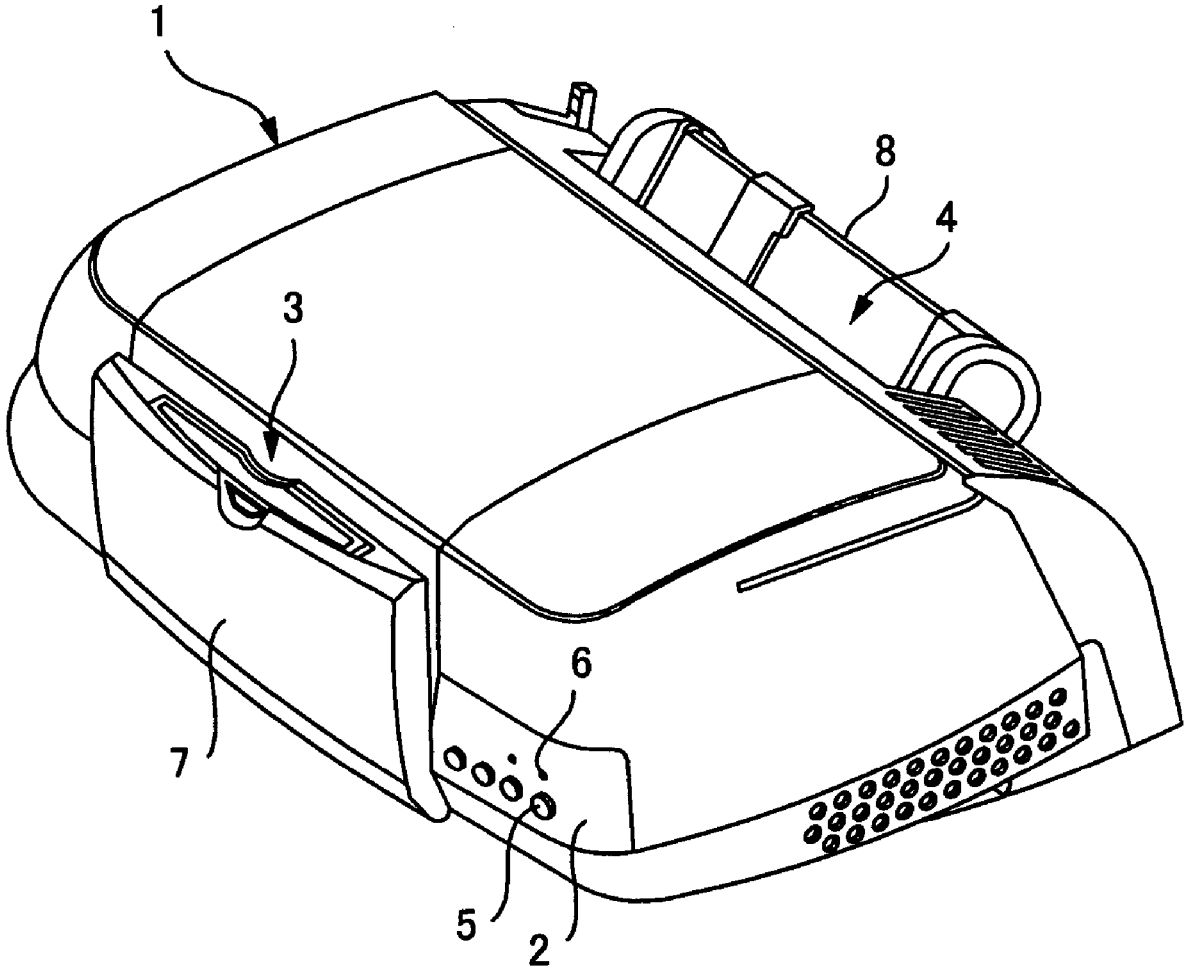
FIG. 1 is a perspective view of an embodiment of a liquid ejection apparatus (printing apparatus).

At least the following matters will be made clear by the present specification and the description of the accompanying drawings.

A nozzle cleaning method, comprising:

a first determination step of determining whether or not there is ejection of a liquid from a liquid ejection nozzle targeted for testing;

a second determination step of determining whether or not there is an abnormality in an ejection direction of a liquid from the liquid ejection nozzle; and a cleaning step of executing a cleaning process that is different between when a determination is made that there is no ejection of the liquid in the first determination step and when a determination is made that there is an abnormality in the ejection direction of the liquid in the second determination step on the liquid ejection nozzle that is subjected to determination.

With this nozzle cleaning method, different cleaning processes can be executed on the liquid ejection nozzle that is subjected to determination when a determination is made that there is no ejection of the liquid and when a determination is made that there is an abnormality in the ejection direction of the liquid. Accordingly, an appropriate cleaning process can be executed in response to the condition of the ejection defect of the liquid ejection nozzle.

In the present nozzle cleaning method, it is preferable that the second determination step is executed when a determination is made that there is ejection of the liquid in the first determination step.

By determining whether or not there is an abnormality in the ejection direction of the liquid when it is determined that there is ejection of the liquid, the determination process can be carried out appropriately and simply.

In the present nozzle cleaning method, it is preferable that a determination is made in at least one of the first determination step and the second determination step based on a magnitude of an induced current produced in a detection member by the liquid that has been ejected from the liquid ejection nozzle and that has been charged.

By making a determination using at least one of the first determination step and the second determination step based on a magnitude of an induced current produced in a detection member by the liquid that has been ejected from the liquid ejection nozzle and that has been charged, it is possible to determine easily whether or not there is liquid ejection and whether or not there is an abnormality in the ejection direction of the liquid.

In the present nozzle cleaning method, it is preferable that a determination is made in the first determination step or the second determination step by comparing a magnitude of the induced current produced in a detection member and a predetermined reference value.

By comparing the magnitude of the induced current and the predetermined reference value to make the determinations, it is possible to determine easily whether or not there is liquid ejection from the liquid ejection nozzle and whether or not there is an abnormality in the ejection direction of the liquid.

In the present nozzle cleaning method, it is preferable that there is a plurality of the liquid ejection nozzles.

When there is a plurality of the liquid ejection nozzles, testing can be carried out with excellent efficiency on the plurality of liquid ejection nozzles.

In the present nozzle cleaning method, it is preferable that a suction process of suctioning the liquid from the liquid ejection nozzle is executed as the cleaning process.

By executing the suction process as the cleaning process, it is possible to solve ejection defects of the liquid ejection nozzles.

In the present nozzle cleaning method, it is preferable that the suction process is executed as the cleaning process when a determination is made in the first determination step that there is no ejection of the liquid.

By executing the suction process when a determination is made that there is no ejection of the liquid, it is possible to solve ejection defects of the liquid ejection nozzles.

In the present nozzle cleaning method, it is preferable that a liquid ejection operation of ejecting the liquid from the liquid ejection nozzle toward a liquid recovery section is executed as the cleaning process.

By executing the liquid ejection operation as the cleaning process, it is possible to solve ejection defects of the liquid ejection nozzles.

In the present nozzle cleaning method, it is preferable that the liquid ejection nozzle is a nozzle that forms dots of at least two or more different sizes on a medium by ejection of the liquid, and executes as the cleaning process the liquid ejection operation of ejecting the liquid from the liquid ejection nozzle toward the liquid recovery section to form a dot of a smaller size than a largest size.

By executing the liquid ejection operation as the cleaning process, it is possible to solve ejection defects of the liquid ejection nozzles.

In the present nozzle cleaning method, it is preferable that the liquid ejection nozzle is a nozzle that carries out an operation of ejecting the liquid based on drive signals of at least two different frequencies, and executes as the cleaning process the liquid ejection operation of ejecting the liquid from the liquid ejection nozzle toward the liquid recovery section based on a drive signal of another frequency excluding a highest frequency.

By executing the liquid ejection operation as the cleaning process, it is possible to solve ejection defects of the liquid ejection nozzles.

In the present nozzle cleaning method, it is preferable that the liquid ejection operation is executed as the cleaning process when a determination is made in the second determination step that there is an abnormality in an ejection direction of the liquid.

By executing the liquid ejection operation when a determination is made that there is an abnormality in the ejection direction of the liquid, it is possible to solve ejection defects of the liquid ejection nozzles.

In the present nozzle cleaning method, it is preferable that a wiping process of wiping and removing extraneous matter adhering to an opening of the liquid ejection nozzle is executed as the cleaning process.

By executing the wiping process as the cleaning process, it is possible to solve ejection defects of the liquid ejection nozzles.

In the present nozzle cleaning method, it is preferable that the wiping process is executed as the cleaning process when a determination is made in the second determination step that there is an abnormality in an ejection direction of the liquid.

By executing the wiping process when a determination is made that there is an abnormality in the ejection direction of the liquid, it is possible to solve ejection defects of the liquid ejection nozzles.

In the present nozzle cleaning method, it is preferable that the liquid ejected from the liquid ejection nozzle is ink.

When the liquid ejected from the liquid ejection nozzle is ink, nozzle cleaning can be executed with excellent efficiency.

Furthermore, it is also possible to achieve a nozzle cleaning device such as the following.

A nozzle cleaning device, comprising:

a first determination section that determines whether or not there is ejection of a liquid from a liquid ejection nozzle targeted for testing;

a second determination section that determines whether or not there is an abnormality in an ejection direction of a liquid from the liquid ejection nozzle; and a controller that executes a cleaning process that is different between when a determination is made by the first determination section that there is no ejection of the liquid and when a determination is made by the second determination section that there is an abnormality in the ejection direction of the liquid on the liquid ejection nozzle that is subjected to determination.

With this nozzle cleaning device, different cleaning processes can be executed on the liquid ejection nozzle that is subjected to determination when a determination is made that there is no ejection of the liquid and when a determination is made that there is an abnormality in the ejection direction of the liquid. Accordingly, an appropriate cleaning process can be executed in response to the condition of the ejection defect of the liquid ejection nozzle.

Furthermore, it is also possible to achieve a nozzle cleaning method such as the following.

A nozzle cleaning method, comprising:

a first determination step of determining whether or not there is ejection of a liquid from a liquid ejection nozzle targeted for testing;

a second determination step of determining whether or not there is an abnormality in an ejection condition of a liquid from the liquid ejection nozzle; and a cleaning step of executing a cleaning process that is different between when a determination is made that there is no ejection of the liquid in the first determination step and when a determination is made that there is an abnormality in the ejection condition of the liquid in the second determination step on the liquid ejection nozzle that is subjected to determination.

With this nozzle cleaning method, different cleaning processes can be executed on the liquid ejection nozzle that is subjected to determination when a determination is made that there is no ejection of the liquid and when a determination is made that there is an abnormality in the ejection condition of the liquid. Accordingly, an appropriate cleaning process can be executed in response to the condition of the ejection defect of the liquid ejection nozzle.

Furthermore, it is also possible to achieve a nozzle cleaning device such as the following.

A nozzle cleaning device, comprising:

a first determination section that determines whether or not there is ejection of a liquid from a liquid ejection nozzle targeted for testing;

a second determination section that determines whether or not there is an abnormality in an ejection condition of a liquid from the liquid ejection nozzle; and a controller that executes a cleaning process that is different between when a determination is made by the first determination section that there is no ejection of the liquid and when a determination is made by the second determination section that there is an abnormality in the ejection condition of the liquid on the liquid ejection nozzle that is subjected to determination.

With this nozzle cleaning device, different cleaning processes can be executed on the liquid ejection nozzle that is subjected to determination when a determination is made that there is no ejection of the liquid and when a determination is made that there is an abnormality in the ejection condition of the liquid. Accordingly, an appropriate cleaning process can be executed in response to the condition of the ejection defect of the liquid ejection nozzle.

Furthermore, it is also possible to achieve a liquid ejection apparatus such as the following.

A liquid ejection apparatus, comprising:

a nozzle that ejects a liquid;

a first determination section that determines whether or not there is ejection of the liquid from the nozzle;

a second determination section that determines whether or not there is an abnormality in an ejection direction of the liquid from the nozzle; and a controller that executes a cleaning process that is different between when a determination is made by the first determination section that there is no ejection of the liquid and when a determination is made by the second determination section that there is an abnormality in the ejection direction of the liquid on the nozzle that is subjected to determination.

With this liquid ejection apparatus, different cleaning processes can be executed on the liquid ejection nozzle that is subjected to determination when a determination is made that there is no ejection of the liquid and when a determination is made that there is an abnormality in the ejection direction of the liquid. Accordingly, an appropriate cleaning process can be executed in response to the condition of the ejection defect of the liquid ejection nozzle.

Furthermore, it is also possible to achieve a liquid ejection apparatus such as the following.

A liquid ejection apparatus, comprising:

a nozzle that ejects a liquid;

a first determination section that determines whether or not there is ejection of the liquid from the nozzle;

a second determination section that determines whether or not there is an abnormality in an ejection condition of the liquid from the nozzle; and a controller that executes a cleaning process that is different between when a determination is made by the first determination section that there is no ejection of the liquid and when a determination is made by the second determination section that there is an abnormality in the ejection condition of the liquid on the nozzle that is subjected to determination.

With this liquid ejection apparatus, different cleaning processes can be executed on the liquid ejection nozzle that is subjected to determination when a determination is made that there is no ejection of the liquid and when a determination is made that there is an abnormality in the ejection condition of the liquid. Accordingly, an appropriate cleaning process can be executed in response to the condition of the ejection defect of the liquid ejection nozzle.

Furthermore, it is also possible to achieve a printing apparatus such as the following.

A printing apparatus comprising:

a nozzle that carries out printing by ejecting ink toward a medium;

a first determination section that determines whether or not there is ejection of the ink from the nozzle;

a second determination section that determines whether or not there is an abnormality in an ejection direction of the ink from the nozzle; and a controller that executes a cleaning process that is different between when a determination is made by the first determination section that there is no ejection of the ink and when a determination is made by the second determination section that there is an abnormality in the ejection direction of the ink on the nozzle that is subjected to determination.

With this printing apparatus, different cleaning processes can be executed on the liquid ejection nozzle that is subjected to determination when a determination is made that there is no ejection of the liquid and when a determination is made that there is an abnormality in the ejection direction of the liquid. Accordingly, an appropriate cleaning process can be executed in response to the condition of the ejection defect of the liquid ejection nozzle.

Furthermore, it is also possible to achieve a printing apparatus such as the following.

A printing apparatus comprising:

a nozzle that carries out printing by ejecting ink toward a medium;

a first determination section that determines whether or not there is ejection of the ink from the nozzle;

a second determination section that determines whether or not there is an abnormality in an ejection condition of the ink from the nozzle; and a controller that executes a cleaning process that is different between when a determination is made by the first determination section that there is no ejection of the ink and when a determination is made by the second determination section that there is an abnormality in the ejection condition of the ink on the nozzle that is subjected to determination.

With this printing apparatus, different cleaning processes can be executed on the liquid ejection nozzle that is subjected to determination when a determination is made that there is no ejection of the liquid and when a determination is made that there is an abnormality in the ejection condition of the liquid. Accordingly, an appropriate cleaning process can be executed in response to the condition of the ejection defect of the liquid ejection nozzle.

It is also possible to achieve a computer-readable medium such as the following.

A computer-readable medium for enabling operation of a nozzle cleaning device comprises the following codes:

a code for determining whether or not there is ejection of a liquid from a liquid ejection nozzle targeted for testing;

a code for determining whether or not there is an abnormality in an ejection direction of a liquid from the liquid ejection nozzle; and a code for executing a cleaning process that is different between when a determination is made that there is no ejection of the liquid in a first determination step and when a determination is made that there is an abnormality in the ejection direction of the liquid in a second determination step on the liquid ejection nozzle that is subjected to determination.

With this computer-readable medium, different cleaning processes can be executed on the liquid ejection nozzle that is subjected to determination when a determination is made that there is no ejection of the liquid and when a determination is made that there is an abnormality in the ejection condition of the liquid. Accordingly, an appropriate cleaning process can be executed in response to the condition of the ejection defect of the liquid ejection nozzle.

It is also possible to achieve a computer-readable medium such as the following.

A computer-readable medium for enabling operation of a nozzle cleaning device comprises the following codes:

a code for determining whether or not there is ejection of a liquid from a liquid ejection nozzle targeted for testing;

a code for determining whether or not there is an abnormality in an ejection condition of a liquid from the liquid ejection nozzle; and a code for executing a cleaning process that is different between when a determination is made that there is no ejection of the liquid in a first determination step and when a determination is made that there is an abnormality in the ejection condition of the liquid in a second determination step on the liquid ejection nozzle that is subjected to determination.

With this computer-readable medium, different cleaning processes can be executed on the liquid ejection nozzle that is subjected to determination when a determination is made that there is no ejection of the liquid and when a determination is made that there is an abnormality in the ejection condition of the liquid. Accordingly, an appropriate cleaning process can be executed in response to the condition of the ejection defect of the liquid ejection nozzle.

Overview of the Liquid Ejection Apparatus (Printing Apparatus)

Figure 2:
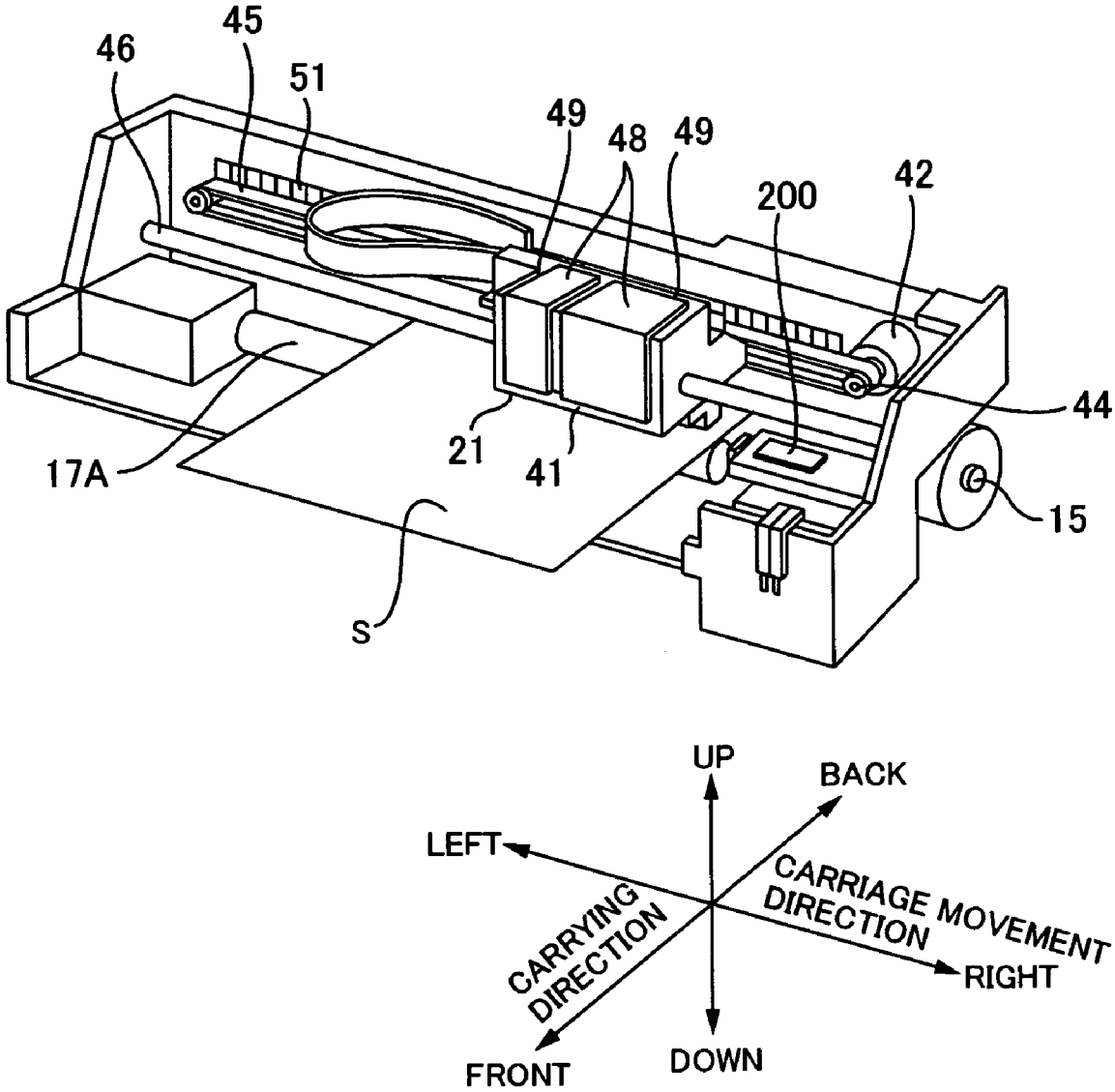
FIG. 2 is a perspective view illustrating an internal configuration of the liquid ejection apparatus (printing apparatus).
Figure 3:
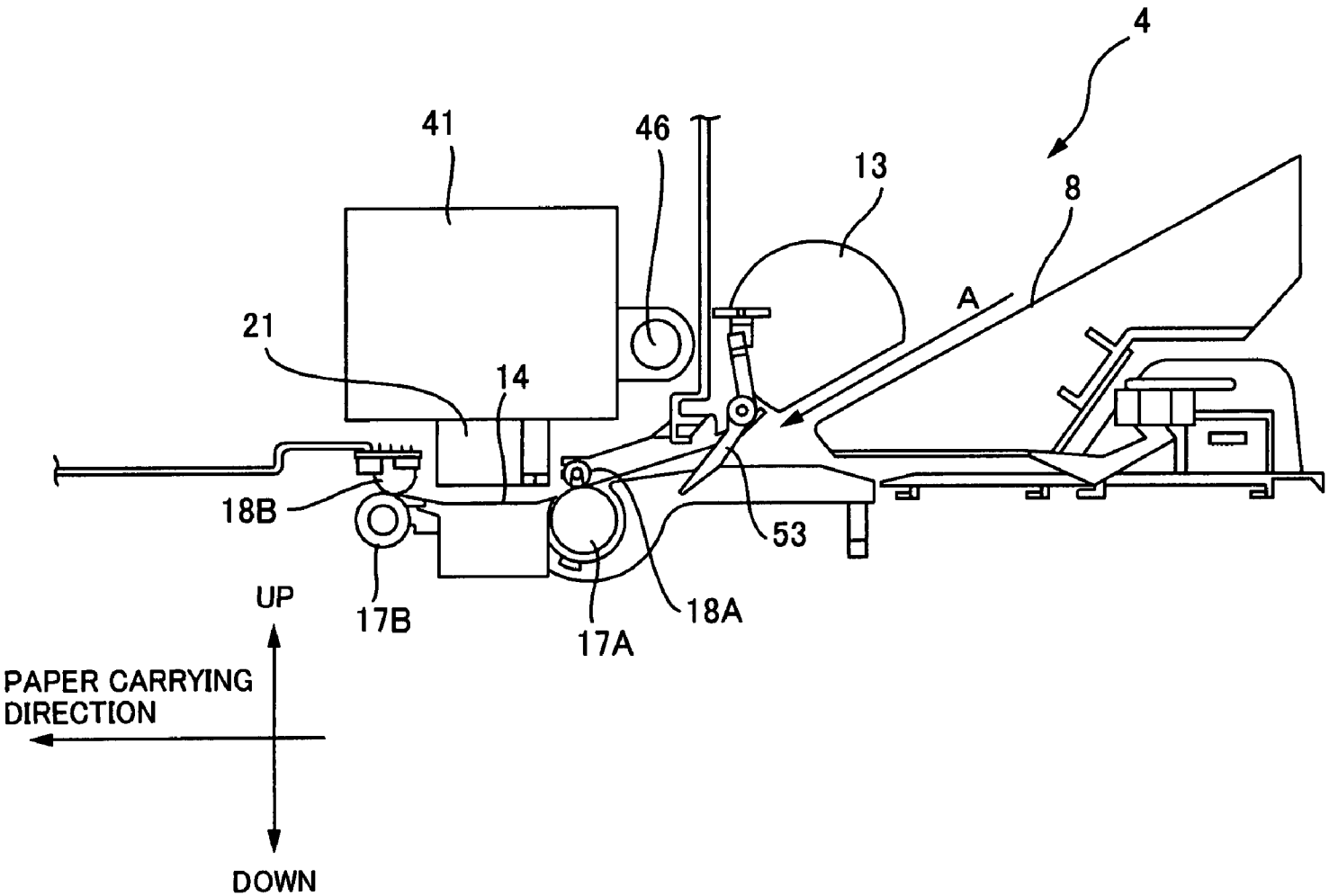
FIG. 3 is a cross-sectional view showing a carrying section of the liquid ejection apparatus (printing apparatus).
Figure 4:
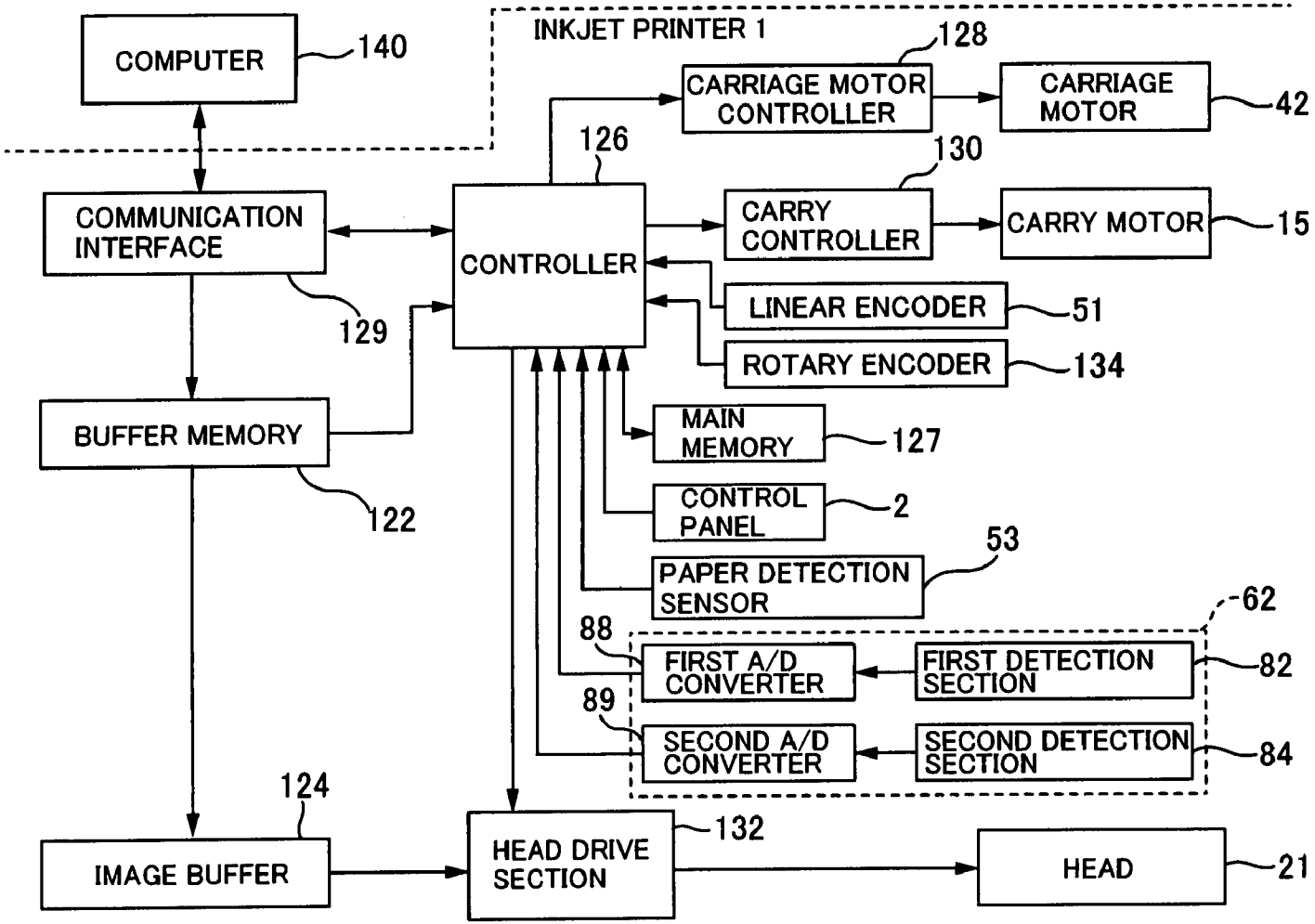
FIG. 4 is a block diagram showing a system configuration of the liquid ejection apparatus (printing apparatus).

An embodiment of a liquid ejection apparatus and a printing apparatus according to the invention is described with an inkjet printer 1 serving as an example. It should be noted that the inkjet printer 1 is equipped with a nozzle cleaning device. FIGS. 1 to 4 show the inkjet printer 1. FIG. 1 shows the appearance of the inkjet printer 1. FIG. 2 shows the internal configuration of the inkjet printer 1. FIG. 3 shows the configuration of a carrying section of the inkjet printer 1. FIG. 4 shows the system configuration of the inkjet printer 1.

As shown in FIG. 1, the inkjet printer 1 is provided with a structure in which a medium such as print paper that is supplied from the rear face is discharged from the front face. The front face section is provided with a control panel 2 and a paper discharge section 3, and the rear face section is provided with a paper supply section 4. The control panel 2 is provided with various types of control buttons 5 and display lamps 6. Furthermore, the paper discharge section 3 is provided with a paper discharge tray 7 that blocks the paper discharge opening when the inkjet printer is not used. The paper supply section 4 is provided with a paper supply tray 8 for holding a medium such as cut paper.

As shown in FIG. 2, the internal portion of the inkjet printer 1 is provided with a carriage 41. The carriage 41 is disposed such that it can move relatively in the left-to-right direction. A carriage motor 42, a pulley 44, a timing belt 45, and a guide rail 46 are arranged in the vicinity of the carriage 41. The carriage motor 42 is constituted by a DC motor or the like and functions as a driving force for moving the carriage 41 relatively in the left-to-right direction (hereinafter, also referred to as "carriage movement direction"). The timing belt 45 is connected via the pulley 44 to the carriage motor 42, and a part of it is also connected to the carriage 41, such that the carriage 41 is moved relatively in the carriage movement direction (left-to-right direction) with the rotational force of the carriage motor 42. The guide rail 46 guides the carriage 41 in the carriage movement direction (left-to-right direction).

In addition to the above, a linear encoder 51 for detecting the position of the carriage 41, a carry roller 17A for carrying a medium S in the direction (front-to-rear direction in the drawing, and hereinafter, also referred to as "carrying direction") that intersects with the movement direction of the carriage 41, and a carry motor 15 for rotatively driving the carry roller 17A are arranged in the vicinity of the carriage 41.

On the other hand, the carriage 41 is provided with ink cartridges 48 that contain various types of ink and a head 21 that carries out printing on the medium S. The ink cartridges 48 contain ink of various colors such as yellow (Y), magenta (M), cyan (C), and black (K), and are mounted in a cartridge mounting section 49 provided in the carriage 41 in a removable manner. Furthermore, in this embodiment, the head 21 carries out printing by ejecting ink onto the medium S. For this reason, the head 21 is provided with a large number of nozzles for ejecting ink.

Additionally, a nozzle suction apparatus 200 for suctioning ink from the nozzles is arranged inside the inkjet printer 1 to clear clogging of the nozzles of the head 21.

The following is a description concerning a carrying section of the inkjet printer 1. As shown in FIG. 3, the carrying section is provided with a paper supply roller 13, a paper detection sensor 53, the carry roller 17A, a paper discharge roller 17B, a platen 14, and free rollers 18A and 18B.

The medium S to be printed is set at the paper supply tray 8. The medium S that has been set at the paper supply tray 8 is carried along the arrow A in the drawing by the paper supply roller 13, which has a substantially D-shaped cross-section, and is sent into the inkjet printer 1. The medium S that has been sent into the inkjet printer 1 is brought into contact with the paper detection sensor 53. This paper detection sensor 53 is positioned between the paper supply roller 13 and the carry roller 17A, so that it detects the medium S that has been supplied by the paper supply roller 13.

The medium S that has been detected by the paper detection sensor 53 is carried by the carry roller 17A one by one to the platen 14 on which printing is carried out. The free roller 18A is disposed at the position opposed to the carry roller 17A. The medium S is placed between the free roller 18A and the carry roller 17A such that the medium S is smoothly carried.

The medium S that has been sent onto the platen 14 is one by one printed with ink ejected from the head 21. The platen 14 is disposed so as to be opposed to the head 21 and supports the medium S to be printed from the below.

The medium S on which printing has been carried out is discharged by the paper discharge roller 17B one by one to the outside of the printer. The paper discharge roller 17B is driven in synchronization with the carry motor 15, and discharges the medium S to the outside of the printer by holding the medium S between the paper discharge roller 17B and the free roller 18B that is disposed so as to be opposed to this paper discharge roller 17B.

<System Configuration>

The following is a description concerning the system configuration of the inkjet printer 1. As shown in FIG. 4, the inkjet printer 1 is provided with a buffer memory 122, an image buffer 124, a controller 126, a main memory 127, a communication interface 129, a carriage motor controller 128, a carry controller 130, and a head drive section 132.

The communication interface 129 is used by the inkjet printer 1 to exchange data with an external computer 140 such as a personal computer. The communication interface 129 is connected to the external computer 140 such that wired or wireless communications are possible, and receives various types of data such as print data transmitted from the computer 140.

The various types of data such as print data received by the communication interface 129 is temporarily stored in the buffer memory 122. Furthermore, the print data stored in the buffer memory is sequentially stored in the image buffer 124. The print data stored in the image buffer 124 is sequentially sent to the head drive section 132. Furthermore, the main memory 127 is constituted by a ROM, a RAM, or an EEPROM for example. Various programs for controlling the inkjet printer 1 and various types of setting data, for example, are stored in the main memory 127.

The controller 126 reads out a control program and the setting data from the main memory 127 and performs overall control of the inkjet printer 1 in accordance with the control program and the various types of setting data. Furthermore, detection signals from various sensors such as a rotary encoder 134, the linear encoder 51, and the paper detection sensor 53 are input to the controller 126.

When various types of data such as print data that has been sent from the external computer 140 is received by the communication interface 129 and is stored in the buffer memory 122, the controller 126 reads out necessary information from among the stored data from the buffer memory 122. Based on the information that is read out, the controller 126 controls each of the carriage motor controller 128, the carry controller 130, and the head drive section 132, for example, in accordance with a control program while referencing output from the linear encoder 51 and the rotary encoder 134.

The carriage motor controller 128 controls the drive such as the rotation direction, the rotation number, and the torque of the carriage motor 42 in accordance with instructions from the controller 126. The carry controller 130 controls the drive of, for example, the carry motor 15 for rotatively driving the carry roller 17A in accordance with instructions from the controller 126.

The head drive section 132 controls the drive of the color nozzles provided at the head 21 in accordance with instructions from the controller 126 and based on print data stored in the image buffer 124.

In addition, the ink-jet printer 1 of the present embodiment is provided with a liquid ejection testing device 62 as a nozzle cleaning device configuration. The liquid ejection testing device 62 is a device for checking whether or not the nozzles arranged in the head 21 are ejecting ink properly. The liquid ejection testing device 62 is provided with a first detection section 82, a second detection section 84, a first A/D converter 88, and a second A/D converter 89. The liquid ejection testing device 62 is described in detail below.

<Head>

Figure 5:
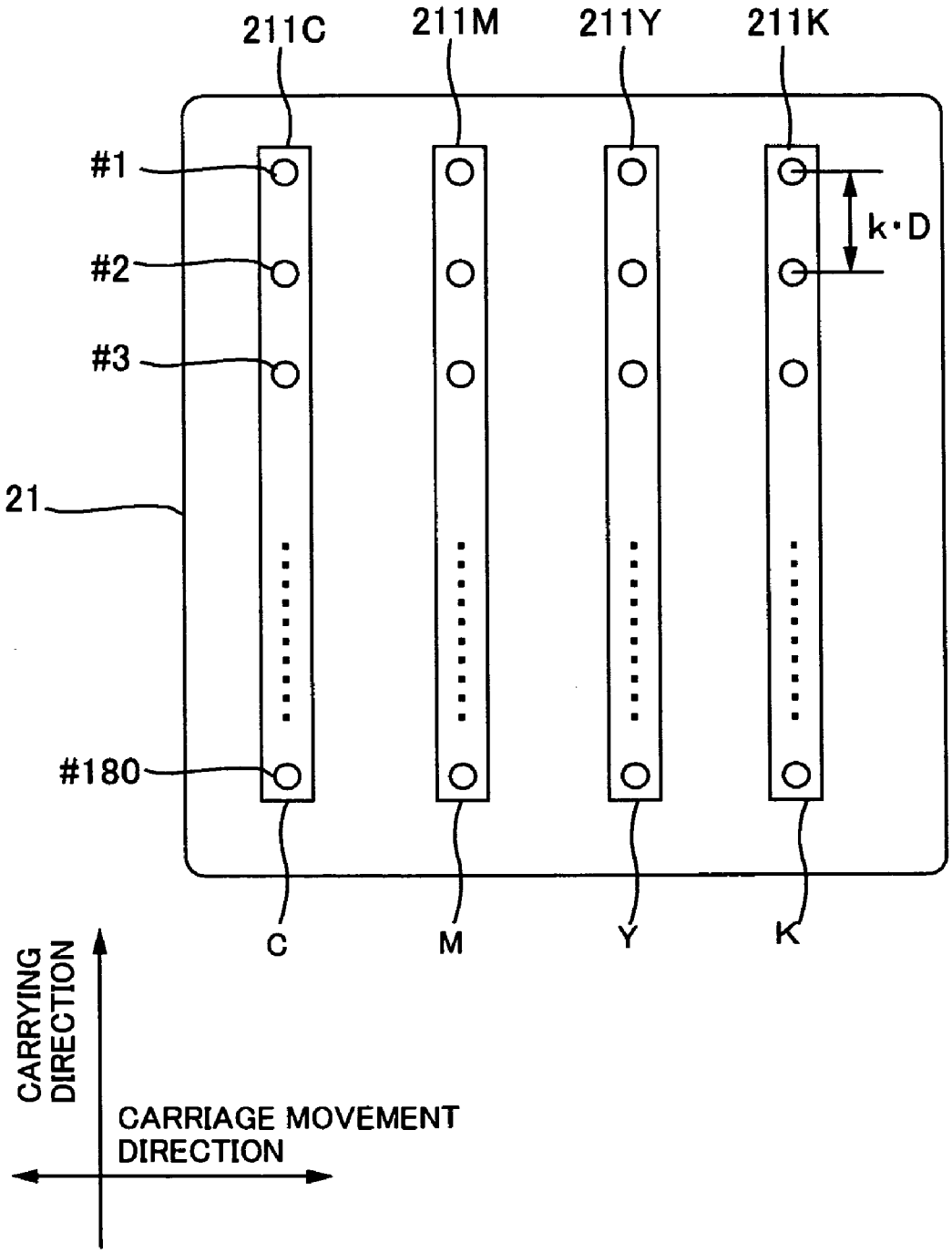
FIG. 5 is an explanatory diagram showing the arrangement of nozzles of a head.

FIG. 5 is a diagram showing the arrangement of the ink nozzles provided on the bottom surface portion of the head 21. As shown in this drawing, the bottom surface portion of the head 21 is provided with nozzle rows constituted by a plurality of nozzles #1 to #180 for each of the colors yellow (Y), magenta (M), cyan (C), and black (K), that is, a cyan nozzle row 211C, a magenta nozzle row 211M, a yellow nozzle row 211Y, and a black nozzle row 211K.

The nozzles #1 to #180 (corresponding to "liquid ejection nozzles") of each of the nozzle rows 211C, 211M, 211Y, and 211K are arranged linearly in single rows in a predetermined direction (here, the carrying direction of the medium S) with an interval between each of the rows. An interval (nozzle interval) between each of the nozzles #1 to #180 is set to "k·D" respectively. Here, "D" is the minimum dot pitch in the carrying direction (that is, the spacing at the highest resolution of the dots formed on the medium S). Also, "k" is an integer of 1 or more. For example, if the nozzle pitch is 120 dpi (1/120 inch), and the dot pitch in the carrying direction is 360 dpi (1/360), then k=3. The nozzle rows 211C, 211M, 211Y, and 211K are arranged in parallel with spaces therebetween in the movement direction (scanning direction) of the head 21. The nozzles #1 to #180 are provided with piezo elements (not shown) as drive elements for ejecting ink droplets.

The nozzles #1 to #180 in each of the nozzle rows 211C, 211M, 211Y, and 211K are arranged linearly in a predetermined direction. In this embodiment, when the head is normally installed, the nozzles #1 to #180 in each of the nozzle rows 211C, 211M, 211Y, and 211K are arranged in the carrying direction of the medium S. The nozzle rows 211C, 211M, 211Y, and 211K are arranged in parallel with spaces therebetween in the movement direction (scanning direction) of the head 21. The nozzles #1 to #180 are provided with piezo elements (not shown) as drive elements for ejecting ink droplets.

When a voltage of a predetermined duration is applied between electrodes provided at both ends of the piezo elements, the piezo elements expand for the duration of voltage application and deform a lateral wall of the ink channel. Accordingly, the volume of the ink channel is constricted according to the expansion of the piezo element, and ink corresponding to this amount of constriction becomes an ink droplet, which is ejected from the respective nozzles #1 to #180 of the color nozzle rows 211C, 211M, 211Y, and 211K.

<Drive Circuits>

Figure 6:
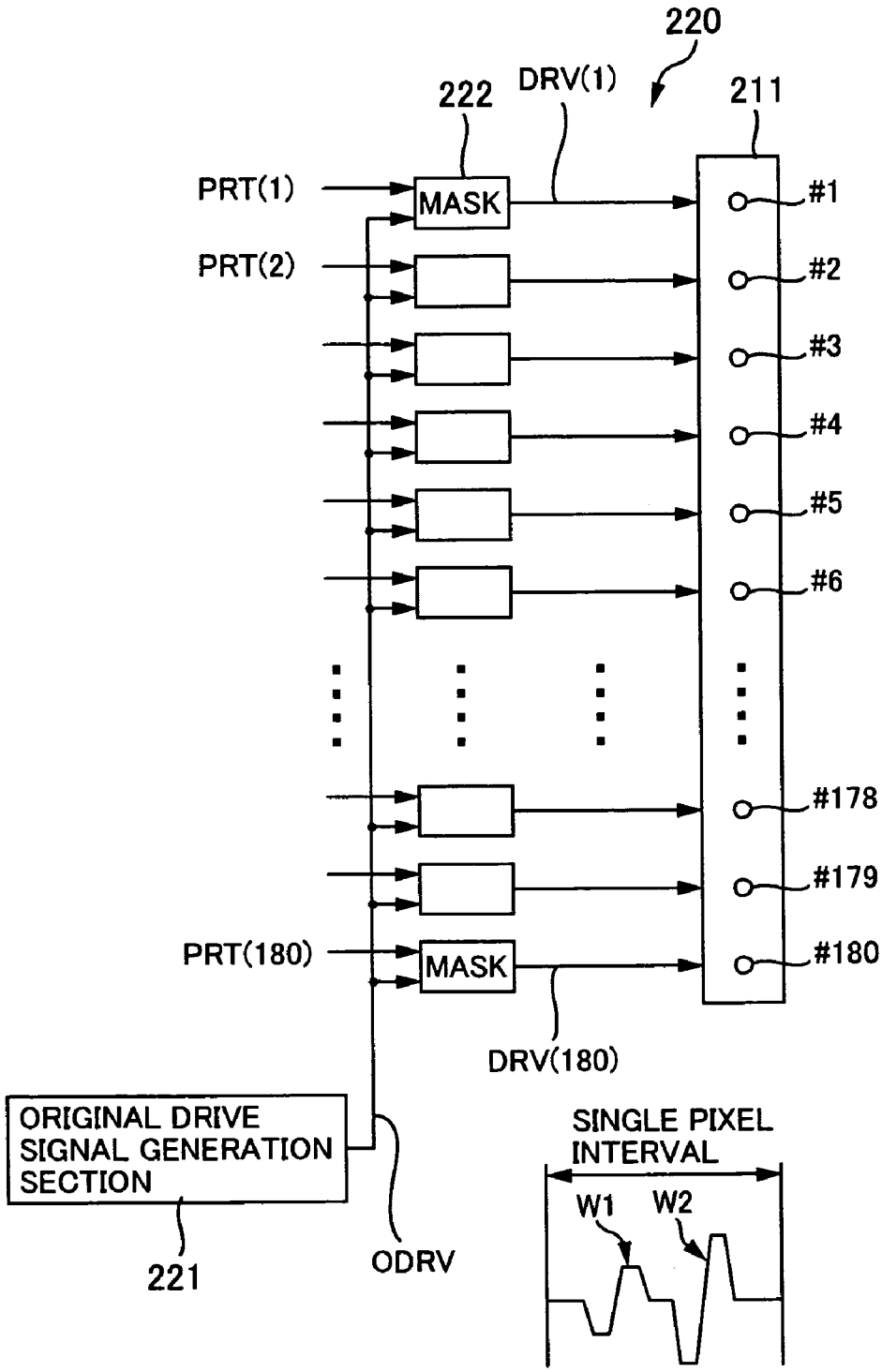
FIG. 6 is a diagram illustrating an example of a drive circuit of the head.

FIG. 6 shows a drive circuit 220 of the nozzles #1 to #180. As shown in FIG. 6, the drive circuit 220 is provided with an original drive signal generation section 221, and a plurality of mask circuits 222. The original drive signal generation section 221 creates an original drive signal ODRV that is shared by the nozzles #1 to #180. As shown in a lower portion of FIG. 6, the original drive signal ODRV is a signal that includes two pulses, a first pulse W1 and a second pulse W2 during the main scanning period of a single pixel (during the period that the carriage 41 crosses over a single pixel). The original drive signal ODRV created by the original drive signal generation section 221 is output to each mask circuit 222.

The mask circuits 222 are provided corresponding to the plurality of piezo elements for driving the nozzles #1 to #180 of the head 21. The mask circuits 222 receive the original drive signal ODRV from the original drive signal generation section 221 and also receive print signals PRT(i). The print signals PRT(i) are pixel data corresponding to pixels and are binary signals having 2-bit information corresponding to a single pixel. The bits respectively correspond to the first pulse W1 and the second pulse W2. The mask circuits 222 are gates for blocking the original drive signal ODRV or allowing it to pass depending on the level of the print signal PRT(i). That is, when the print signal PRT(i) is level "0," the pulse of the original drive signal ODRV is blocked, but when the print signal PRT(i) is level "1," the pulse corresponding to the original drive signal ODRV is allowed to pass as it is and is output to the piezo elements of the nozzles #1 to #180 as an actual drive signal DRV. The piezo elements of the nozzles #1 to #180 are driven by the actual drive signals DRV from the mask circuits 222 and eject ink.

<Signal Waveforms>

Figure 7:
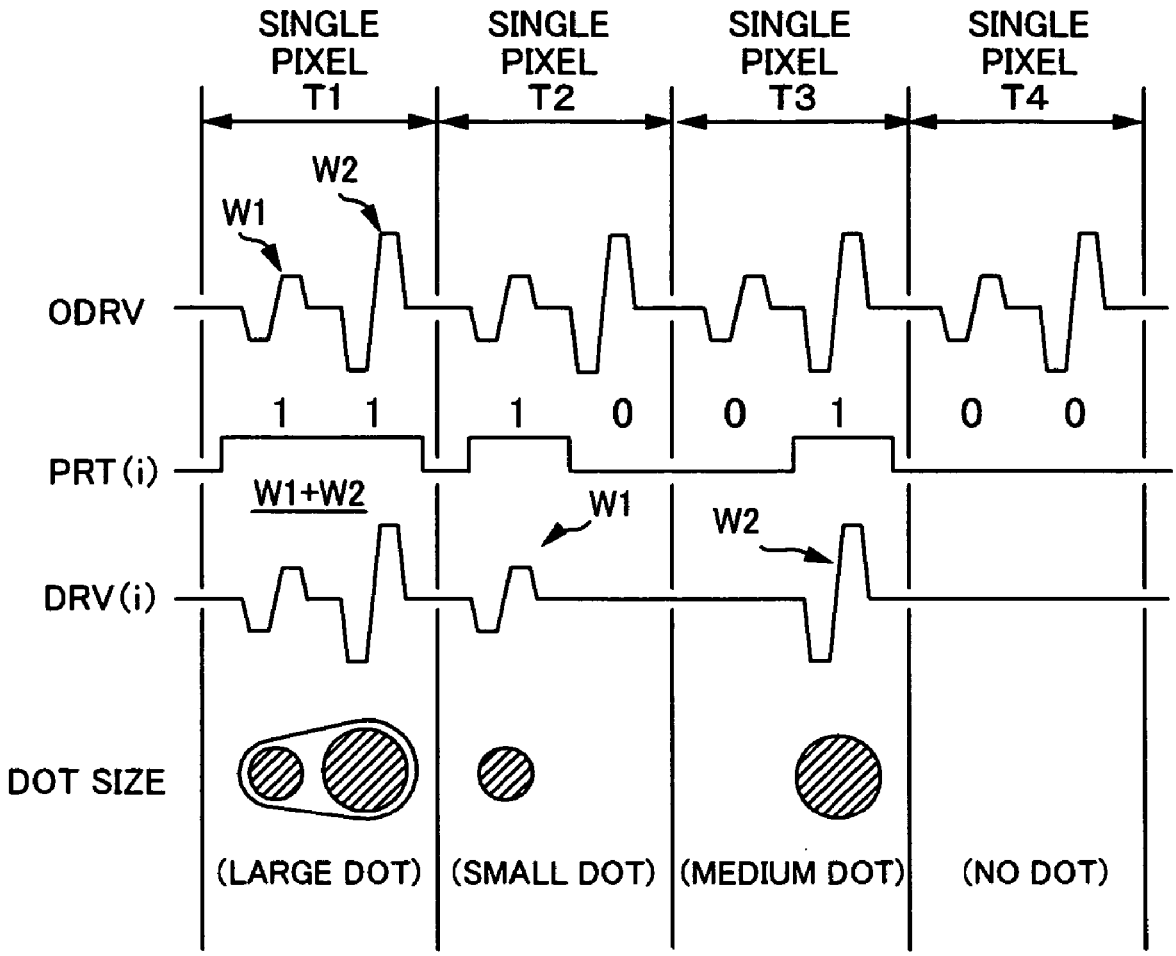
FIG. 7 is a timing chart of signals.

FIG. 7 is a timing chart of the original drive signal ODRV, the print signal PRT(i), and the actual drive signal DRV(i) indicating the operation of the original drive signal generation section 221. As shown in the diagram, the original drive signal ODRV generates a first pulse W1 and a second pulse W2 in that order during each pixel interval T1, T2, T3, and T4. It should be noted that "pixel interval" has the same meaning as the movement interval of the carriage 41 for a single pixel.

When the print signal PRT(i) corresponds to the two bits of pixel data "10" then only the first pulse W1 is output in the first half of the single pixel interval. Accordingly, a small ink droplet is ejected from the nozzles #1 to #180, forming small-sized dots (small dots) on the medium S. When the print signal PRT(i) corresponds to the two bits of pixel data "01", then only the second pulse W2 is output in the second half of the single pixel interval. Accordingly, a medium-sized ink droplet is ejected from the nozzles #1 to #180, forming medium-sized dots (medium dots) on the medium S. Furthermore, when the print signal PRT(i) corresponds to the two bits of pixel data "11" then the first pulse W1 and the second pulse W2 are output during the single pixel interval. Accordingly, a large ink droplet is ejected from the nozzles #1 to #180, forming large-sized dots (large dots) on the medium S. As described above, the actual drive signal DRV(i) in a single pixel interval is shaped so that it may have three different waveforms corresponding to three different values of the print signal PRT(i), and based on these signals, the head 21 can form dots of three different sizes and can adjust the amount of ejected ink between pixel intervals. Furthermore, when the print signal PRT(i) corresponds to the two bits of pixel data "00" as in the pixel interval T4, then no ink droplet is ejected from the nozzles #1 to #180 and no dots are formed on the medium S.

In the inkjet printer 1 according to the present embodiment, the drive circuits 220 of the nozzles #1 to #180 are arranged separately for each of the nozzle rows 211, that is, for each of the colors yellow (Y), magenta (M), cyan (C), and black (K) such that piezo elements are driven separately for each of the nozzles #1 to #180 of the nozzle rows 211.

Printing Operation

Figure 8:
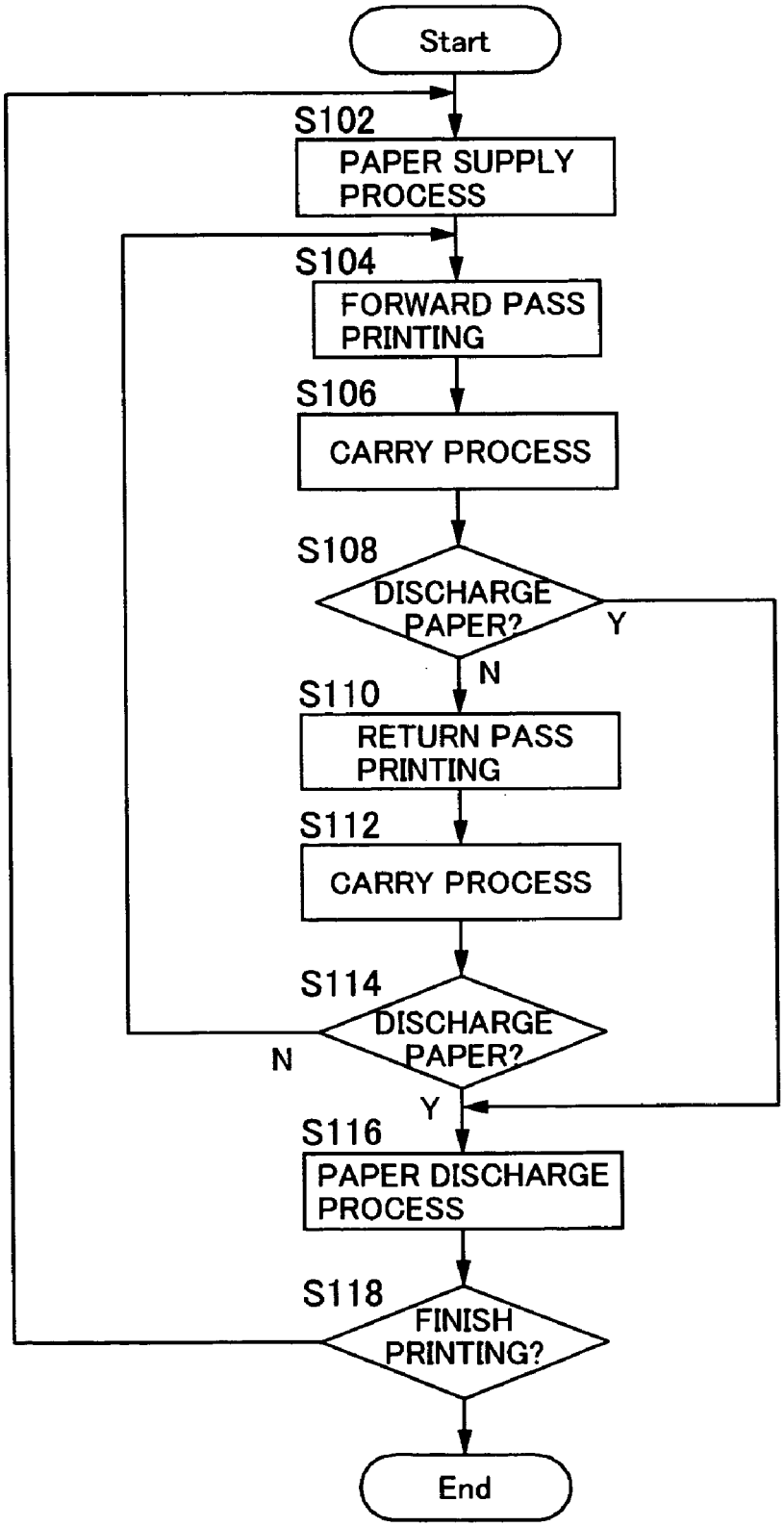
FIG. 8 is a flowchart illustrating an example of a printing process.

The following is a description concerning a printing operation of the above-described inkjet printer 1. Here, an example of "bidirectional printing" is described. FIG. 8 is a flowchart showing an example of a processing procedure of the printing operation of the inkjet printer 1. The processes described below are each performed when the controller 126 reads out programs from the main memory 127 and controls each of the carriage motor controller 128, the carry controller 130, and the head drive section 132, for example, in accordance with the programs.

When the controller 126 receives print data from the computer 140, in order to perform printing in accordance with the print data, first, a paper supply process is carried out (S102). The paper supply process is a process where a medium S to be printed is supplied into the inkjet printer 1 and is carried to a print start position (also referred to as "indexing position"). The controller 126 rotates the paper supply roller 13 to send the medium S to be printed up to the carry roller 17A. The controller 126 rotates the carry roller 17A to position the medium S that has been sent from the paper supply roller 13 at the print start position (upstream on the platen 14).

Next, the controller 126 carries out a printing process in which the medium S is printed by driving the carriage motor 42 via the carriage motor controller 128 and moving the carriage 41 relative to the medium S. Here, first, forward pass printing in which ink is ejected from the head 21 is performed while moving the carriage 41 in one direction along the guide rail 46 (S104). The controller 126 moves the carriage 41 by driving the carriage motor 42, and ejects ink by driving the head 21 in accordance with the print data. The ink ejected from the head 21 reaches the medium S, to be formed as dots.

After performing printing in this manner, next the controller 126 carries out a carrying process for carrying the medium S by a predetermined amount (S106). In this process, the controller 126 rotates the carry roller 17A by driving the carry motor 15 via the carry controller 130, and carries the medium S only by a predetermined amount in the carrying direction relative to the head 21. With this carrying process, the head 21 can print onto a region that is different from the region printed on before.

After carrying out the carrying process in this manner, the controller 126 carries out a paper discharge determination in which it is determined whether or not to discharge the paper (S108). Herein, the controller 126 carries out a paper discharge process if there is no more data to be printed onto the medium S that is currently being printed (S116). On the other hand, if there is other data left to be printed onto the medium S that is currently being printed, then the controller 126 carries out return pass printing without performing a paper discharge process (S110). In this return pass printing, printing is performed while moving the carriage 41 along the guide rail 46 in the opposite direction to the previous forward pass printing. Also here, the controller 126 moves the carriage 41 by rotatively driving the carriage motor 42 in the opposite direction as before via the carriage motor controller 128, ejects ink by driving the head 21 based on the print data, and performs printing.

After return pass printing has been performed, a carrying process is carried out (S112), and then a paper discharge determination is carried out (S114). Here, if there is other data left to be printed onto the medium S that is currently being printed, then no paper discharge process is carried out, the procedure returns to step S104, and forward pass printing is performed again (S104). On the other hand, a paper discharge process is carried out if there is no more data to be printed onto the medium S that is currently being printed (S116).

After the paper discharge process has been carried out, a print termination determination is carried out in which it is determined whether or not to terminate printing (S118). Here, based on the print data from the computer 140, it is checked whether or not there is a further medium S to be printed left. If there is a further medium S to be printed left, then the procedure returns to step S102, another paper supply process is carried out, and printing is started. On the other hand, if there is no medium S to be printed left, then the printing process is terminated.

Liquid ejection Testing Device

The inkjet printer 1 (liquid ejection apparatus, printing apparatus) according to the present embodiment is provided with a liquid ejection testing device 62 as a configuration of a nozzle cleaning device that cleans the nozzles #1 to #180 of the nozzle rows 211C, 211M, 211Y, and 211K. The liquid ejection testing device 62 is described in detail.

Overview of Liquid Ejection Testing Device

Figure 9:
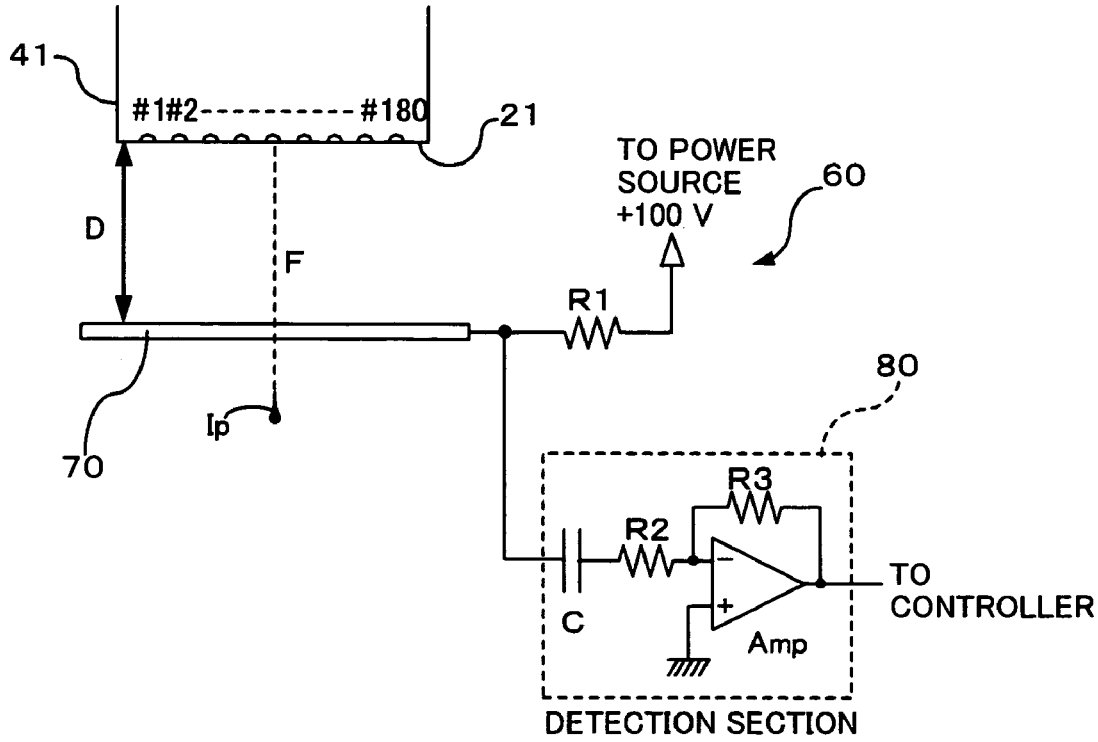
FIG. 9 is an explanatory diagram describing a basic configuration of the liquid ejection testing device.
Figure 10:
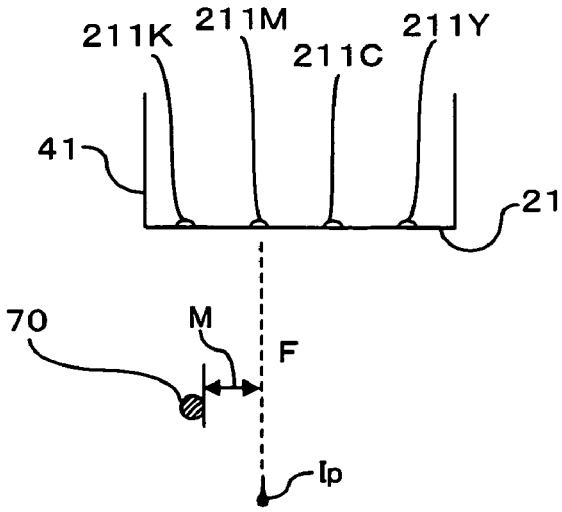
FIG. 10 is an explanatory diagram describing a testing principle of the liquid ejection testing device.

FIGS. 9 and 10 schematically outline a basic configuration 60 and a testing method of the liquid ejection testing device 62 that is equipped in the inkjet printer 1 according to the present embodiment. FIG. 9 is an explanatory diagram describing the basic configuration 60 of the liquid ejection testing device 62. FIG. 10 is an explanatory diagram for describing a testing principle of the liquid ejection testing device 62.

As shown in FIG. 9, the basic configuration 60 is provided with a detection member 70 arranged in a position that can be opposed to the head 21 and a detection section 80 connected to the detection member 70. The detection member 70 is made of a wire rod having the conductivity of a metal or the like and is arranged parallel to the head 21 extending in a tensioned state. The detection member 70 is arranged such that it can be opposed to the head 21 in a non-contact state with an interval D open between it and the head 21 when the carriage 41 moves. The interval D between the head 21 and the detection member 70 is set to 1 mm for example.

A power source (not shown) is connected to the detection member 70 through a protective resistor R1. A high voltage of +100V (volts) for example is applied to the detection member 70 from the power source.

On the other hand, the detection section 80 is configured to detect electric current produced in the detection member 70. In the present embodiment, the detection section 80 is constituted by a detection circuit provided with a capacitor C, an input resistor R2, a feedback resistor R3, and an operational amplifier Amp. When a current fluctuation is produced in the detection member 70, the capacitor C fulfills a role of inputting the current fluctuation as an electrical signal to the operational amplifier Amp via the input resistor R2. The operational amplifier Amp fulfills a role as an amplifier circuit that amplifies and outputs signals that input through the capacitor C. The output signal from the operational amplifier Amp undergoes A/D conversion from an analog signal to a digital signal by an A/D converter (the first A/D converter 88 and the second A/D converter 89, see FIG. 4) and is transmitted toward the controller 126 in an appropriate form as a digital signal such as digital data.

When actual ejection testing is carried out, an operation is executed in which ink is ejected separately from the respective nozzles #1 to #180 of the head 21 toward the detection member 70 or the vicinity thereof. FIG. 10 illustrates the manner in which ink is ejected from a given nozzle of the head 21 toward the vicinity of the detection member 70. Here, an ink droplet Ip is ejected from the respective nozzles #1 to #180 of the head 21 one time each, that is, one droplet at a time.

At this time, an extremely high voltage of 100 V (volts) for example is applied to the detection member 70 by a supply voltage from the power source. Thus, an extremely strong electric field is formed between the head 21 and the detection member 70. When an ink droplet Ip is ejected from the nozzles #1 to #180 under these conditions, the ejected ink droplet Ip becomes electrically charged.

The charged ink droplet Ip which has been ejected from the nozzles #1 to #180, passes the vicinity of the detection member 70. When the charged ink droplet Ip passes the vicinity of the detection member 70, an induced current is produced in the detection member 70. When the charged ink droplet Ip approaches the detection member 70, the induced current is produced along a predetermined direction in the detection member 70. It should be noted that the induced current is considered to be produced by an influence of electrostatic induction due to the approach of the charged ink droplet Ip.

At this time, the induced current is produced in the detection member 70 which is of a magnitude corresponding to a distance M between the detection member 70 and a flight path F of the ink droplet Ip. That is to say, the closer the flight path F of the ink droplet Ip to the detection member 70, the greater the magnitude of the induced current produced in the detection member 70. Also, as the flight path F of the ink droplet Ip becomes more distant from the detection member 70, the magnitude of the induced current produced in the detection member 70 becomes smaller.

When an induced current is produced in the detection member 70 in this way corresponding to the distance between the detection member 70 and the flight path F of the ink droplet Ip, fluctuation is created in the electric current that is inputted to the detection section 80 and this current fluctuation is inputted to the operational amplifier Amp as an electrical signal via the input resistor R2. Then, the signal that is inputted to the operational amplifier Amp is amplified and outputted toward the controller 126 and the like as a detection signal. In this way, when an induced current is produced in the detection member 70, this is detected by the detection section 80, and the detection signal thereof undergoes conversion from an analog signal to digital data or the like through an A/D converter (the first A/D converter 88 and the second A/D converter 89, see FIG. 4) and is outputted toward the controller 126.

On the other hand, if an ink droplet Ip is not ejected from the nozzles #1 to #180, then no charged ink droplet Ip passes the vicinity of the detection member 70, and therefore a sufficient induced current is not produced in the detection member 70. Thus, the detection section 80 does not output a sufficient detection signal.

The controller 126 obtains the magnitude of the induced current produced in the detection member 70 from the signal level of the detection signal outputted from the detection section 80 and determines whether or not ejection of the ink droplet Ip by the nozzles #1 to #180 has been carried out properly based on the magnitude of the induced current. Here, for example, the controller 126 compares the magnitude of the obtained induced current and a predetermined reference value to determine whether or not ejection of the ink droplet Ip from the nozzles #1 to #180 has been carried out. Also, the controller 126 determines from the magnitude of the obtained induced current whether or not the ejection direction of the ink droplet Ip is correct. Additionally, the controller 126 may determine whether or not the ejection velocity of the ink droplet Ip from the nozzles #1 to #180 is correct by obtaining a timing or the like by which the induced current is produced in the detection member 70.

It should be noted that it is preferable for the size of the ink droplet Ip ejected from the nozzles #1 to #180 during ejection testing to be as big as possible. That is to say, it is preferable that this is set to substantially the same size as the largest size dot of the inkjet printer 1 in the present embodiment, for example, the ink droplet Ip ejected in order to form a large dot (pixel data "11") on the medium S. This is because the larger the size of the ink droplet Ip ejected from the nozzles #1 to

#180, the greater the amount of electric charge by which the ink droplet Ip ejected from the nozzles #1 to #180 is charged. In this way, the larger the amount of electric charge in the ink droplet Ip, the easier it is for induced currents to be produced in the detection member 70. In this way, the induced current in the detection member 70 can be made easier to detect in the detection section 80.

Of course, it is not absolutely necessary for the size of the ink droplet Ip ejected during ejection testing to be set to the size for forming the largest size dot (large dot, etc.), and it is also possible to eject a large-sized ink droplet Ip especially only during ejection testing and it is also possible to eject a small-sized ink droplet Ip.

Furthermore, it is not absolutely necessary that the ink droplet Ip ejected from the nozzles #1 to #180 is ejected toward the vicinity of the detection member 70, but it may be ejected so as to make contact with the detection member 70. In this case, since an induced current is produced in the detection member 70 due to the ink droplet Ip approaching the detection member 70, the presence or absence of ejection of the ink droplet Ip can be examined.

Furthermore, the number of ink droplets Ip ejected from the nozzles #1 to #180 is not necessarily limited to a single droplet. That is, ink droplets Ip may be ejected successively a plurality of times from the nozzles #1 to #180. By successively ejecting the ink droplets Ip a plurality of times in this way, the number of ink droplets Ip that pass the vicinity of the detection member 70 is increased, thus an induced current can be more easily produced in the detection member 70. Accordingly, detection of the induced current by the detection section 80 can be achieved more easily.

<Actual Detection Waveforms>

Figure 11:
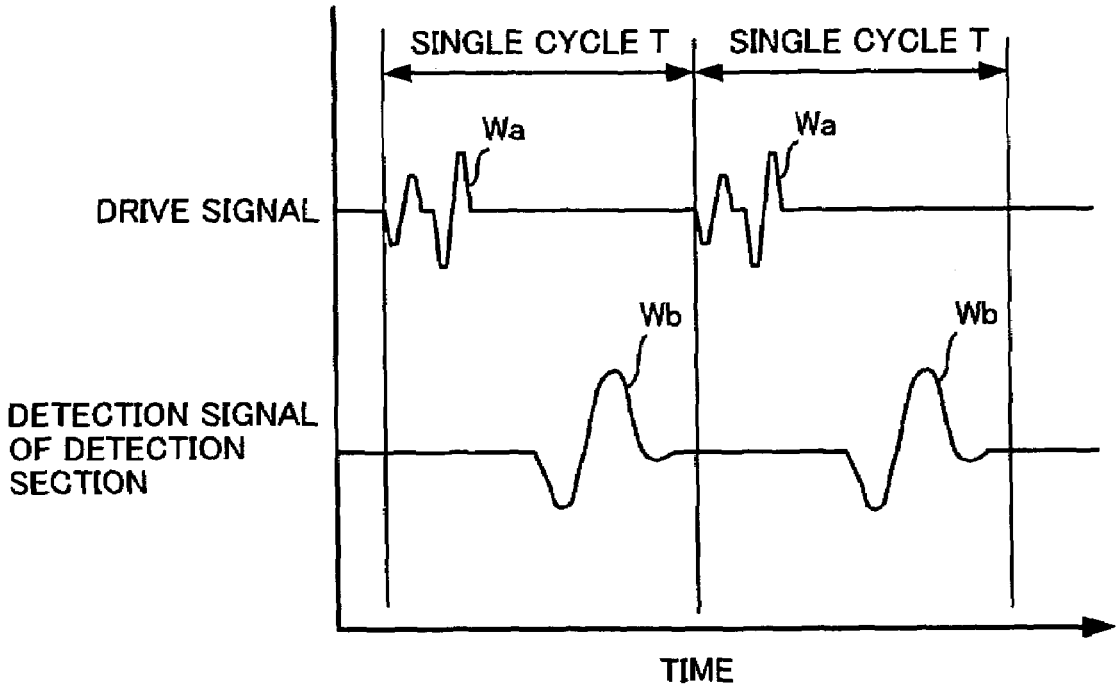
FIG. 11 is an explanatory diagram of drive signals for ejecting ink and detection signals of the detection section.

FIG. 11 shows the waveforms of the drive signal outputted to the piezo elements provided corresponding to the nozzles #1 to #180 to eject ink during ejection testing and the detection signal from the detection section 80. The upper waveform in this diagram shows the waveform of the drive signal and the lower waveform in the diagram shows the waveform of the detection signal of the detection section 80. When carrying out ejection testing for a particular nozzle, a drive pulse Wa for ejecting an ink droplet one time, that is, one droplet is inputted as a drive signal to the piezo element provided in the nozzle targeted for testing as shown in the drawing.

On the one hand, when ink is ejected properly from the nozzle targeted for testing by this drive signal, an induced current is produced in the detection member 70 by the ink droplet Ip ejected from the nozzle targeted for testing, and when this induced current is detected by the detection section 80, a pulse Wb of a waveform that oscillates up and down as shown in the diagram is outputted from the detection section 80 as a detection signal. Since there is a slight time gap until the induced current that is produced is detected and outputted by the detection section 80, along with the time taken corresponding to from when the ink droplet Ip from the nozzle targeted for testing is ejected until the induced current is produced, the rising edge of the pulse of the detection signal outputted from the detection section 80 is delayed compared to the drive pulse of the drive signal.

On the other hand, if ink is not ejected properly from the nozzles #1 to #180, then no induced current is produced in the detection member 70. As a result, the pulse Wb of the waveform shown in the diagram will not appear clearly in the detection signal of the detection section 80.

The magnitude of the pulse Wb of the detection signal from the detection section 80 varies in response to the distance between the detection member 70 and the flight path F of the ink droplet Ip. This is because the magnitude of the induced current produced in the detection member 70 varies in response to the distance M between the detection member 70 and the flight path F of the ink droplet Ip.

Figure 12A:
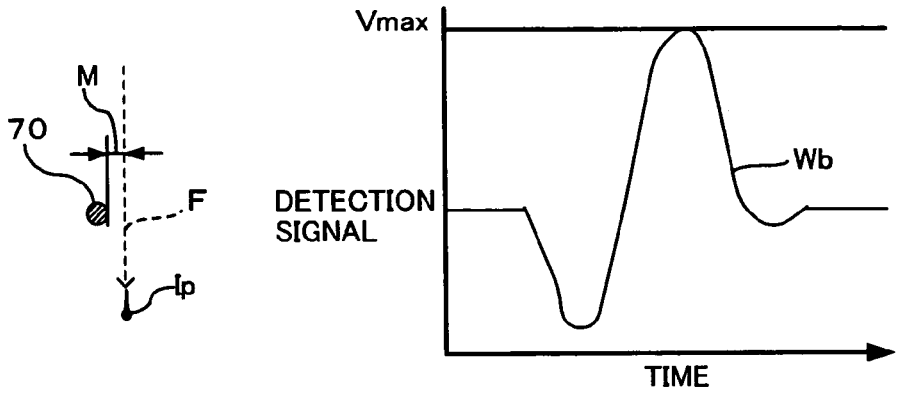
FIG. 12A is a diagram showing when a flight path of an ink droplet is close to a detection member.
Figure 12B:
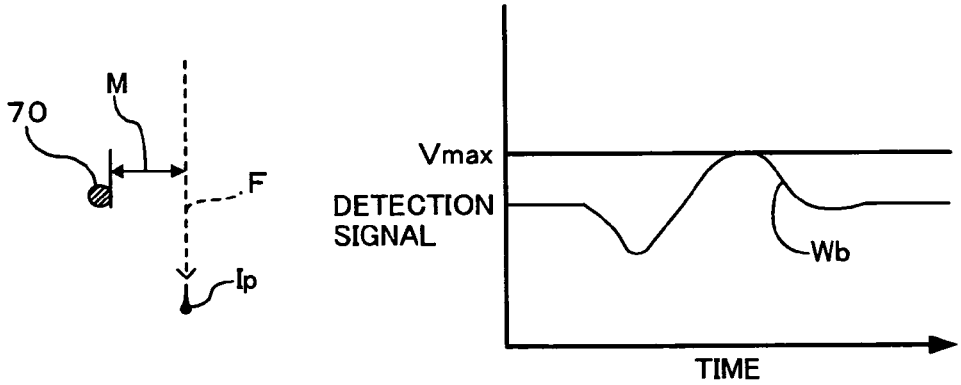
FIG. 12B is a diagram showing when a distance between the flight path of an ink droplet and the detection member is appropriate.
Figure 12C:
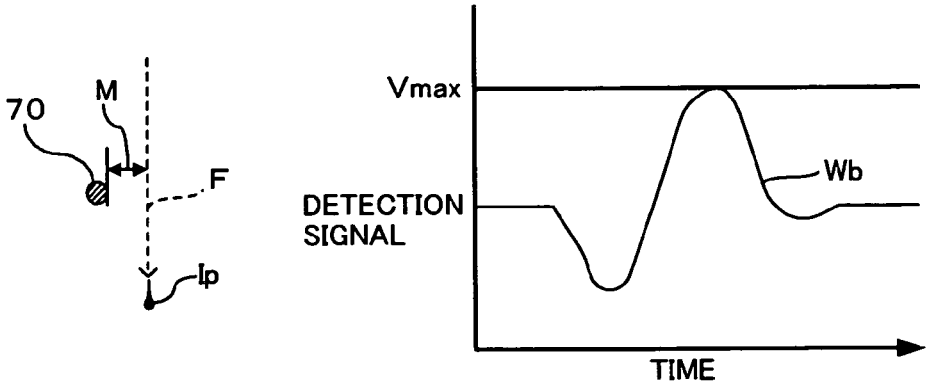
FIG. 12C is a diagram showing when a flight path of an ink droplet is distant from the detection member.

FIGS. 12A, 12B, and 12C show a relation between the distance M between the detection member 70 and the flight path F of the ink droplet Ip and the waveform of the detection signal from the detection section 80. FIG. 12A shows when the distance M between the flight path F of the ink droplet Ip and the detection member 70 is extremely small. FIG. 12B shows when the distance M between the flight path F of the ink droplet Ip and the detection member 70 is large. FIG. 12C shows when the distance M between the flight path F of the ink droplet Ip and the detection member 70 is substantially midway.

As shown in FIG. 12A, when the flight path F of the ink droplet Ip is near the detection member 70, the magnitude of the pulse Wb produced in the detection signal from the detection section 80 becomes extremely large. Thus, a peak value Vmax obtained from the detection signal is extremely large. On the other hand, when the flight path F of the ink droplet Ip is distant from the detection member 70, the magnitude of the pulse Wb produced in the detection signal from the detection section 80 becomes extremely small as shown in FIG. 12B, and the peak value Vmax obtained from the detection signal is small. Furthermore, when the distance between the flight path F of the ink droplet Ip and the detection member 70 is substantially midway, the magnitude of the pulse Wb produced in the detection signal from the detection section 80 also becomes substantially midway as shown in FIG. 12C, and the peak value Vmax obtained from the detection signal is substantially midway.

In this way, the distance M between the flight path F of the ink droplet Ip and the detection member 70 can be detected from the peak value of the pulse Wb produced in the detection signal from the detection section 80. Thus, the ejection direction of the ink droplets Ip from the nozzles #1 to #180 can be determined.

It should be noted that ejection testing can be carried out continuously for a plurality of nozzles as a group, for example, the nozzles in one row of nozzles, namely the 180 nozzles of the nozzles #1 to #180. At this time, as shown in FIG. 11, the drive signal is of a form in which the drive pulse for ejecting an ink droplet Ip targeted for testing in one-time (one droplet) are repetitively outputted in a predetermined cycle T. As also shown in FIG. 11, the detection signals of the detection section 80 are of a form in which the pulses Wb are formed in the predetermined cycle T as long as the ink is ejected properly from the nozzles #1 to #180 corresponding to the drive signals. Here, the predetermined cycle T is set as appropriate in reference to a time from when the drive pulse Wa is outputted for the nozzles #1 to #180 that are targeted for testing until the pulse Wb appears in the detection signal of the detection section 80. Testing can be executed separately for each of the nozzles #1 to #180 by separately checking the detection signal from the detection section 80 in each cycle T.

Configuration of the Liquid Ejection Testing Device of the Present Embodiment The liquid ejection testing device according to the present embodiment is provided with two systems of the detection member 70 in which an induced current is produced by the ink droplets Ip respectively ejected from the nozzles #1 to #180 and the detection section 80 that detects the induced current produced in the detection member 70. The controller 126 determines whether or not the ejection of the ink droplets Ip from the nozzles #1 to #180 is being carried out properly based on the magnitude of the induced current obtained by the two systems of the detection member 70 and the detection section 80.

Figure 13:
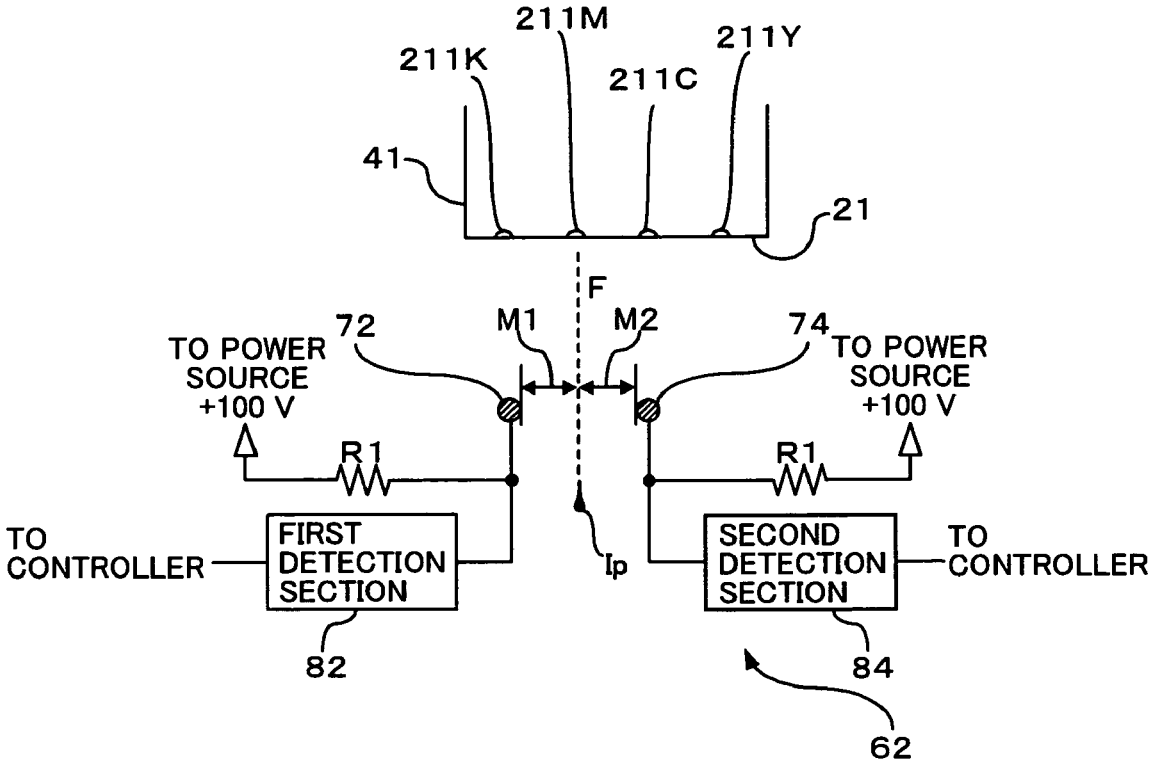
FIG. 13 is an explanatory diagram describing an outline of a configuration of the liquid ejection testing device.

FIG. 13 illustrates an example configuration of the liquid ejection testing device 62 according to the present embodiment. The liquid ejection testing device 62 is provided with a first detection member 72 and a second detection member 74 as detection members 70 in which an induced current is produced by the ink droplets Ip respectively ejected from the nozzles #1 to #180. Furthermore, the liquid ejection testing device 62 is provided with a first detection section 82 and a second detection section 84 as detection sections 80 that detect the induced current produced in the detection members 70. The first detection section 82 detects the induced current produced in the first detection member 72. The second detection section 84 detects the induced current produced in the second detection member 74.

As shown in the diagram, the first detection member 72 and the second detection member 74 are respectively arranged in parallel and so they can be opposed to the head 21. Furthermore, here the first detection member 72 and the second detection member 74 are arranged in parallel to each other with an interval therebetween.

The first detection member 72 and the second detection member 74 are connected to power sources (not shown) via respective protective resistors R1 and a high voltage of +100 V (volts) for example is applied to them. Furthermore, the first detection member 72 and the second detection member 74 are connected to the first detection section 82 and the second detection section 84 that detect the induced currents respectively produced in the first detection member 72 and the second detection member 74. The first detection section 82 and the second detection section 84 respectively have the same configuration as the configuration of the detection section 80 described in FIG. 9.

When the respective ink droplets Ip are ejected from the nozzles #1 to #180, induced currents are produced respectively in the first detection member 72 and the second detection member 74. Here, the induced current produced in the first detection member 72 is of a magnitude corresponding to a distance M1 between the first detection member 72 and the flight path F of the ink droplet Ip. The induced current produced in the second detection member 74 is of a magnitude corresponding to a distance M2 between the second detection member 74 and the flight path F of the ink droplet Ip. That is, if the distance M1 or the distance M2 between the first detection member 72 or the second detection member 74 and the flight path F of the ink droplet Ip is small, then a large induced current is produced in the first detection member 72 or the second detection member 74. Further, if the distance M1 or the distance M2 between the first detection member 72 or the second detection member 74 and the flight path F of the ink droplet Ip is large, then a small induced current is produced in the first detection member 72 or the second detection member 74.

The first detection section 82 and the second detection section 84 detect the induced current produced in the first detection member 72 or the second detection member 74 and output the magnitude of the detected induced current as a detection signal to the controller 126. In the present embodiment, the detection signals outputted from the first detection section 82 and the second detection section 84 are respectively inputted to the first A/D converter 88 or the second A/D converter 89 (see FIG. 4), then undergo conversion from an analog signal to a digital signal (digital data or the like) by the first A/D converter 88 or the second A/D converter 89 and are inputted to the controller 126.

Determination of Presence or Absence of Ejection

Figure 14:
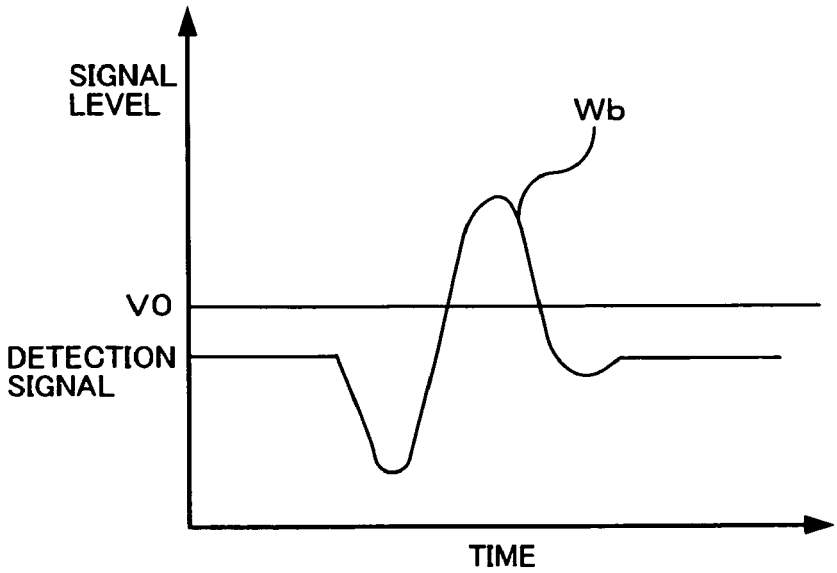
FIG. 14 is an explanatory diagram describing an example of a method for determining the presence or absence of ejection.

Next, a method for determining the presence or absence of ejection using the controller 126 is described. It should be noted that here the controller 126 corresponds to a "first determination section." FIG. 14 illustrates an example of a method for determining, using the controller 126, the presence or absence of ejection of the ink droplet Ip from the nozzles #1 to #180. Here the controller 126 conducts determination based on the magnitude of the induced current produced respectively in the two detection members, namely, the first detection member 72 and the second detection member 74, that is, the detection signals outputted respectively from the first detection section 82 and the second detection section 84.

When the ink droplets Ip are ejected from the nozzles #1 to #180, induced currents are produced in the first detection member 72 and the second detection member 74. Thus, as shown in the diagram, the pulse Wb is produced in the detection signals from the first detection section 82 and the second detection section 84. For this reason, the signal level of the detection signals from the first detection section 82 and the second detection section 84 rises and reaches a predetermined reference value V0. When the signal level of the detection signal has reached the predetermined reference value V0, the controller 126 judges that an induced current of a sufficient magnitude has been produced in the first detection member 72 or the second detection member 74 and determines that there is ejection of the ink droplet Ip from that nozzle.

On the other hand, when an ink droplet Ip is not ejected from the nozzles #1 to #180, since no induced current is produced in the first detection member 72 or the second detection member 74, no pulse Wb is produced in the detection signal from either of the first detection section 82 and the second detection section 84. Thus, the signal level of the detection signals from the first detection section 82 and the second detection section 84 do not rise and do not reach the predetermined reference value V0. Accordingly, the controller 126 judges that no induced current of a sufficient magnitude has been produced in the first detection member 72 or the second detection member 74 and determines that there is no ejection of an ink droplet Ip from that nozzle. Thus, the controller 126 determines whether or not ink droplets Ip have been ejected from the nozzles #1 to #180 based on the detection signals outputted from the first detection section 82 and the second detection section 84.

It should be noted that the predetermined reference value V0 is set to an appropriate value so that error is not produced in the ejection testing. Furthermore, information relating to the predetermined reference value V0 is stored as data in an appropriate storage section, for example a memory such as the main memory 127. In comparing the magnitude of the detection signal and the predetermined reference value V0, the controller 126 obtains information relating to the predetermined reference value V0 from an appropriate storage section such as the main memory 127.

Figure 15:
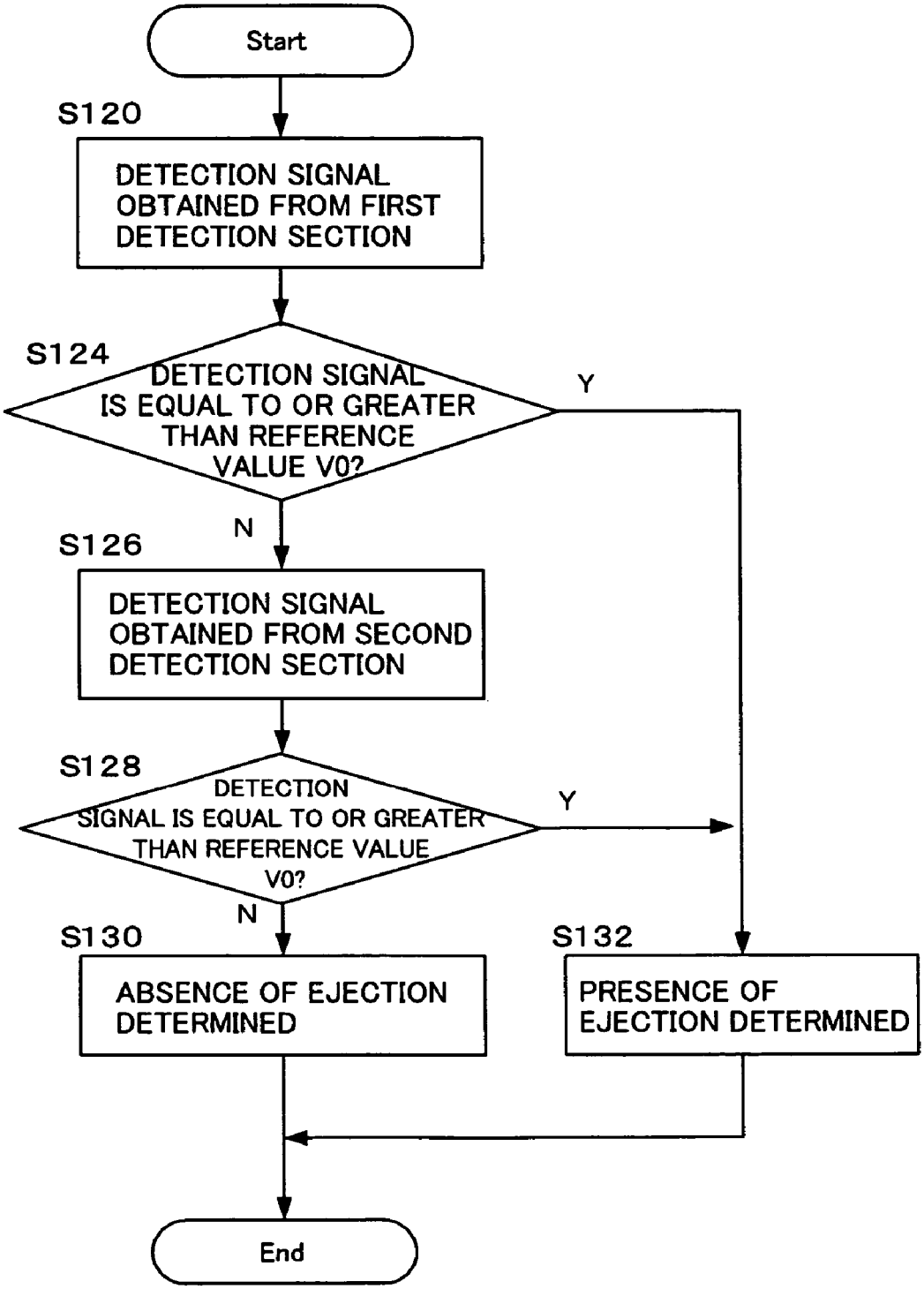
FIG. 15 is a flowchart illustrating an example of a procedure for determining the presence or absence of ejection.

FIG. 15 is a flowchart showing an example of a procedure for determining the presence or absence of ejection by the controller 126. Here, the controller 126 first obtains the detection signal that is outputted from the first detection section 82 (S120). Next, the controller 126 compares the obtained detection signal from the first detection section 82 and the predetermined reference value V0 (S124). When the comparison result is that the detection signal from the first detection section 82 has reached the predetermined reference value V0, the procedure proceeds to step S132 and the controller 126 determines that there is ejection of the ink droplet Ip in regard to the nozzle targeted for testing. After this, the controller 126 finishes processing.

On the other hand, when the detection signal from the first detection section 82 has not reached the predetermined reference value V0, the procedure next proceeds to step S126 and the controller 126 obtains the detection signal outputted from the second detection section 84 (S126).

Next, the controller 126 compares the obtained detection signal from the second detection section 84 and the predetermined reference value V0 (S128). Here, when the detection signal from the second detection section 84 has reached the predetermined reference value V0, the procedure proceeds to step S132 and the controller 126 determines that there is ejection of the ink droplet Ip in regard to the nozzle targeted for testing. After this, the controller 126 finishes processing.

On the other hand, when the detection signal from the second detection section 84 has not reached the predetermined reference value V0, since the detection signal from neither the first detection section 82 nor the second detection section 84 has reached the predetermined reference value V0, the controller 126 judges that ejection of the ink droplet Ip from the nozzle is not being carried out and determines that there is no ejection of the ink droplet Ip in regard to the nozzle targeted for testing (S130). After this, the controller 126 finishes processing.

Determination of Ejection Direction

Next, an example of a method for testing whether or not the ejection direction of the ink droplets Ip from the nozzles #1 to #180 is proper is described. Here, the determination of whether or not the ejection direction of the ink droplets Ip is proper is likewise carried out by the controller 126. It should be noted that here the controller 126 corresponds to a "second determination section." The controller 126 carries out the determination based on the detection signals from the first detection section 82 and the second detection section 84. Specifically, peak values of the detection signals respectively outputted from the first detection section 82 and the second detection section 84 are acquired, then a difference of these two peak values is obtained and a determination of whether or not the ejection direction of the ink droplets Ip from the nozzles #1 to #180 is proper is carried out based on this difference. The magnitude of the induced currents produced in the first detection member 72 and the second detection member 74 varies in response to the distance between the first detection member 72 or the second detection member 74 and the flight path F of the ink droplet Ip.

<Detection Signals of the Detection Sections>

Figure 16A:
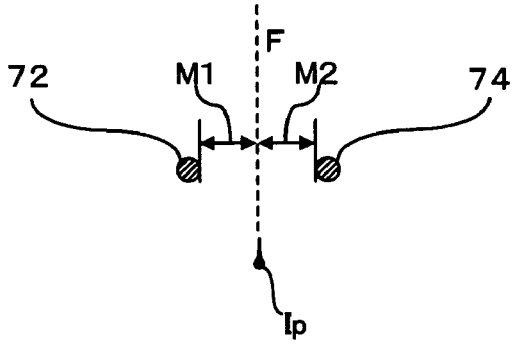
FIG. 16A is a diagram describing an example of a positional relation between a first detection member and a second detection member with the flight path of an ink droplet.
Figure 16B:
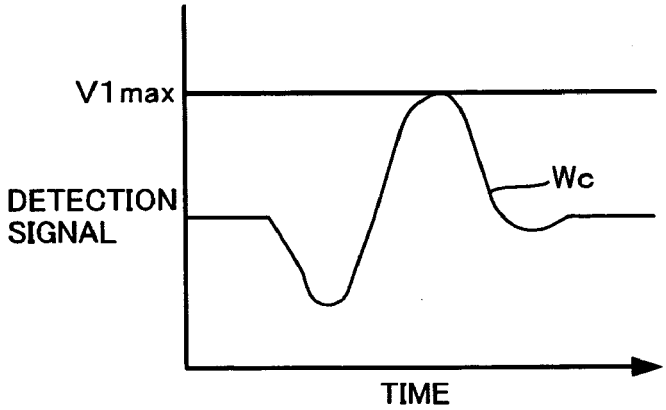
FIG. 16B is a diagram describing an example of a detection waveform of an induced current of the first detection member in FIG. 16A.
Figure 16C:
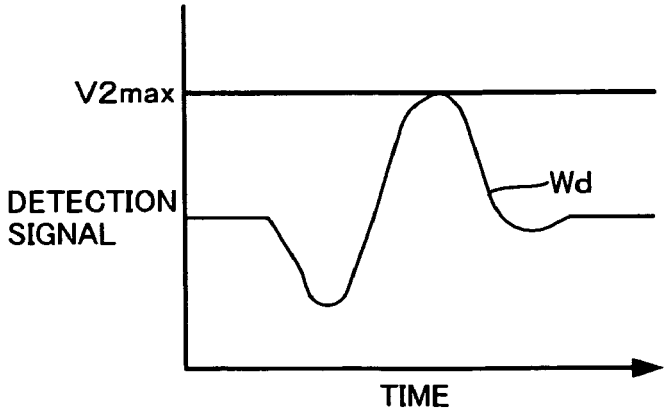
FIG. 16C is a diagram describing an example of a detection waveform of an induced current of the second detection member in FIG. 16A.
Figure 17A:
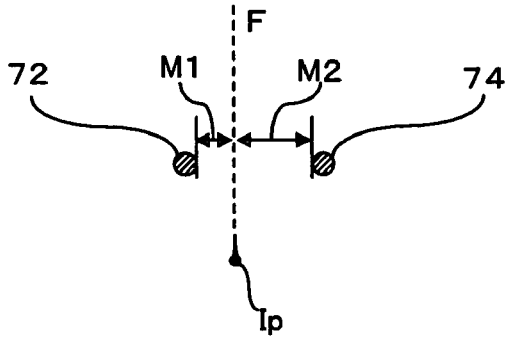
FIG. 17A is a diagram describing an example of a positional relation between a first detection member and a second detection member, and the flight path of an ink droplet.
Figure 17B:
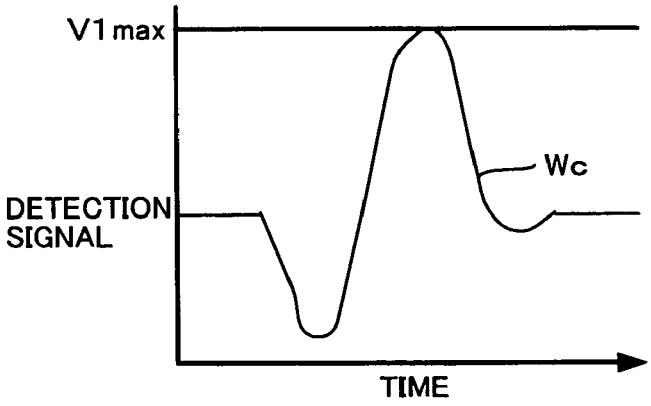
FIG. 17B is a diagram describing an example of a detection waveform of an induced current of the first detection member in FIG. 17A.
Figure 17C:
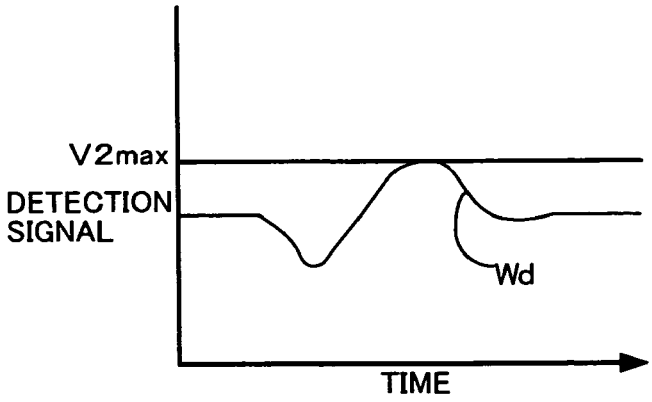
FIG. 17C is a diagram describing an example of a detection waveform of an induced current of the second detection member in FIG. 17A.
Figure 18A:
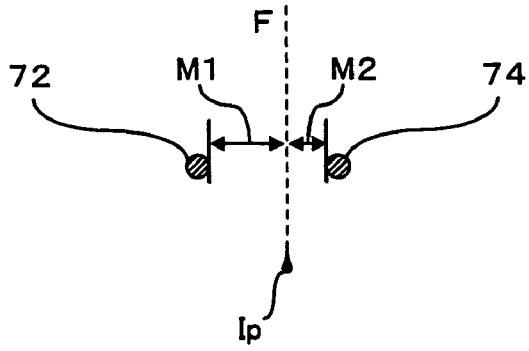
FIG. 18A is a diagram describing an example of a positional relation between a first detection member and a second detection member, and the flight path of an ink droplet.
Figure 18B:
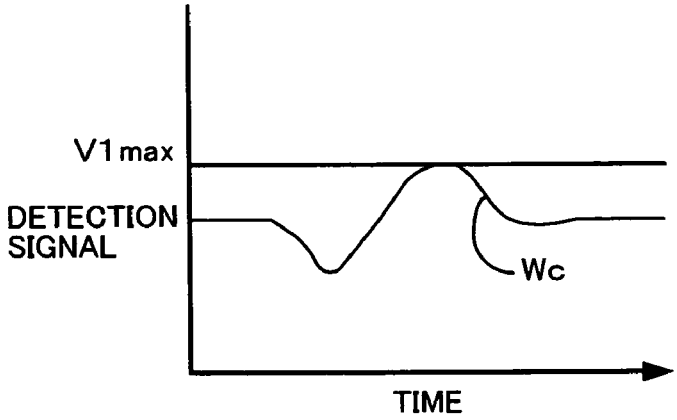
FIG. 18B is a diagram describing an example of a detection waveform of an induced current of the first detection member in FIG. 18A.
Figure 18C:
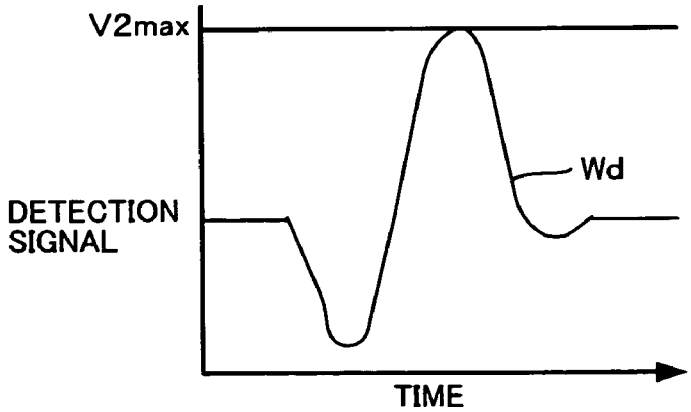
FIG. 18C is a diagram describing an example of a detection waveform of an induced current of the second detection member in FIG. 18A.

FIGS. 16A to 18C describe positional relationships between the first detection member 72 and the second detection member 74 and the flight path F of the ink droplet Ip, and the waveforms of the detection signals obtained from the first detection section 82 and the second detection section 84. FIGS. 16A to 16C describe when the flight path F of the ink droplet Ip is substantially in the center between the first detection member 72 and the second detection member 74. FIGS. 17A to 17C describe when the flight path F of the ink droplet Ip is toward the first detection member 72 side. FIGS. 18A to 18C describe when the flight path F of the ink droplet Ip is toward the second detection member 74 side. FIGS. 16A, 17A, and 18A respectively illustrate positional relationships between the flight path F of the ink droplet Ip and the first detection member 72 and the second detection member 74. Further, FIGS. 16B, 17B, and 18B respectively illustrate a detection signal obtained from the first detection section 82. Further, FIGS. 16C, 17C, and 18C respectively illustrate a detection signal obtained from the second detection section 84.

When the flight path F of the ink droplet Ip is substantially midway between the first detection member 72 and the second detection member 74 as shown in FIG. 16A, the distance M1 between the first detection member 72 and the flight path F of the ink droplet Ip and the distance M2 between the second detection member 74 and the flight path F of the ink droplet Ip become substantially equivalent. Thus, as shown in FIGS. 16B and 16C, the magnitude of the induced current produced in the first detection member 72 and the magnitude of the induced current produced in the second detection member 74 due to the ink droplet Ip ejected from the nozzles #1 to #180 become substantially equivalent. Accordingly, a peak value V1max of the pulse Wc of the detection signal from the first detection section 82 and a peak value V2max of the pulse Wd of the detection signal from the second detection section 84 become substantially equivalent values.

On the other hand, when the flight path F of the ink droplet Ip is toward the first detection member 72 side as shown in FIG. 17A, the distance M1 between the first detection member 72 and the flight path F of the ink droplet Ip becomes small compared to the distance M2 between the second detection member 74 and the flight path F of the ink droplet Ip. Thus, as shown in FIGS. 17B and 17C, the magnitude of the induced current produced in the first detection member 72 due to the ink droplet Ip ejected from the nozzles #1 to #180 becomes large compared to the magnitude of the induced current produced in the second detection member 74. Accordingly, the peak value V1max of the pulse Wc of the detection signal from the first detection section 82 becomes large compared to the peak value V2max of the pulse Wd of the detection signal from the second detection section 84.

Furthermore, when the flight path F of the ink droplet Ip is toward the second detection member 74 side as shown in FIG. 18A, the distance M2 between the second detection member 74 and the flight path F of the ink droplet Ip becomes small compared to the distance M1 between the first detection member 72 and the flight path F of the ink droplet Ip. Thus, as shown in FIGS. 18B and 18C, the magnitude of the induced current produced in the second detection member 74 due to the ink droplet Ip ejected from the nozzles #1 to #180 becomes large compared to the magnitude of the induced current produced in the first detection member 72. Accordingly, the peak value V2max of the pulse Wd of the detection signal from the second detection section 84 becomes large compared to the peak value V1max of the pulse Wc of the detection signal from the first detection section 82.

<Determination Method>

When testing whether or not the ejection direction of the ink droplet Ip from the nozzles #1 to #180 is proper, the difference between the peak values V1max and V2max of the detection signals respectively outputted from the first detection section 82 and the second detection section 84 is acquired, and the determination is carried out based on that difference. Here, description is given using an example in a case the flight paths F of the ink droplet Ip described in FIGS. 16A, 17A, and 18A are proper flight paths.

Figure 19A:
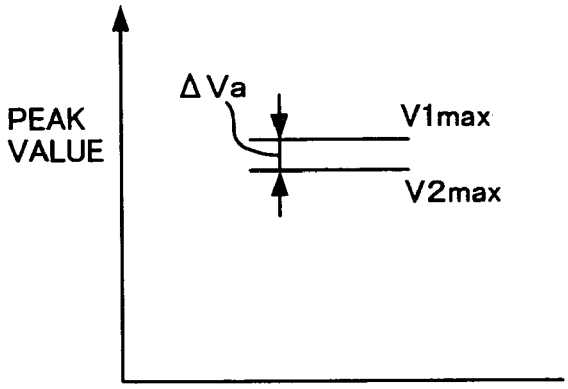
FIG. 19A is an explanatory diagram of a difference between the peak values in FIGS. 16A and 16B.
Figure 19B:
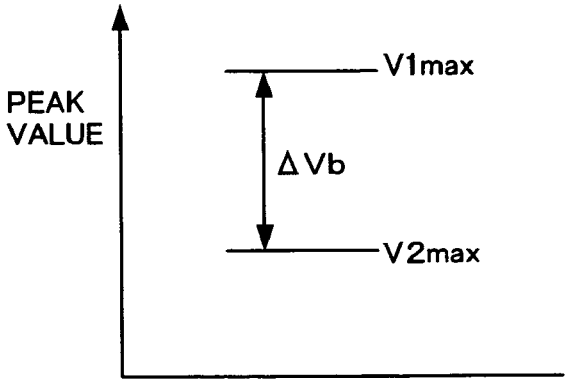
FIG. 19B is an explanatory diagram of a difference between the peak values in FIGS. 17A and 17B.
Figure 19C:
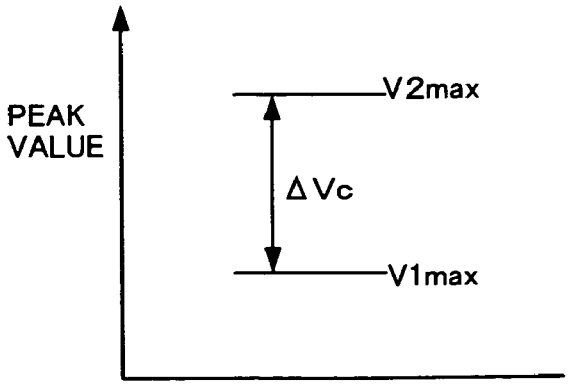
FIG. 19C is an explanatory diagram of a difference between the peak values in FIGS. 18A and 18B.

FIGS. 19A to 19C illustrate differences ΔVa, ΔVb, and ΔVc between the peak values V1max and V2max of the detection signals from the first detection section 82 and the second detection section 84 in FIGS. 16A to 18C. FIG. 19A illustrates the difference ΔVa between the peak values V1max and V2max of FIGS. 16B and 16C. FIG. 19B illustrates the difference ΔVb between the peak values V1max and V2max of FIGS. 17B and 17C. FIG. 19C illustrates the difference ΔVc between the peak values V1max and V2max of FIGS. 18B and 18C. Here, the differences ΔVa, ΔVb, and ΔVc are obtained respectively by an equation "V1max-V2max."

When the flight path F of the ink droplet Ip is substantially in the middle between the first detection member 72 and the second detection member 74 as shown in FIG. 16A, the peak value V1max of the detection signal from the first detection section 82 and the peak value V2max of the detection signal from the second detection section 84 are substantially equivalent, and therefore, as shown in FIG. 19A, the difference ΔVa is an extremely small value substantially close to zero.

On the other hand, when the flight path F of the ink droplet Ip is toward the first detection member 72 side as shown in FIG. 17A, the peak value V1max of the detection signal from the first detection section 82 is large compared to the peak value V2max of the detection signal from the second detection section 84, and therefore, as shown in FIG. 19B, the difference ΔVb is a large absolute positive value compared to the difference ΔVa.

Furthermore, when the flight path F of the ink droplet Ip is toward the second detection member 74 side as shown in FIG. 18A, the peak value V2max of the detection signal from the second detection section 84 is large compared to the peak value V1max of the detection signal from the first detection section 82, and therefore, as shown in FIG. 19C, the difference ΔVc is a large absolute negative value compared to the difference ΔVa.

Here, when a displacement has occurred in the ejection direction of the ink droplet Ip from the nozzles #1 to #180, the flight path F of the ink droplet Ip shifts, and the distance M1 between the flight path F of the ink droplet Ip and the first detection member 72 and the distance M2 between the flight path F of the ink droplet Ip and the second detection member 74 changes. Accordingly, the magnitudes of the induced currents respectively produced in the first detection member 72 and the second detection member 74 change, and the peak values V1max and V2max of the detection signals obtained respectively from the first detection section 82 and the second detection section 84 increase or decrease. Thus, the differences ΔVa, ΔVb, and ΔVc obtained from the two peak values V1max and V2max change.

Figure 20A:
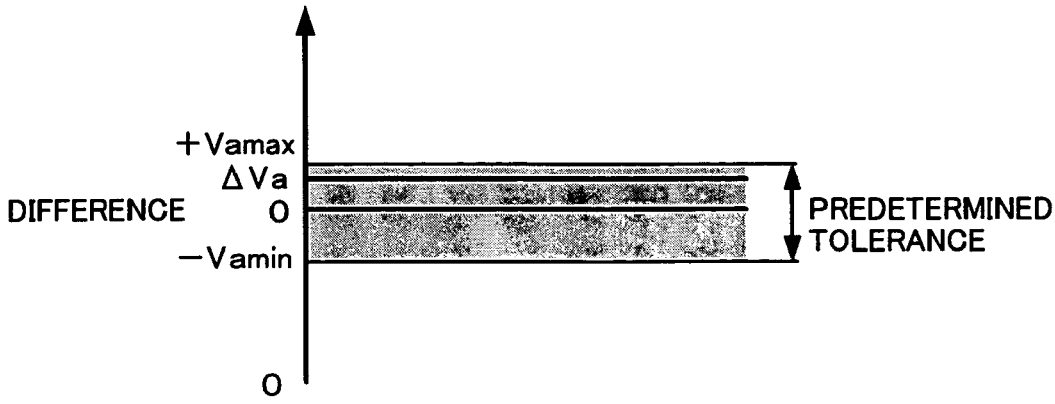
FIG. 20A is a diagram showing an example of a tolerance setting that is set corresponding to the difference in FIG. 19A.
Figure 20B:
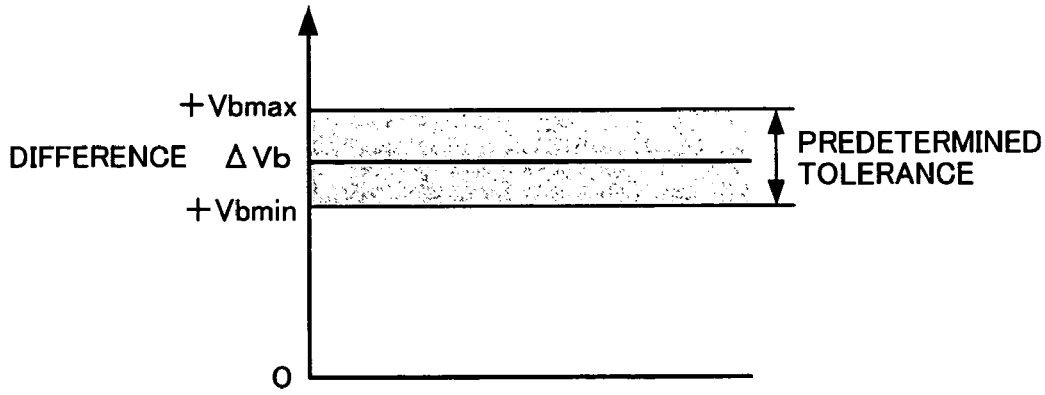
FIG. 20B is a diagram showing an example of a tolerance setting that is set corresponding to the difference in FIG. 19B.
Figure 20C:
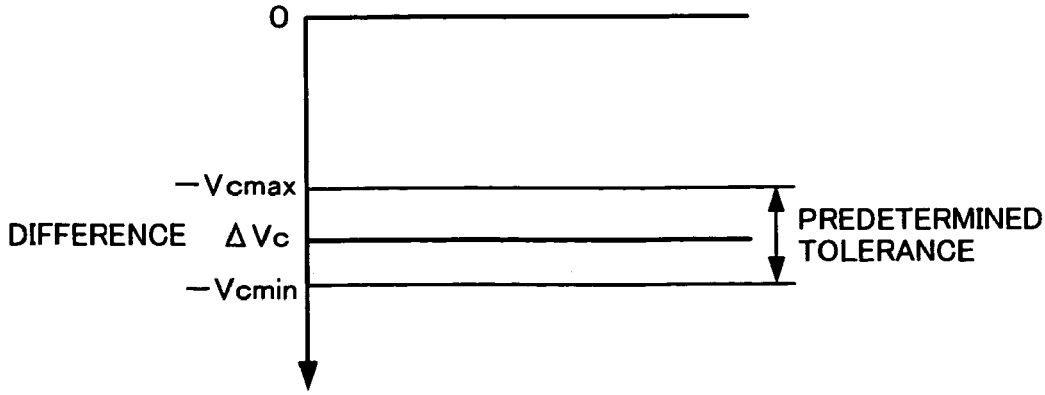
FIG. 20C is a diagram showing an example of a tolerance setting that is set corresponding to the difference in FIG. 19C.

When determining whether or not the ejection direction of the ink droplet Ip from the nozzles #1 to #180 is proper, the differences ΔVa, ΔVb, and ΔVc are respectively checked as to whether or not they are within a predetermined tolerance. FIGS. 20A to 20C illustrate examples of predetermined tolerances that have been set corresponding to the differences ΔVa, ΔVb, and ΔVc. FIG. 20A illustrates an example of a predetermined tolerance that has been set corresponding to the difference ΔVa. FIG. 20B illustrates an example of a predetermined tolerance that has been set corresponding to the difference ΔVb. FIG. 20C illustrates an example of a predetermined tolerance that has been set corresponding to the difference ΔVc.

When the ejection direction of the ink droplet Ip from the nozzles #1 to #180 is proper, the difference ΔVa is an extremely small value substantially close to zero. Therefore, as shown in FIG. 20A, the predetermined tolerance corresponding to the difference ΔVa is set with zero at the center and with an upper limit value thereof set to "+Vamax" and a lower limit value thereof set to "−Vamin." Here, if the difference ΔVa is within the predetermined tolerance, that is, "+Vamax" or less and "−Vamin" or more, then the ejection direction of the ink droplet Ip from the nozzles #1 to #180 is determined to be proper. On the other hand, if the difference ΔVa is out of the predetermined tolerance, then the ejection direction of the ink droplet Ip from the nozzles #1 to #180 is determined to be not proper.

Furthermore, when the ejection direction of the ink droplet Ip from the nozzles #1 to #180 is proper, the difference ΔVb fluctuates in a positive region. Therefore, as shown in FIG. 20B, the predetermined tolerance corresponding to the difference ΔVb is set having an upper limit value thereof set to "+Vbmax" and a lower limit value thereof set to "+Vbmin." Here, if the difference ΔVb is within the predetermined tolerance, that is, "+Vbmax" or less and "+Vbmin" or more, then the ejection direction of the ink droplet Ip from the nozzles #1 to #180 is determined to be proper. On the other hand, if the difference ΔVb is out of the predetermined tolerance, then the ejection direction of the ink droplet Ip from the nozzles #1 to #180 is determined to be not proper.

Furthermore, when the ejection direction of the ink droplet Ip from the nozzles #1 to #180 is proper, the difference ΔVc fluctuates in a negative region. Therefore, as shown in FIG. 20C, the predetermined tolerance corresponding to the difference ΔVc is set having an upper limit value thereof set to "−Vcmax" and a lower limit value thereof set to "−Vcmin." Here, if the difference ΔVc is within the predetermined tolerance, that is, "−Vcmax" or less and "−Vcmin" or more, then the ejection direction of the ink droplet Ip from the nozzles #1 to #180 is determined to be proper. On the other hand, if the difference ΔVc is out of the predetermined tolerance, then the ejection direction of the ink droplet Ip from the nozzles #1 to #180 is determined to be not proper.

By carrying out the determinations in this manner, appropriate testing can be performed for each of the nozzles #1 to #180 even when the relative positional relationship between the nozzles #1 to #180 targeted for testing and the first detection member 72 and the second detection member 74 varies according to the nozzles #1 to #180.

Here, the upper limit values ("+Vamax," "+Vbmax," "−Vcmax," and so on) and the lower limit values ("−Vamin," "+Vbmin," "−Vcmin," and so on) that prescribe the predetermined tolerance correspond to "reference values." Information relating to the upper limit values ("+Vamax," "+Vbmax," and "−Vcmax") and the lower limit values ("−Vamin," "+Vbmin," and "−Vcmin") is stored as data in a suitable storage section including a memory such as the main memory 127. In determining the ejection direction, the controller 126 obtains the reference values from an appropriate storage section such as the main memory 127 and carries out the determination.

Also, here, the difference between the peak values V1max and V2max of the detection signals from the first detection section 82 and the second detection section 84 was acquired, and whether or not the ejection direction of the ink droplet Ip is proper was determined from that difference. However, the method for determining the ejection direction of the ink droplet Ip is not limited to a method in which the difference is obtained by acquiring the peak values V1max and V2max of the detection signals from the first detection section 82 and the second detection section 84 in this way, and carrying out the determination based on that difference. As long as the determination is carried out based on the magnitude of the induced currents produced in the first detection member 72 and the second detection member 74, any determination method may be used.

<Procedure of the Determination Process>

Figure 21:
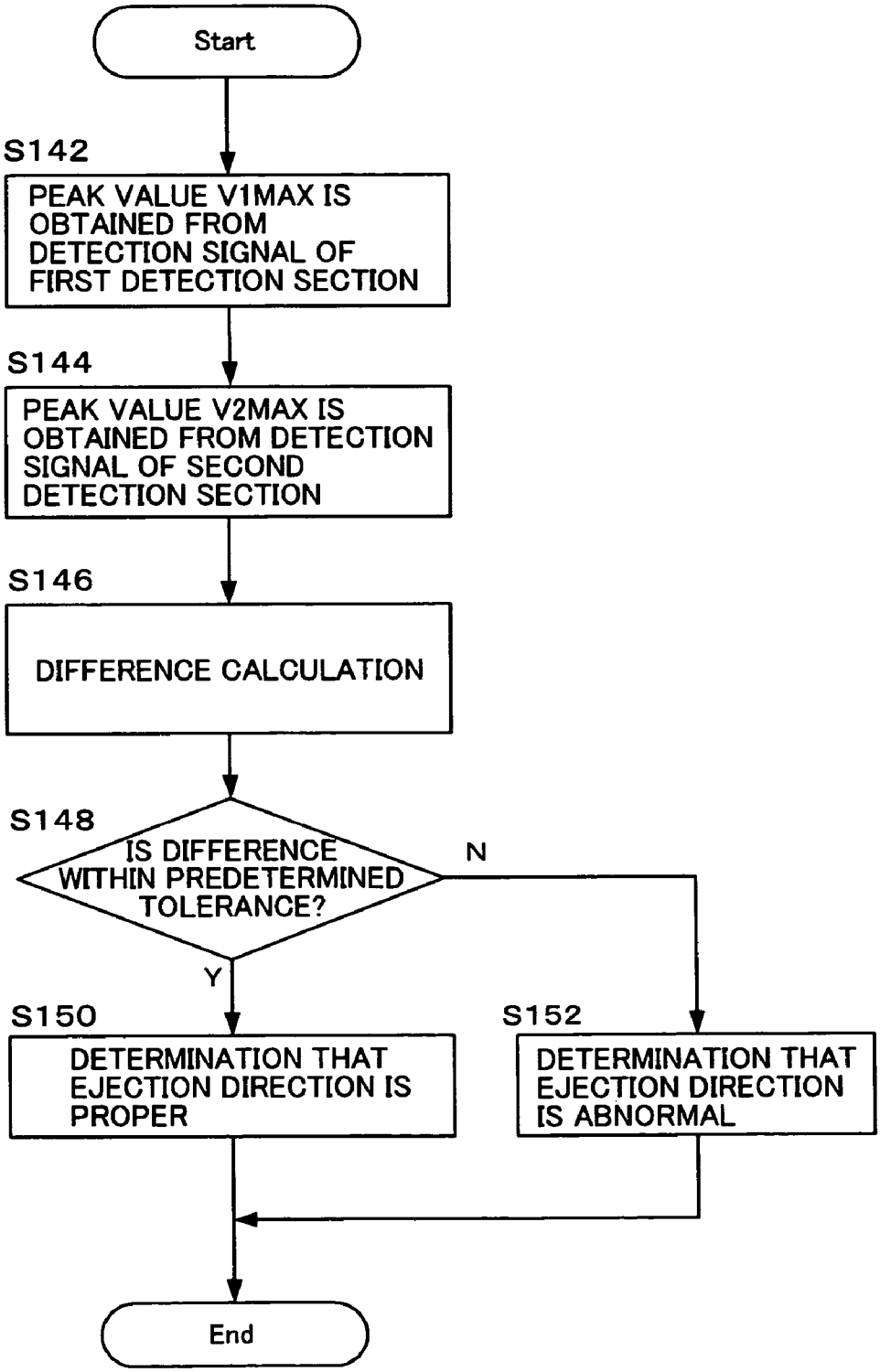
FIG. 21 is a flowchart illustrating an example of a procedure for determining the ejection direction.

FIG. 21 is a flowchart showing an example of a procedure for determining the direction of ejection using the controller 126. Here, the controller 126 first obtains the peak value V1max from the detection signal that is outputted from the first detection section 82 (S142). Next, the controller 126 obtains the peak value V2max from the detection signal that is outputted from the second detection section 84 (S144). Next, the controller 126 calculates the difference between the obtained peak values V1max and V2max (S146).

Next, the controller 126 checks whether or not the difference is within the predetermined tolerance (S148). Here, when the difference is within the predetermined tolerance, the controller 126 determines that the ejection direction of the ink droplet Ip from the nozzles #1 to #180 is proper (S150). On the other hand, when the difference is out of the predetermined tolerance, the controller 126 determines that the ejection direction of the ink droplet Ip from the nozzles #1 to #180 is not proper (S152).

Detection Member of the Present Embodiment

In order to efficiently carry out ejection testing of the nozzles #1 to #180 of the nozzle rows 211C, 211M, 211Y, and 211K in the inkjet printer 1 according to the present embodiment, the first detection member 72 and the second detection member 74 are configured as follows.

<Installation Method>

Figure 22A:
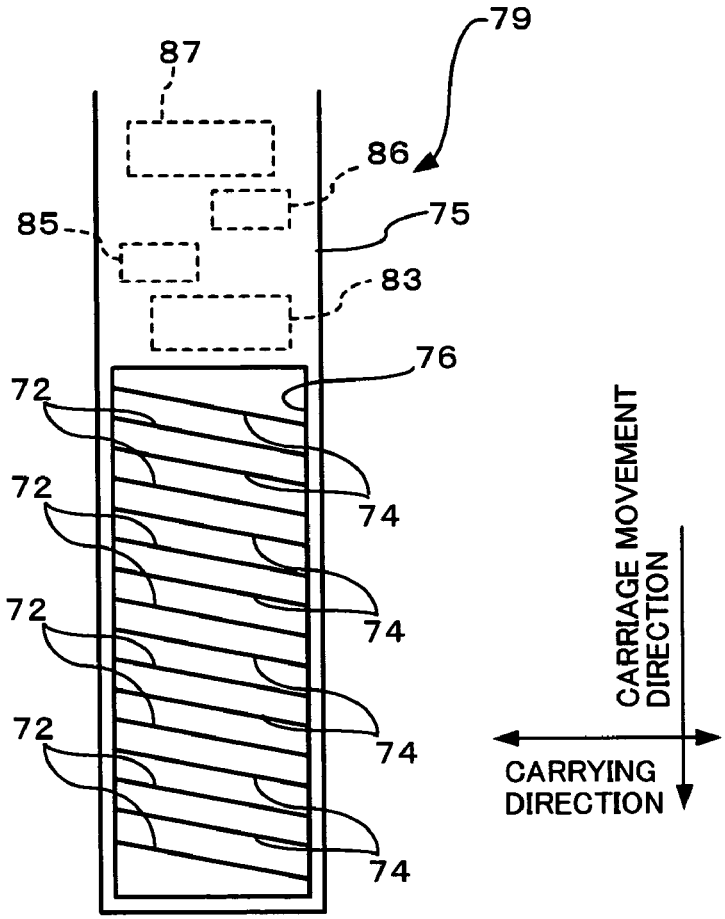
FIG. 22A is a top view illustrating a configuration of the first detection members and the second detection members.
Figure 22B:
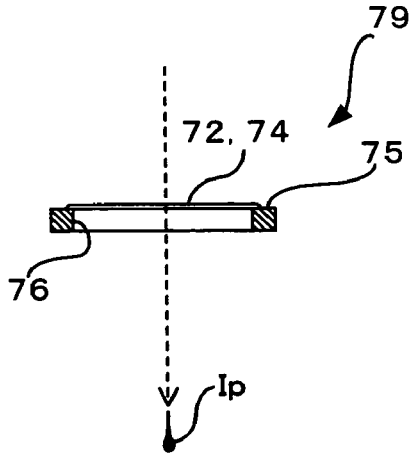
FIG. 22B is a vertical cross-section illustrating a configuration of the first detection members and the second detection members.

FIGS. 22A and 22B show a configuration of the first detection member 72 and the second detection member 74 of the liquid ejection testing device 62 equipped in the inkjet printer 1 according to the present embodiment. FIG. 22A is a top view showing an outline of the first detection member 72 and the second detection member 74. FIG. 22B is a vertical cross-section showing the first detection member 72 and the second detection member 74.

As shown in FIG. 22A, the first detection members 72 and the second detection members 74 are provided on a rectangular shaped substrate 75. The substrate 75 is structured using a printed circuit board, for example. The first detection members 72 and the second detection members 74 are put slanted across an opening 76 that is formed at a leading edge area (lower end area) of the substrate 75 so as to intersect the movement direction of the carriage 41.

A plurality of the first detection members 72 and the second detection members 74 are provided at the opening 76. The first detection members 72 and the second detection members 74 are arranged in parallel to each other with an interval therebetween along a lengthwise direction of the substrate 75. Here, the intervals between the first detection members 72 and the second detection members 74 are equivalent. The diameter of the first detection member 72 and the second detection member 74 is approximately 0.2 mm.

The first detection members 72 and the second detection members 74 respectively have both their end areas fixed to an edge area of the opening 76 of the substrate 75. Thus, the first detection members 72 and the second detection members 74 are arranged extending over the opening 76 of the substrate 75. As shown in FIG. 22B, the ink droplets Ip ejected from the nozzles #1 to #180 of the head 21 pass the sides of the first detection members 72 and the second detection members 74 through a gap between the first detection members 72 and the second detection members 74 and drop below the substrate 75.

Here, a reason for the first detection members 72 and the second detection members 74 being arranged diagonally to the movement direction of the carriage 41 is as follows. Namely, this is in order to detect displacement of the carrying direction of the ink droplets Ip ejected from the nozzles #1 to #180. When the ink droplets Ip become displaced in the carrying direction, "white streaks" sometimes occur in the printed image along the movement direction of the carriage 41. Thus, compared to when there is displacement in the movement direction of the carriage 41, the influence on the quality of a printed image is greater when the ink droplets Ip ejected from the nozzles #1 to #180 are displaced in the carrying direction. Therefore, it is necessary to precisely check for displacement of the carrying direction of the ejected ink droplets Ip.

Further still, in the present embodiment, circuit elements 83, 85, 86, and 87 constituting components such as the protective resistor R1, the capacitor C, the input resistor R2, the feedback resistor R3, and the operational amplifier Amp that constitute the first detection section 82 and the second detection section 84 are integrally mounted on the substrate 75 on which the first detection members 72 and the second detection members 74 are provided. Accordingly, the substrate 75 is a single ejection testing unit 79 on which the first detection member 72, the second detection member 74, and the circuit elements 83, 85, 86, and 87, which are used for ejection testing, are mounted.

<Configuration of Detection Members>

Figure 23:
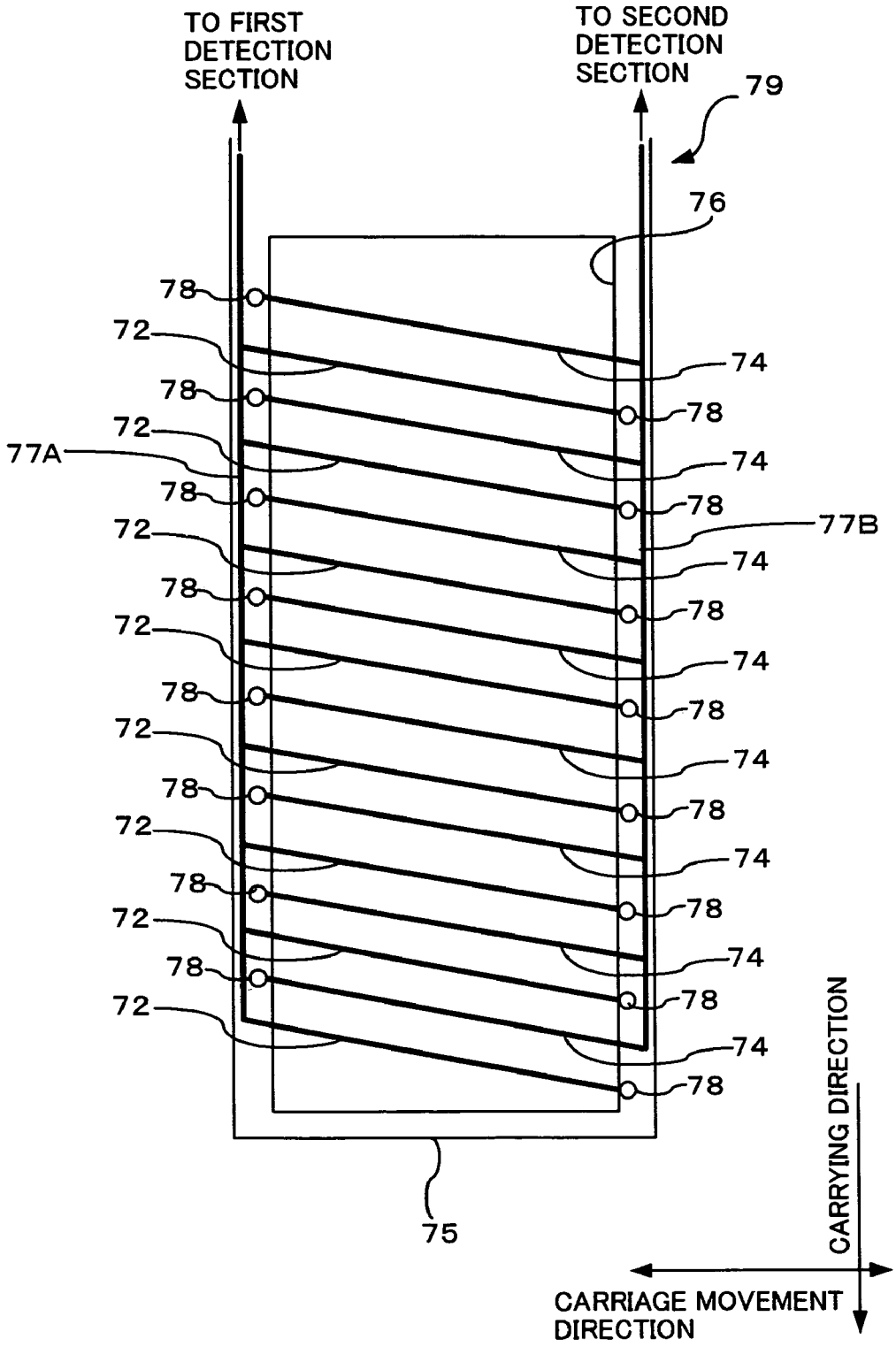
FIG. 23 is a diagram illustrating a circuit configuration of the first detection members and the second detection members.

FIG. 23 illustrates in detail a circuit configuration of the first detection members 72 and the second detection members 74 arranged on the substrate 75. As shown in the diagram, the first detection members 72 arranged on the substrate 75 are diagonally arranged with equivalent intervals along the lengthwise direction of the substrate 75. One end area (here, the left end area) of each of the first detection members 72 is connected to a single first common wire 77A that is provided along an edge area (here, the left side edge area) of the opening 76 of the substrate 75. This first common wire 77A is connected to the first detection section 82 that detects the induced currents produced in each of the first detection members 72.

On the other hand, the other end areas (here, the right end areas) of the first detection members 72 are not electrically connected to each other via the first common wire 77A or the like as is the one end area (here, the left end area) and each is electrically open. The other end area (here, the right end area) of each of the first detection members 72 is fixed to the edge area of the opening 76 of the substrate 75 via respective fixing sections 78. Comb teeth are formed by the plurality of first detection members 72 and the first common wire 77A.

On the other hand, the second detection members 74 are diagonally arranged with equivalent intervals along the lengthwise direction of the substrate 75 in a similar manner as the first detection members 72. The second detection members 74 are arranged parallel to the first detection members 72 in between the first detection members 72. One end area (here, the right end area) of each of the second detection members 74 is connected to a single second common wire 77B that is provided along an edge area (here, the right side edge area) of the opening 76 of the substrate 75. The second common wire 77B is connected to the second detection section 84 that detects the induced currents produced in each of the second detection members 74.

The other end areas (here, the left end areas) of the second detection members 74 are not electrically connected to each other via the second common wire 77B or the like as is the one end area (here, the right end area) and each is electrically open. The other end area (here, the left end area) of each of the second detection members 74 is fixed to the edge area of the opening 76 of the substrate 75 via respective fixing sections 78. Comb teeth are formed by the plurality of second detection members 74 and the second common wire 77B.

In this way, by connecting one end area of the first detection members 72 and the second detection members 74 (the left end area of the first detection members 72 and the right end area of the second detection members 74) respectively to the first common wire 77A or the second common wire 77B, and having the other end area of each of the first detection members 72 and the second detection members 74 (the right end area of the first detection members 72 and the left end area of the second detection members 74) not electrically connected to each other and electrically open, the induced currents produced in a plurality of the first detection members 72 or a plurality of the second detection members 74 can be detected with excellent efficiency. Thus, it is sufficient to provide only a single detection section, that is, the first detection section 82 and the second detection section 84, respectively for the plurality of first detection members 72 and the plurality of second detection members 74.

Furthermore, by forming the respective sets of comb teeth with the first detection member 72 and the first common wire 77A as well as the second detection member 74 and the second common wire 77B, ejection testing can be performed compactly for a plurality of the nozzles #1 to #180 together. In particular, by arranging the plurality of first detection members 72 and the plurality of second detection members 74 in respective rows, ejection testing can be performed compactly for a multitude of the nozzles #1 to #180 even when the length of the detection members 72 and 74 is short.

It should be noted that in the present embodiment the above-described two sets of comb teeth, that is, the comb teeth formed by the first detection members 72 and the first common wire 77A and the comb teeth formed by the second detection members 74 and the second common wire 77B are arranged on the substrate 75 such that they intermesh.

Installation Position of the Ejection Testing Unit

Figure 24:
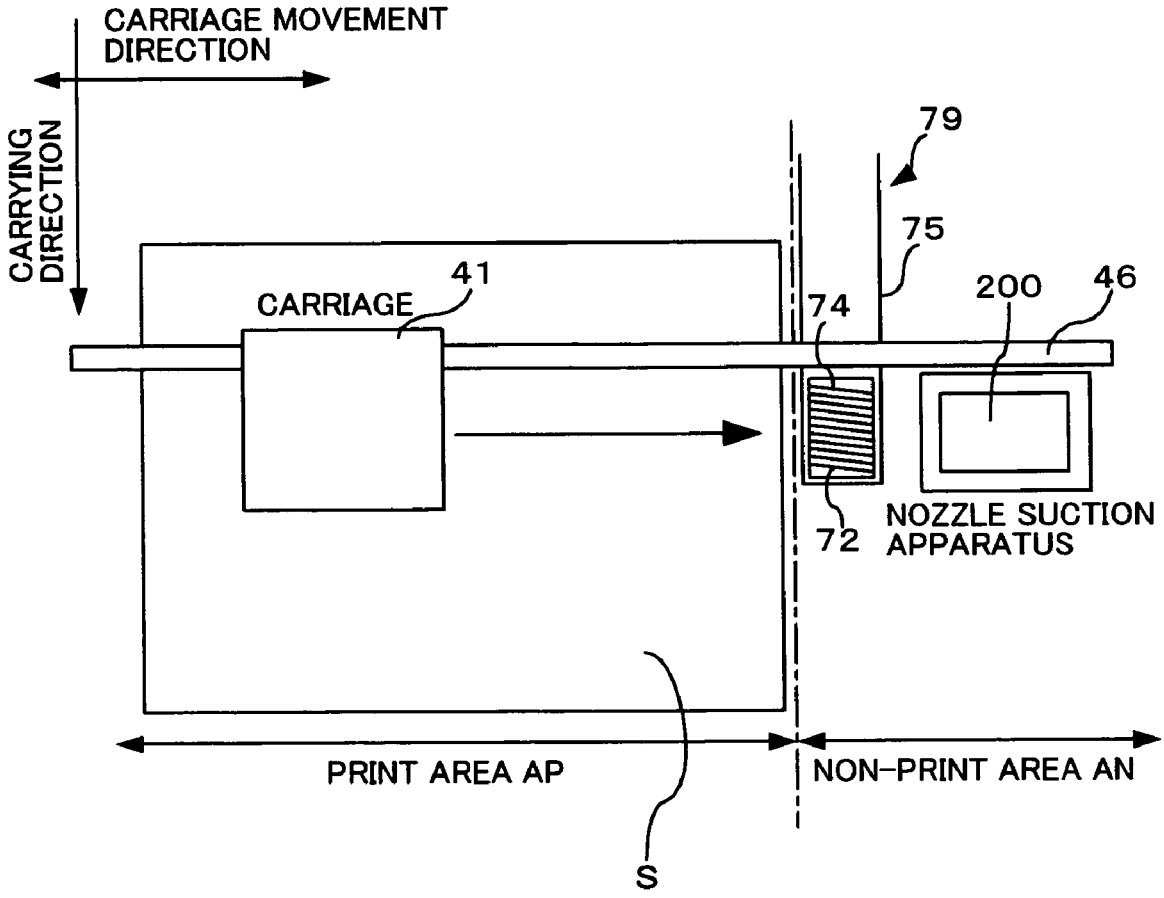
FIG. 24 is a diagram illustrating an example of an installation position of an ejection testing unit.

FIG. 24 illustrates in detail an installation position of the ejection testing unit 79 of the present embodiment. As shown in the diagram, the ejection testing unit 79 of the present embodiment is installed in an area An (hereafter referred to as a "non-print area") outside a print area Ap in which printing is carried out by ejecting ink from the nozzles #1 to #180. A nozzle suction apparatus 200 for suctioning ink from the nozzles #1 to #180 is provided in the non-print area An as a cleaning device for the nozzles #1 to #180 to clear clogging of the nozzles. Additionally, a wiping device or the like that wipes away extraneous ink adhering to the openings of the nozzles #1 to #180 may be provided in the non-print area An. The ejection testing unit 79 of the present embodiment is provided adjacent to various cleaning devices including the nozzle suction apparatus 200 that performs such nozzle cleaning.

In the present embodiment, the ejection testing unit 79 is provided in a position in the non-print area An but close to the print area Ap, that is, between the print area Ap and a cleaning unit 30 as shown in the diagram. Thus, when the carriage 41 moves from the print area Ap to the non-print area An, it must always pass over the opening 76 of the ejection testing unit 79, that is, over the first detection members 72 and the second detection members 74. Therefore, ink ejection testing can always be carried out during non-printing times when the carriage 41 moves to the non-print area An.

Positional Relation of Ejection Testing Unit and Nozzle Rows

Figure 25:
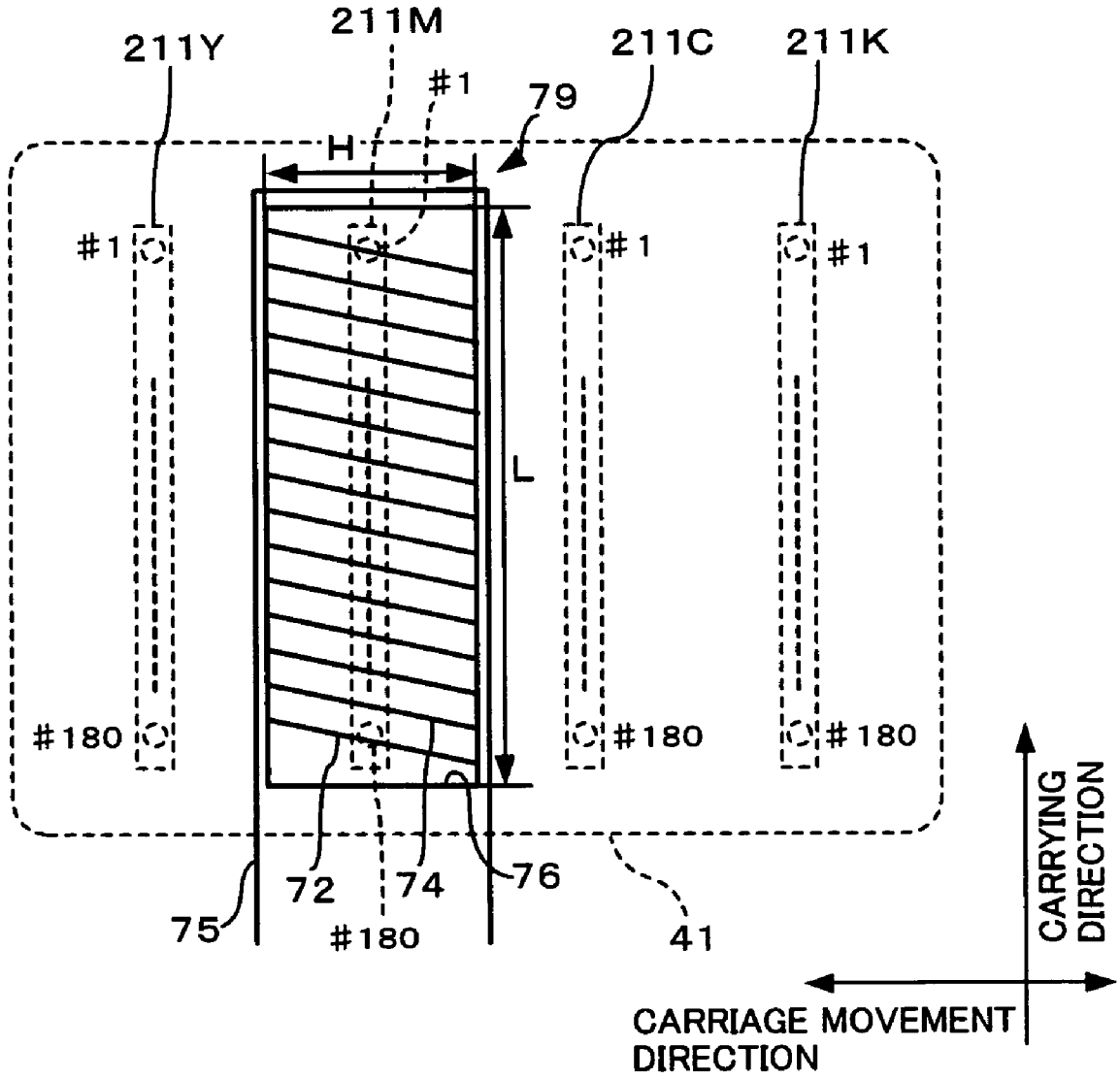
FIG. 25 is a diagram illustrating a positional relation between the first detection members and the second detection members, and the nozzle rows.

FIG. 25 illustrates a positional relation between the ejection testing unit 79 and the nozzle rows 211C, 211M, 211Y, and 211K when ejection testing is carried out. As shown in the diagram, a longitudinal length L of the opening 76 provided in the substrate 75 of the ejection testing unit 79 is set corresponding to and slightly longer than a length of the nozzle rows 211C, 211M, 211Y, and 211K. Furthermore, a horizontal length H of the opening 76 is set corresponding to a width of a one row area of the nozzle rows 211C, 211M, 211Y, and 211K. The first detection members 72 and the second detection members 74 provided at the opening 76 of the ejection testing unit 79 are arranged diagonally along a direction intersecting an arrangement direction of the nozzles #1 to #180 of the nozzle rows 211C, 211M, 211Y, and 211K (here parallel to the carrying direction) corresponding respectively to the nozzles #1 to #180 of the nozzle rows 211C, 211M, 211Y, and 211K.

As shown in the diagram, when carrying out ejection testing, one nozzle row (here, the nozzle row 211M) of the plurality of nozzle rows 211C, 211M, 211Y, and 211K provided on the head 21 undergoes alignment so as to be positioned directly above the opening 76 of the ejection testing unit 79, that is, directly above the first detection members 72 and the second detection members 74. After the alignment is finished, ink is ejected from the nozzles #1 to #180 of the nozzle row 211M toward the respective gaps between the first detection members 72 and the second detection members 74 to carry out ejection testing.

After ejection testing is finished for the one nozzle row 211M, the carriage 41 moves in order to carry out ejection testing for the other nozzle rows 211C, 211Y, and 211K, which are yet to undergo ejection testing. Then, alignment is again performed between the opening 76 of the ejection testing unit 79, that is, the first detection members 72 and the second detection members 74 and the next nozzle row for which ejection testing is to be carried out (here, the nozzle row 211Y, for example), and then ejection testing is carried out on the nozzle row 211Y. In this way, ejection testing is carried out successively one row at a time with respect to the plurality of nozzle rows 211C, 211M, 211Y, and 211K provided on the head 21.

Positional Relation of Detection Members and Nozzles

Figure 26:
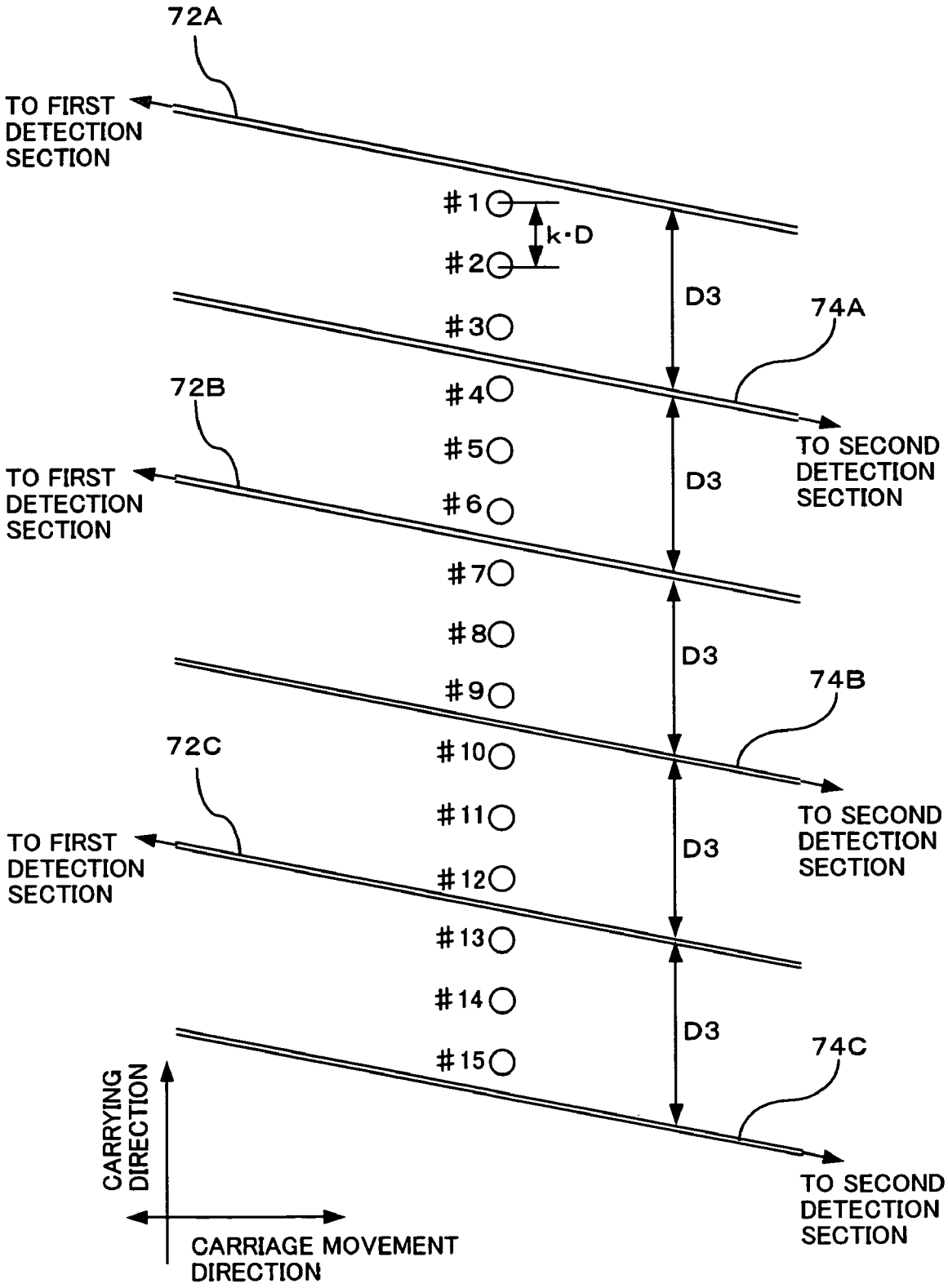
FIG. 26 is a diagram illustrating an example of a positional relationship between the detection members and the nozzles.

FIG. 26 illustrates another example of a positional relation between the first detection members 72 and the second detection members 74 and the nozzles #1 to #180 during ejection testing. Here, description is given using an example of when ejection testing of 15 nozzles #1 to #15 is carried out using three first detection members 72A, 72B, and 72C and three second detection members 74A, 74B, and 74C.

Here, the first detection members 72A, 72B, and 72C and the second detection members 74A, 74B, and 74C are arranged in parallel to each other with an equivalent interval therebetween. Intervals D3 in the carrying direction between the first detection members 72A, 72B, and 72C and the second detection members 74A, 74B, and 74C are all equivalent. Here, the intervals D3 are set to be equivalent to three times the nozzle interval "k·D."

The nozzles #1 to #16 are arranged three each between each of the first detection members 72A, 72B, and 72C and the second detection members 74A, 74B, and 74C. That is to say, the nozzles #1, #2, and #3 are arranged between the first detection member 72A and the second detection member 74A. The nozzles #4, #5, and #6 are arranged between the first detection member 72B and the second detection member 74A. The nozzles #7, #8, and #9 are arranged between the first detection member 72B and the second detection member 74B. The nozzles #10, #11, and #12 are arranged between the first detection member 72C and the second detection member 74B. The nozzles #13, #14, and #15 are arranged between the first detection member 72C and the second detection member 74C.

When an ink droplet Ip is ejected from one of the nozzles #1 to #3, induced currents are produced mainly in the first detection member 72A and the second detection member 74A respectively. Further, when an ink droplet Ip is ejected from one of the nozzles #4 to #6, induced currents are produced mainly in the first detection member 72B and the second detection member 74A respectively. Further, When an ink droplet Ip is ejected from one of the nozzles #7 to #9, induced currents are produced mainly in the first detection member 72B and the second detection member 74B respectively. When an ink droplet Ip is ejected from one of the nozzles #10 to #12, induced currents are produced mainly in the first detection member 72C and the second detection member 74B. Further, when an ink droplet Ip is ejected from one of the nozzles #13 to #15, induced currents are produced mainly in the first detection member 72C and the second detection member 74C respectively.

The induced currents produced in the first detection members 72A, 72B, and 72C and the second detection members 74A, 74B, and 74C are inputted to the first detection section 82 or the second detection section 84 via the first common wire 77A or the second common wire 77B, and detection is performed in the first detection section 82 or the second detection section 84.

<Ejection Testing>

When carrying out ejection testing, the induced currents produced respectively in the first detection members 72A, 72B, and 72C and the second detection members 74A, 74B, and 74C due to the ink droplets Ip ejected from the nozzles #1 to #15 in the same manner as described above are detected by the first detection section 82 and the second detection section 84, and a determination is made based on the detection result as to whether or not the ejection of the ink droplet Ip from each of the nozzles #1 to #15 is proper.

When testing the presence or absence of ejection, the signal levels of the detection signals from the first detection section 82 and the second detection section 84 that have detected the induced currents produced in the first detection members 72A, 72B, and 72C and the second detection members 74A, 74B, and 74C as described in FIGS. 14 and 15 are compared to the predetermined reference value "V0", and the presence or absence of ejection is determined by examining whether or not the signal levels of the detection signals from either one of the first detection section 82 and the second detection section 84 reach the predetermined reference value "V0."

Further, when testing the ejection direction, the peak values V1max and V2max are acquired respectively from the detection signals of the first detection section 82 and the second detection section 84 that detected the induced currents produced in the first detection members 72A, 72B, and 72C and the second detection members 74A, 74B, and 74C as described in FIGS. 16A to 21, then the difference between the peak values V1max and V2max are obtained, and the correctness of the ejection direction is tested by examining whether or not the difference is within a predetermined tolerance.

Here, when testing the ejection direction of the nozzles #1, #6, #7, #12, and #13 arranged towards the first detection members 72A, 72B, and 72C side, it can be executed using the method described in FIGS. 17A to 17C, 19B, and 20B. Furthermore, when testing the ejection direction of the nozzles #3, #4, #9, #10, and #15 arranged towards the second detection members 74A, 74B, and 74C side, it can be executed using the method described in FIGS. 18A to 18C, 19C, and 20C. Further, when testing the ejection direction of the nozzles #2, #5, #8, #11, and #14 positioned in the middle between the first detection members 72A, 72B, and 72C and the second detection members 74A, 74B, and 74C, it can be executed using the method described in FIGS. 16A to 16C, 19A, and 20A.

Cleaning Process

As a result of carrying out such ejection testing in the inkjet printer 1 according to the present embodiment, when a nozzle having an ejection defect is discovered in the nozzles #1 to #180 of the nozzle rows 211C, 211M, 211Y, and 211K, a cleaning process is carried out on that nozzle. The following is a description of the cleaning process that is executed. It should be noted that this cleaning process is executed by the controller 126. The controller 126 corresponds to a "controller" that executes cleaning processing.

(1) Suction Processing

Figure 27:
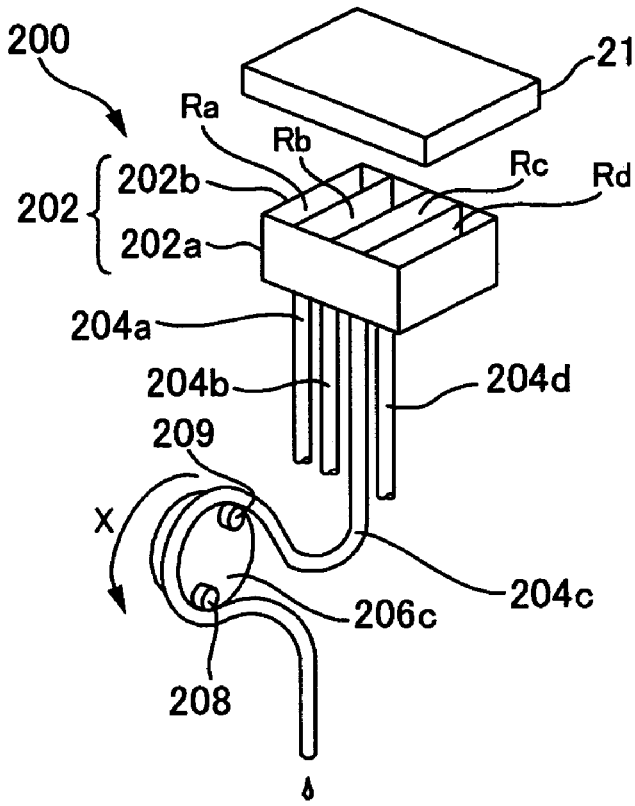
FIG. 27 is a diagram describing a configuration of a nozzle suction apparatus.

The suction processing is carried out by the nozzle suction apparatus 200. FIG. 27 is a diagram for describing a configuration of the nozzle suction apparatus 200. The nozzle suction apparatus 200 is provided with a head cap 202, four hoses 204*a*, 204*b*, 204*c*, and 204*d*, and four pump rollers (here, only one pump roller 206*c* is shown, and the other pump rollers are not shown). It should be noted that the overall structure and operation of the four hoses 204*a*, 204*b*, 204*c*, and 204*d* and the four pump rollers (here, only the pump roller 206*c* is shown) are all the same. Here, a simplified description is given using the hose 204*c* and the pump roller 206*c* and duplicated description and illustrations are omitted.

As shown in the diagram, the head cap 202 has a casing 202*a* and a rubber frame 202*b*. The rubber frame 202*b* is provided on an upper edge area of the casing 202*a*. The internal space of the casing 202*a* is partitioned into four suction chambers Ra, Rb, Rc, and Rd. When the head cap 202 is raised, the rubber frame 202*b* tightly contacts a bottom surface of the head 21. Then, the suction chambers Ra, Rb, Rc, and Rd form closed spaces covering the respective nozzle rows 211C, 211M, 211Y, and 211K arranged on the head 21. Here, the suction chamber Ra forms a closed space covering the yellow nozzle row 211Y. Further, the suction chamber Rb forms a closed space covering the magenta nozzle row 211M. Further, the suction chamber Rc forms a closed space covering the cyan nozzle row 211C. Further, the suction chamber Rd forms a closed space covering the black nozzle row 211K. The suction chambers Ra, Rb, Rc, and Rd are respectively connected to the hoses 204*a*, 204*b*, 204*c*, and 204*d*.

The pump roller 206*c* is provided with two small rollers 208 and 209 near its periphery. The hose 204*c* is wound around these two small rollers 208 and 209. The pump roller 206*c* is rotatively driven in a direction of the arrow X by the carry motor 15. When the pump roller 206*c* is rotatively driven in the direction of the arrow X by the carry motor 15, the air inside the hose 204*c* is pushed by the small rollers 208 and 209. Accordingly, the air inside the closed space, namely the suction chamber Rc here, arranged in the head cap 202 is discharged. As a result, ink is suctioned from the nozzle row of the head 21, that is in this case the nozzles #1 to #180 of the cyan nozzle row 211C. The ink that has been suctioned in this way is discharged through the hose 204*c*.

By suctioning ink from the nozzles #1 to #180 of the nozzle rows in this way, foreign substances that are a cause of ejection defects such as nozzle clogging can be suctioned from the nozzles. Thus, nozzle ejection defects can be solved.

(2) Ink Ejection Operation (Also Called "Flushing")

A cleaning process using an ink ejection operation is also called flushing, and ink is discharged by carrying out an operation in which ink is forcibly ejected from the nozzles #1 to #180. Specifically, an operation is carried out in which the piezo elements of the nozzles #1 to #180 are driven, and ink is actively ejected from the nozzles in the same manner as when ink is ejected from the nozzles #1 to #180 during printing.

Figure 28:
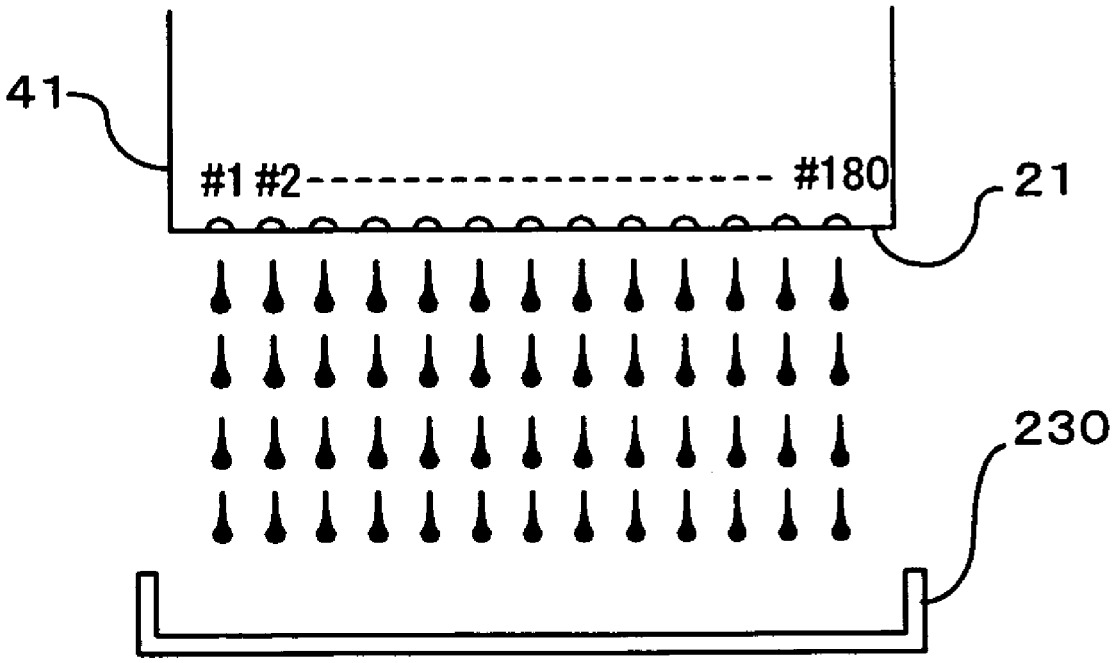
FIG. 28 is a diagram illustrating an ink ejection operation which is one cleaning process.

FIG. 28 schematically shows a condition when an ink ejection operation is being carried out. In this ink ejection operation, ink is forcibly ejected from the nozzles #1 to #180, respectively, provided in the head 21. Here, the ink ejection operation may be carried out for all the nozzle rows 211C, 211M, 211Y, and 211K of cyan (c), magenta (M), yellow (Y), and black (K), or may be carried out for a portion of nozzle rows having a nozzle in which an ejection defect has occurred. Further, the amount of ink ejected from the nozzles #1 to #180 respectively here may be more than during printing. Further, the operation in which ink is ejected is executed continuously multiple times. Ejection defects such as clogging can be solved by ejecting ink continuously multiple times in this manner.

As shown in the diagram, the ink ejected here is recovered in an ink recovery section 230 (corresponding to "liquid recovery section") arranged in opposition underneath the head 21. The ink recovery section 230 may be, for example, a groove or the like provided on the platen 14.

When carrying out the ink ejection operation process (flushing), the carriage 41 moves to above the ink recovery section 230 such that the head 21 becomes in opposition to the ink recovery section 230. Then, ink is ejected from the nozzles #1 to #180 of the nozzle rows 211C, 211M, 211Y, and 211K of the head 21 to carry out the ink ejection operation.

By actively ejecting ink from the nozzles #1 to #180 in this way, foreign substances that are a cause of ejection defects such as nozzle clogging can be removed from the nozzles. Thus, nozzle ejection defects can be solved.

(3) Wiping Process

Figure 29A:
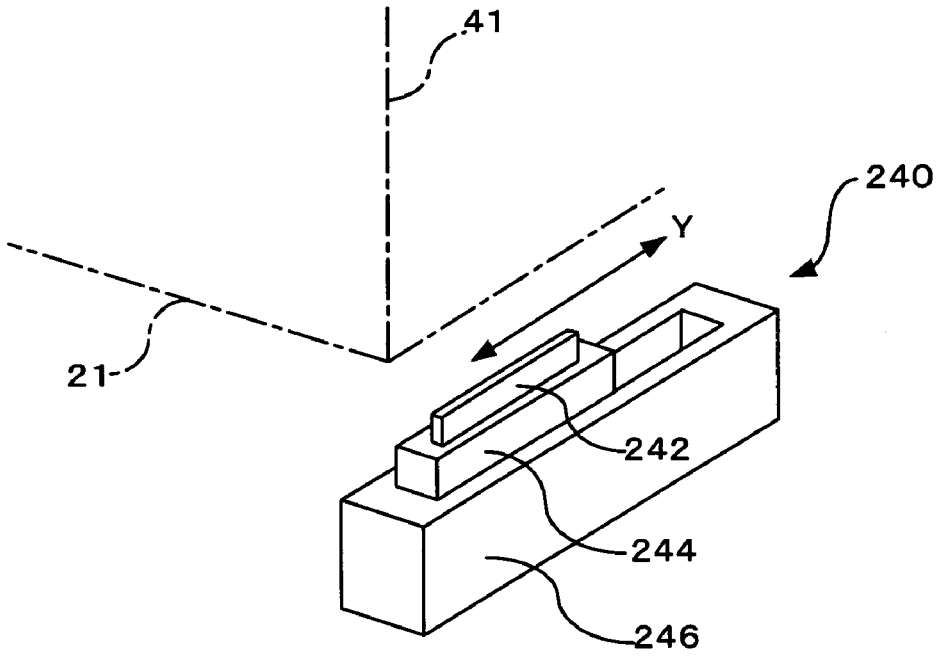
FIG. 29A is a diagram illustrating a configuration of a wiping device.
Figure 29B:
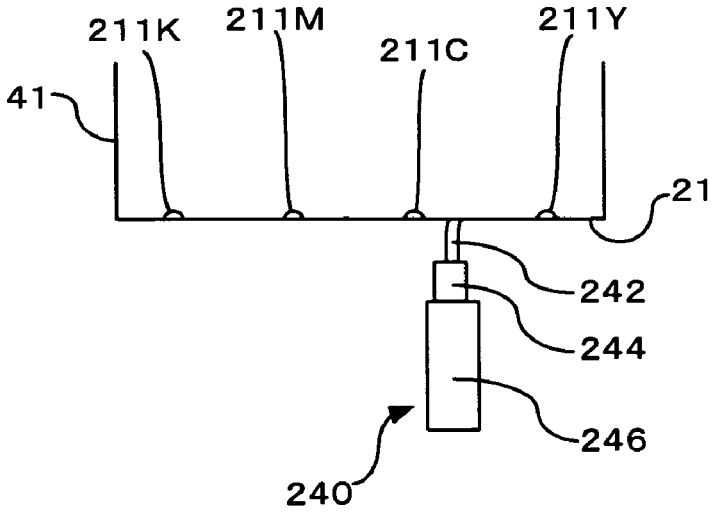
FIG. 29B is a diagram illustrating a wiping operation of the wiping device.

The wiping process is carried out by the wiping device 240. FIGS. 29A and 29B illustrate an example of the wiping device 240. FIG. 29A illustrates a configuration of the wiping device 240. FIG. 29B illustrates a wiping process using the wiping device 240.

As shown in FIG. 29A, the wiping device 240 is provided with a wiper blade 242, a wiper blade holding section 244, a wiper head section 246, and a drive mechanism (not shown) for moving the wiper head section 246 along the arrow Y direction in the diagram. The wiper blade 242 is formed using, for example, a board shaped elastic member or the like in which a felt layer and a rubber layer are joined together. Further, the wiper blade holding section 244 supports the wiper blade 242. The wiper head section 246 is moved relatively along the arrow Y direction in the diagram by the drive mechanism which is not shown. Here, the direction of the arrow Y is set parallel to the carrying direction.

Prior to cleaning being executed, the wiper head section 246 is on standby at a standby position on the front side of the arrow Y direction as shown in the diagram. Then, when a wiping process is executed on the nozzle rows 211C, 211M, 211Y, and 211K of the head 21, the wiper head section is moved by the drive mechanism which is not shown from the standby position shown in the diagram along the arrow Y direction in the diagram. Thus, the wiper head section 246 is put in place directly under the nozzle rows 211C, 211M, 211Y, and 211K of the head 21.

Then, when the head 21 moves to above the wiper head section 246 due to the movement of the carriage 41, a leading edge area of the wiper blade 242 contacts the nozzle rows 211C, 211M, 211Y, and 211K of the head 21 as shown in FIG. 29B. Further, when the carriage 41 moves such that the nozzle rows 211C, 211M, 211Y, and 211K traverse above the wiper blade, the openings of the nozzles #1 to #180 of the nozzle rows 211C, 211M, 211Y, and 211K are wiped by the wiper blade 242.

In this way, by the wiper blade 242 wiping the openings of the nozzles #1 to #180 of the nozzle rows 211C, 211M, 211Y, and 211K, extraneous matter such as foreign substances or the like adhering to the openings of the nozzles can be wiped away and removed. Thus, nozzle ejection defects can be solved.

It should be noted that the "cleaning processes" referred to here are not limited to the cleaning processes of (1) to (3). That is, the "cleaning process" includes any process as long as it is a process executed with an objective of cleaning the nozzles of the nozzles #1 to #180.

Procedure for Executing Cleaning

The following describes an example of a procedure for cleaning that is actually executed. Here, if there is a nozzle in which an ejection defect has occurred among the nozzles #1 to #180 after ejection testing is carried out by the liquid ejection testing device 62 for the nozzles #1 to #180 by ejecting ink successively from the nozzles #1 to #180 of the nozzle rows 211C, 211M, 211Y, and 211K, then a cleaning process is executed for that nozzle. Ejection testing is executed one nozzle row at a time for the four nozzle rows 211C, 211M, 211Y, and 211K. Further, the cleaning process is executed by the controller 126 selecting an appropriate cleaning process among the plurality of cleaning processes according to the results of ejection testing by the liquid ejection testing device 62.

<Ejection of Ink>

Figure 30:
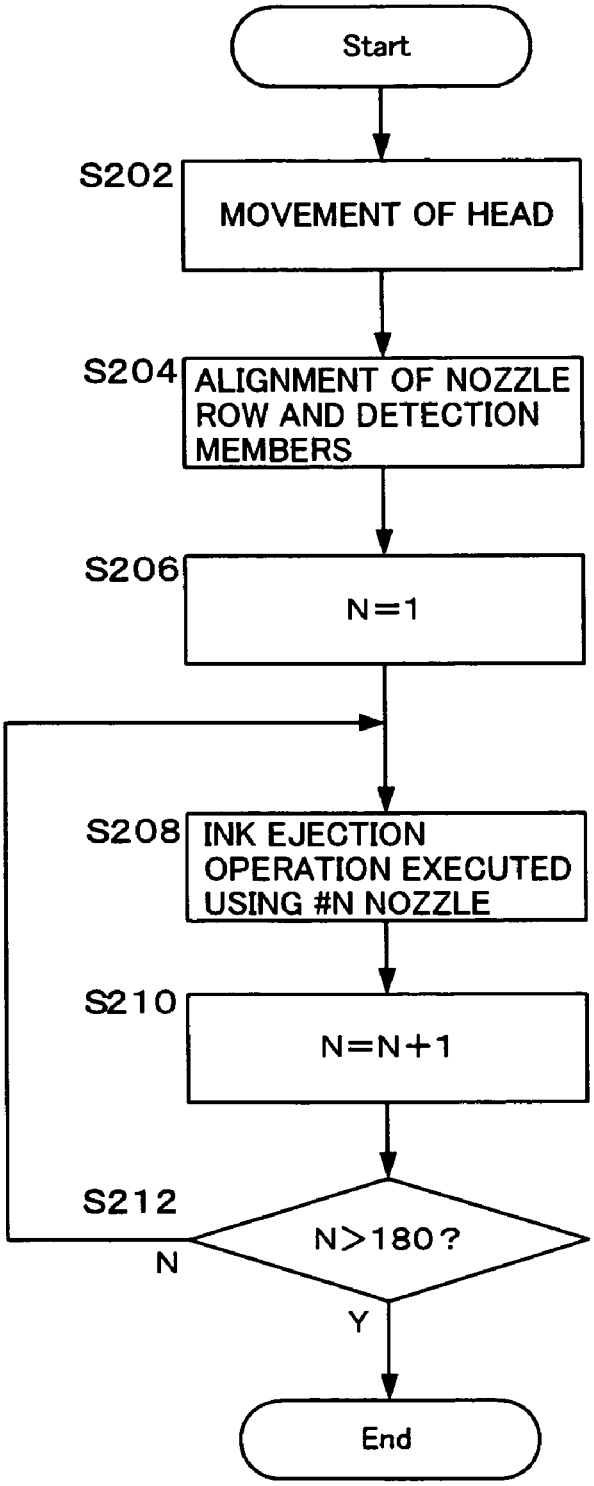
FIG. 30 is a flowchart explaining an example of an ink ejection procedure during testing.

FIG. 30 is a flowchart illustrating an example of a procedure for carrying out separate ejection testing for each of the nozzle rows 211K, 211C, 211M, and 211Y when ejection testing is carried out. Here, since the ejection testing unit 79 corresponds to only a single row of the nozzle rows, the carriage 41 (head 21) is moved with respect to each of the nozzle rows 211K, 211C, 211M, and 211Y and ejection testing is carried out separately for each of the nozzle rows 211K, 211C, 211M, and 211Y.

First, the head 21 is moved toward the ejection testing unit 79 (S202). Then, alignment is carried out between one nozzle row of the nozzle rows 211C, 211M, 211Y, and 211K targeted for testing and the ejection testing unit 79 (S204). Next, an initial value "1" is set as a variable "N" (S206) and an operation is carried out in which a one-time portion (one droplet portion) of the ink droplet Ip is ejected from the "N"th nozzle (nozzle #N) to between the first detection member 72 and the second detection member 74 to carry out ejection testing (S208). After ejection is finished, the variable "N" is set to a value "N+1" (S210), and a check is carried out as to whether or not the variable "N" exceeds "180," which is the number of nozzles (S212). Here, when the variable "N" exceeds "180", the process finishes, deeming that ejection testing is finished for all the nozzles.

On the other hand, when the variable "N" does not exceed "180", it is deemed that testing is not finished for all the nozzles #1 to #180, the procedure returns to step S208, and ejection testing is carried out by next executing an ink ejection operation for the "N+1"th nozzle (nozzle #N+1) (S208). After this, the variable "N" is again set to a value "N+1" (S210), and ejection testing is executed successively and separately for the nozzles #1 to #180 until the variable "N" exceeds "180" which is the number of nozzles.

It should be noted that in the present embodiment these series of testing processes are carried out by the controller 126 based on a program read out from the main memory 127 or carried out by commands from the computer 140.

<Determination Process>

Figure 31:
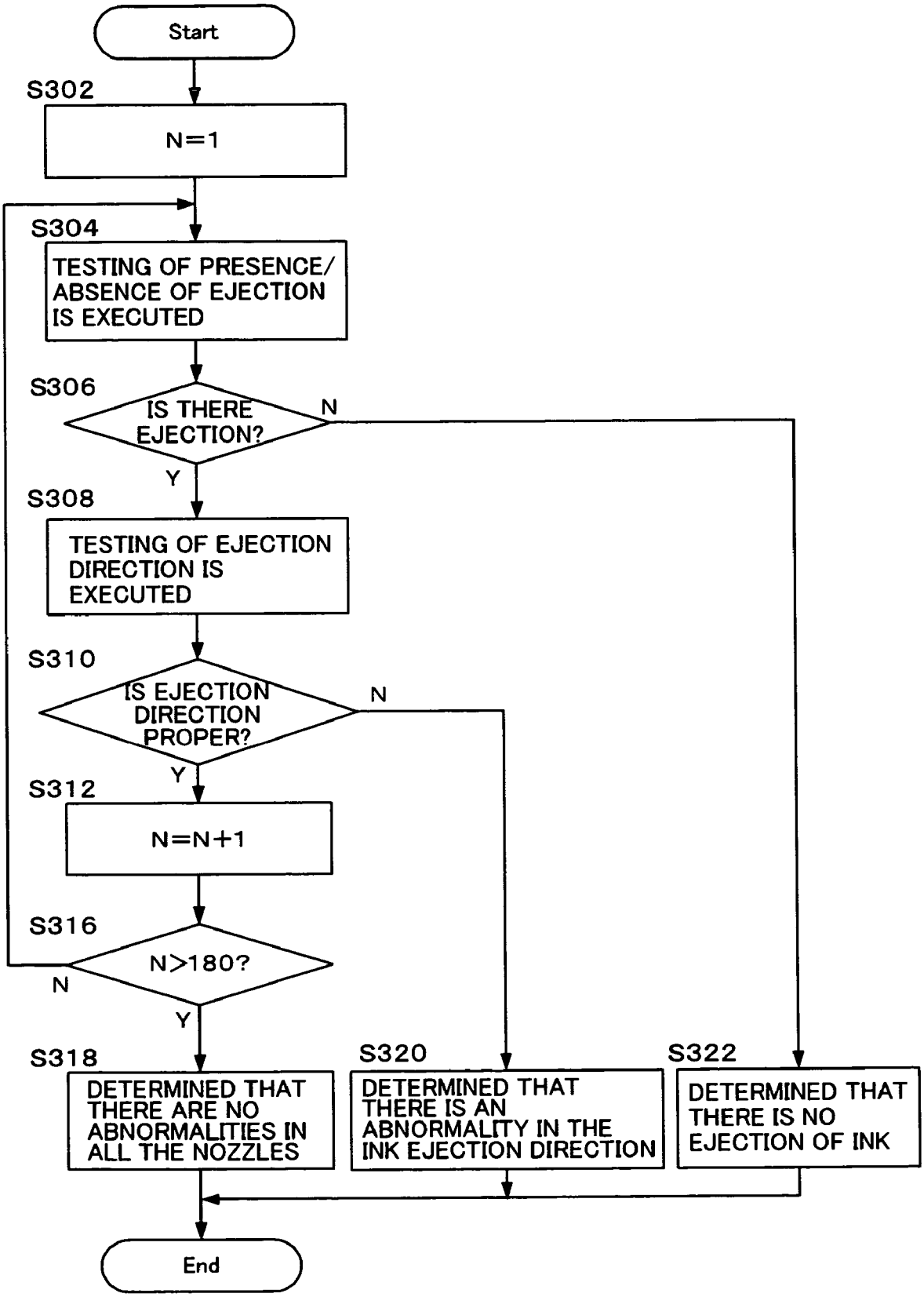
FIG. 31 is a flowchart illustrating an example of a determination process.

FIG. 31 is a flowchart illustrating an example of a determination procedure by the controller 126. The controller 126 sets an initial value "1" for the variable "N" (S302). Next, the controller 126 executes testing of the presence or absence of ejection from the "N"th nozzle (nozzle #N) (S304). This testing is executed using a method such as that described in FIGS. 14 and 15, for example. Then, the controller 126 determines whether or not there is ejection from the "N"th nozzle (nozzle #N) (S306). When a result of the testing is that ink ejection has not been detected from the "N"th nozzle (nozzle #N), the controller 126 determines that there is no ink ejection and the procedure proceeds to step S322 (S322). After this, the controller 126 finishes processing.

On the other hand, when a determination has been made that there is ejection from the "N"th nozzle (nozzle #N), the procedure proceeds to the next step S308 and the controller 126 carries out ejection direction testing for the "N"th nozzle (nozzle #N) (S308). This testing is executed using a method such as that described in FIGS. 16 to 21, for example. Then, the controller 126 determines whether or not the ejection direction is proper (S310). When a result of the testing is that the ejection direction is not proper from the "N"th nozzle (nozzle #N), the procedure proceeds to the next step S320 and the controller 126 determines that there is an abnormality in the ejection direction of the ink (S320). After this, the controller 126 finishes processing.

On the other hand, when a determination is made that the ejection direction from the "N"th nozzle (nozzle #N) is proper, the procedure proceeds to the next step S312, and the controller 126 sets the value "N+1" to the variable "N" in order to carry out testing of the next nozzle (S312). Then, the controller 126 checks whether or not the variable "N" that has been set exceeds "180" which is the number of nozzles (S316). Here, when the variable "N" does not exceed "180", the procedure returns to step S304 and the controller 126 carries out testing for a new separate untested nozzle ("N+1" nozzle). On the other hand, when the variable "N" has exceeded "180", the controller 126 deems that testing has finished for all the nozzles #1 to #180 of the nozzle row targeted for testing, the procedure proceeds to step S318, and processing immediately finishes after a determination is made that there is no abnormality in any of the nozzles #1 to #180 in the nozzle row targeted for testing (S318).

<Testing Procedure for Separate Nozzle Rows>

Figure 32:
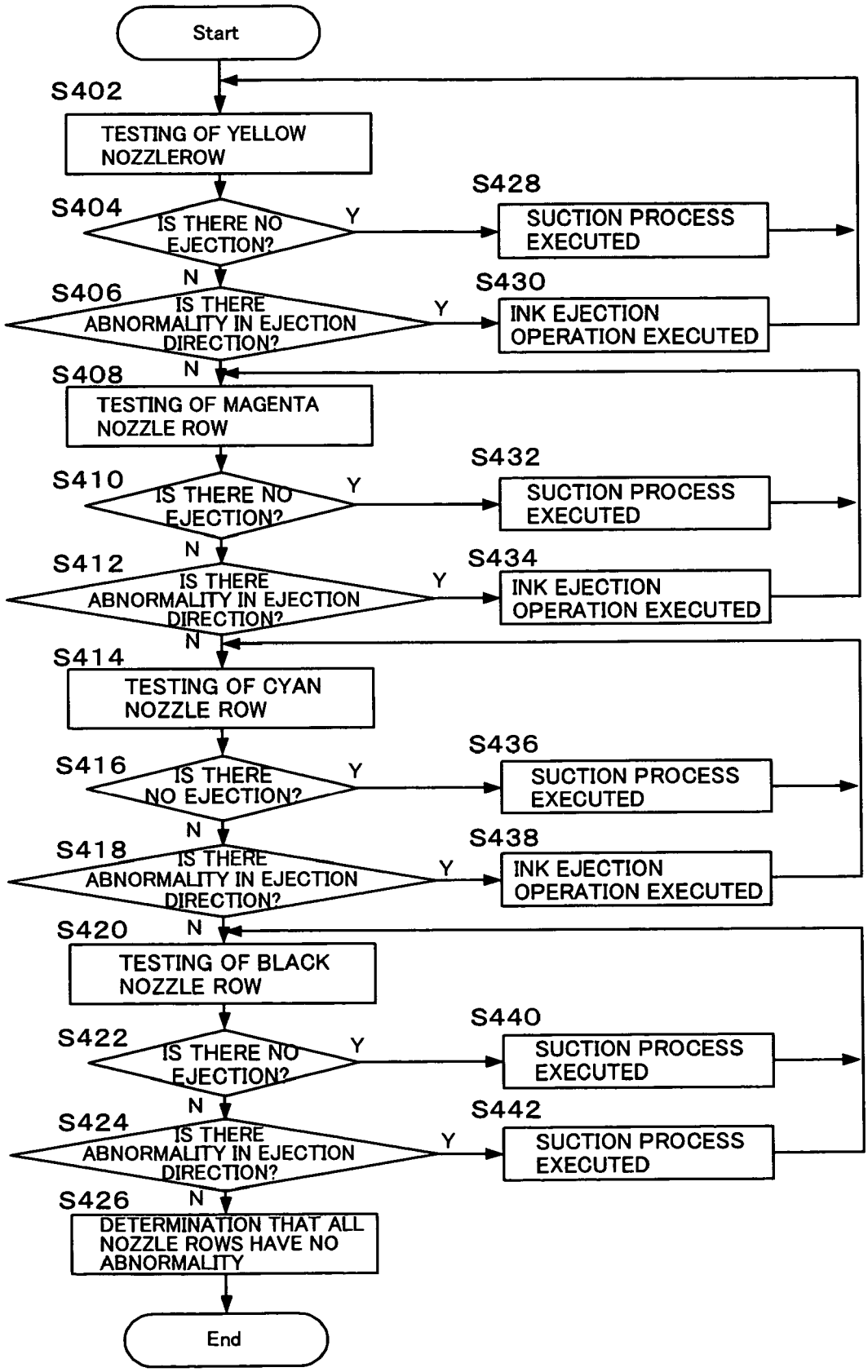
FIG. 32 is a flowchart illustrating an example of a testing procedure for the nozzle rows.

FIG. 32 is a flowchart that illustrates an example of a testing procedure for separate nozzle rows. Here, ejection testing is carried out separately for each of the nozzle rows 211K, 211C, 211M, and 211Y. Here, ejection testing is carried out in an order from the yellow nozzle row 211Y to the magenta nozzle row 211M, then the cyan nozzle row 211C, and on to the black nozzle row 211K. It should be noted that ejection testing of each of the nozzle rows 211C, 211M, 211Y, and 211K is carried out by the controller 126.

First, the controller 126 executes ejection testing of the yellow nozzle row 211Y (S402). Here, testing is carried out as to the presence or absence of ink ejection and ink ejection direction in the nozzles targeted for testing. The testing is carried out on the nozzle row targeted for testing, that is, the nozzles #1 to #180 of the yellow nozzle row 211Y. After the ejection testing, the controller 126 checks the yellow nozzle row 211Y targeted for testing as to whether or not there are any nozzles that do not have ink ejection (S404). Here, when there is a nozzle that does not have ink ejection, the controller 126 determines this to be a "serious ejection defect", and the procedure proceeds to step S428 where a suction process is carried out on the yellow nozzle row 211Y as a cleaning process (S428). After the suction process finishes, the procedure proceeds to step S402 and the controller 126 again carries out ejection testing of the yellow nozzle row 211Y.

On the other hand, when the yellow nozzle row 211Y does not have a nozzle that has no ejection of ink in step S404, the procedure proceeds to the next step S406, and the controller 126 checks whether or not there is a nozzle that has an abnormality in its ink ejection direction in the yellow nozzle row 211Y (S406). Here, when there is a nozzle that has an abnormality in its ink ejection direction, the controller 126 determines this to be a "slight ejection defect", and the procedure proceeds to step S430 where an ink ejection operation (flushing) is carried out on the yellow nozzle row 211Y as a cleaning process (S428). After the ink ejection operation is finished, the procedure proceeds to step S402, and the controller 126 again carries out ejection testing of the yellow nozzle row 211Y.

In step S406, when the yellow nozzle row 211Y does not have a nozzle that has an abnormality in its ink ejection direction, the procedure proceeds to the next step S408, and the controller 126 carries out ejection testing on the magenta nozzle row 211M (S408). After the ejection testing, the controller 126 checks the magenta nozzle row 211M targeted for testing as to whether or not there are any nozzles that do not have ink ejection (S410). Here, when there is a nozzle that does not have ink ejection, the controller 126 determines this to be a "serious ejection defect", and the procedure proceeds to step S432 where a suction process is carried out on the magenta nozzle row 211M as a cleaning process (S432). After the suction process is finished, the procedure proceeds to step S408 and the controller 126 again carries out ejection testing of the magenta nozzle row 211M.

On the other hand, in step S410, when the magenta nozzle row 211M does not have a nozzle that has no ejection of ink, the procedure proceeds to the next step S412, and the controller 126 checks whether or not there is a nozzle that has an abnormality in its ink ejection direction in the magenta nozzle row 211M (S412). Here, when there is a nozzle in the magenta nozzle row 211M that has an abnormality in its ink ejection direction, the controller 126 determines this to be a "slight ejection defect", and the procedure proceeds to step S434 where an ink ejection operation (flushing) is carried out on the magenta nozzle row 211M as a cleaning process (S434). After the ink ejection operation is finished, the procedure proceeds to step S408, and the controller 126 again carries out ejection testing on the magenta nozzle row 211M.

In step S412, when the magenta nozzle row 211M does not have a nozzle that has an abnormality in its ink ejection direction, the procedure proceeds to the next step S414, and the controller 126 carries out ejection testing on the cyan nozzle row 211C (S414). After the ejection testing, the controller 126 checks the cyan nozzle row 211C targeted for testing as to whether or not there are any nozzles that do not have ink ejection (S416). Here, when there is a nozzle that does not have ink ejection, the controller 126 determines this to be a "serious ejection defect", and the procedure proceeds to step S436 where a suction process is carried out on the cyan nozzle row 211C as a cleaning process (S436). After the suction process is finished, the procedure proceeds to step S414, and the controller 126 again carries out ejection testing of the cyan nozzle row 211C.

On the other hand, in step S416, when the cyan nozzle row 211C does not have a nozzle that has no ejection of ink, the procedure proceeds to the next step S418 and the controller 126 checks whether or not there is a nozzle that has an abnormality in its ink ejection direction in the cyan nozzle row 211C (S418). Here, when there is a nozzle in the cyan nozzle row 211C that has an abnormality in its ink ejection direction, the controller 126 determines this to be a "slight ejection defect", and the procedure proceeds to step S438 where an ink ejection operation (flushing) is carried out on the cyan nozzle row 211C as a cleaning process (S438). After the ink ejection operation is finished, the procedure proceeds to step S414, and the controller 126 again carries out ejection testing on the cyan nozzle row 211C.

In step S418, when the cyan nozzle row 211C does not have a nozzle that has an abnormality in its ink ejection direction, the procedure proceeds to the next step S420, and the controller 126 carries out ejection testing on the black nozzle row 211K (S420). After the ejection testing, the controller 126 checks the black nozzle row 211K targeted for testing as to whether or not there are any nozzles that do not have ink ejection (S422). Here, when there is a nozzle that does not have ink ejection, the controller 126 determines this to be a "serious ejection defect", and the procedure proceeds to step S440 where a suction process is carried out on the black nozzle row 211K as a cleaning process (S440). After the suction process is finished, the procedure proceeds to step S420, and the controller 126 again carries out ejection testing of the black nozzle row 211K.

On the other hand, in step S422, when the black nozzle row 211K does not have a nozzle that has no ejection of ink, the procedure proceeds to the next step S424, and the controller 126 checks whether or not there is a nozzle that has an abnormality in its ink ejection direction in the black nozzle row 211K (S424). Here, when there is a nozzle in the black nozzle row 211K that has an abnormality in its ink ejection direction, the controller 126 determines this to be a "slight ejection defect", and the procedure proceeds to step S442 where an ink ejection operation (flushing) is carried out on the black nozzle row 211K as a cleaning process (S442). After the ink ejection operation is finished, the procedure proceeds to step S420, and the controller 126 again carries out ejection testing on the black nozzle row 211K.

On the other hand, in step S424, when the black nozzle row 211K does not have a nozzle that has an abnormality in its ink ejection direction, the procedure next proceeds to the step S426, and the controller 126 determines that there is no ejection defect in all of the nozzles #1 to #180 of the nozzle rows 211C, 211M, 211Y, and 211K and finishes the testing process.

<Other Working Examples of Cleaning Processes>

In the embodiment illustrated in FIG. 32, the suction process was executed as the cleaning process on the nozzles when there was a nozzle in the nozzles #1 to #180 of the nozzle rows 211C, 211M, 211Y, and 211K that did not have ink ejection, but there is no limitation to this suction process as the cleaning process to executed when there is a nozzle without ink ejection. That is, the above-described ink ejection operation or the wiping process may be executed as the cleaning process when there is a nozzle without ink ejection.

Additionally, other cleaning processes may be executed on a nozzle without ink ejection. Further still, multiple types of cleaning processes may be combined and executed as the cleaning process to be executed when there is a nozzle without ink ejection. For example, the above-described suction process and ink ejection operation may be combined and executed.

On the other hand, the ink ejection operation was executed as the cleaning process on the nozzles when there was a nozzle in the nozzles #1 to #180 of the nozzle rows 211C, 211M, 211Y, and 211K that had an abnormality in its ink ejection direction, but there is no limitation to this ink ejection operation as the cleaning process to executed when there is a nozzle having an abnormality in its ink ejection direction. That is, the above-described suction process or the wiping process may be executed as the cleaning process when there is a nozzle having an abnormality in its ink ejection direction.

Additionally, other cleaning processes may be executed on a nozzle that has an abnormality in its ink ejection. Further still, multiple types of cleaning processes may be combined and executed as the cleaning process to be executed when there is a nozzle that has an abnormality in its ink ejection. For example, the above-described ink ejection operation and wiping process may be combined and executed.

Test Timing

Timings by which ejection testing is carried out include the following.

(1) During Print Processing

Ejection testing is executed with a suitable timing during print processing. For example, in the case of "bi-directional printing", ejection testing is executed on the nozzles #1 to #180 when the movement direction changes and the carriage 41 is moved to a standby position. Thus, it is possible to avoid problems in the print image occurring when nozzle clogging or the like occurs during print processing.

(2) When the Power is Turned On

Ejection testing is executed when the power is turned on. This involves executing ejection testing when the power for the inkjet printer 1 is turned on to carry out subsequent printing, and ejection testing is executed on the nozzles #1 to #180 as one of the processes during initialization of the inkjet printer 1. By executing ejection testing with this timing, print processing can be executed smoothly without clogging or the like in the nozzles #1 to #180.

(3) During Paper Supply

Ejection testing is executed during an operation in which the medium S is sent in to a predetermined position for printing, that is, during paper supply. This involves checking whether or not ink is ejected properly when print processing is about to be executed on a single medium S, and ejection testing may be executed each time the medium S is supplied, and ejection testing may be carried out after a predetermined number of media at an appropriate interval.

(4) During Acquisition of Print Data

Ejection testing is executed when the inkjet printer 1 receives print data from the computer 140 such as a personal computer. That is, a check is carried out as to whether or not ink is being ejected properly when print data is received from the computer 140 and subsequent printing is about to be executed. By executing ejection testing with this timing, print processing can be executed smoothly without clogging or the like in the nozzles #1 to #180.

It should be noted that in the invention it is not absolutely necessary to execute ejection testing using the above-described timings (1) to (4), and it is also possible to execute ejection testing using timings other than those of (1) to (4).

Overview

In foregoing embodiment, by carrying out different cleaning processes on the nozzles when a determination is made that there is no ink ejection and when a determination is made that there is an abnormality in the ink ejection direction using the liquid ejection testing device 62 on the nozzles #1 to #180 of the nozzle rows 211C, 211M, 211Y, and 211K, an appropriate cleaning process can be executed in response to the condition of the nozzle ejection defect. That is, in the present embodiment, when it is determined that there is no ink ejection, the controller 126 judges this to be a "serious ejection defect", and the suction process is carried out on the nozzles #1 to #180 as the cleaning process. When it is determined that there is an abnormality in the ink ejection direction, the controller 126 judges this to be a "slight ejection defect", and the ink ejection operation is carried out on the nozzles #1 to #180 as the cleaning process. By performing the suction process when a determination is made that there is no ink ejection and by performing the ink ejection operation when a determination is made that there is an abnormality in the ink ejection direction, the time required for the cleaning processing can be shortened and the amount of ink ejected during cleaning can be suppressed, thus increases in the cost burden of the user can be prevented.

Further, with the present embodiment, ejection testing can be carried out appropriately and simply by testing the ink ejection direction when a determination is made that there is no ink ejection.

Further, detection members are provided in the present embodiment in which an induced current is produced by ink ejected from the nozzles #1 to #180, and since the induced current produced in the detection member is detected and determinations are made based on the detection result, it can be easily determined whether or not there is ejection of ink from the nozzles #1 to #180 and whether or not there is an abnormality in the ink ejection direction from the nozzles #1 to #180, and moreover these determinations can be carried out at the same time. In particular, determinations can be made extremely simply by carrying out the determinations by comparing the induced current produced in the detection members and the predetermined reference value.

Other Determinations

In the above-described embodiment, description was given concerning a point that testing of whether or not the ejection direction of ink from the nozzles #1 to #180 is proper can be achieved based on the induced currents produced respectively in the first detection members 72 and the second detection members 74. However, using the induced currents produced respectively in the first detection members 72 and the second detection members 74, in addition to testing whether or not the ejection direction is proper, for example, it is also possible to test whether or not ink from the nozzles #1 to #180 is being ejected and dispersed.

Figure 33:
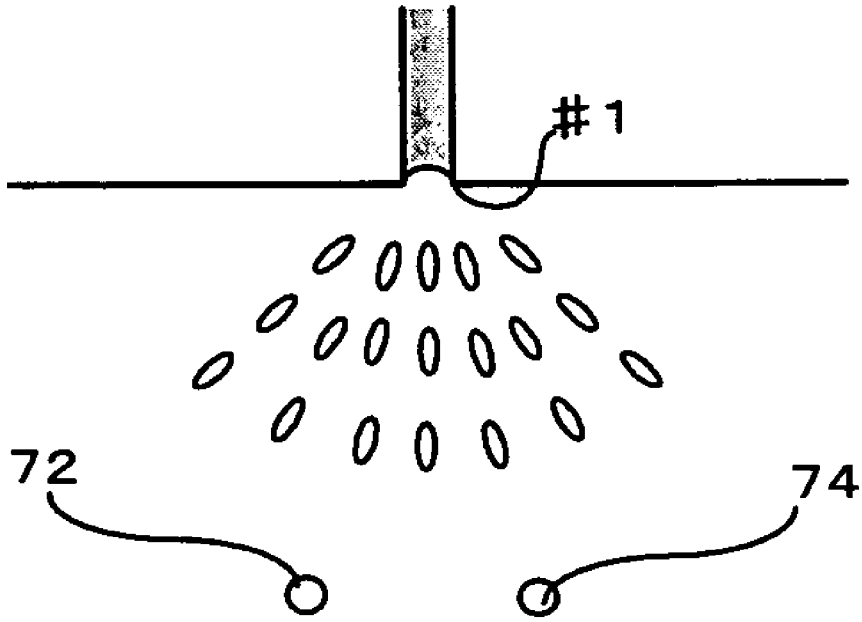
FIG. 33 is an explanatory diagram of an example of when ink is ejected and dispersed from the nozzle.

Here, a case in which ink is ejected and dispersed from the nozzles #1 to #180 is described. FIG. 33 illustrates an example of when ink is ejected and dispersed from the nozzle #1. As shown in the diagram, when ink is ejected and dispersed from the nozzle #1, the ink ejected from the nozzle #1 becomes fine particles and scatters in the vicinity when separating from the nozzle. Accordingly, the ink that sputters and is ejected from the nozzle #1 becomes a mist and may cause adverse effects such as soiling of the vicinity.

The first detection members 72 and the second detection members 74 can detect when ink from the nozzles #1 to #180 is ejected and dispersed in this way. That is, when ink from the nozzles #1 to #180 is ejected and dispersed, each of the particles formed by being dispersed is charged respectively, and therefore respective induced currents are produced in the first detection members 72 and the second detection members 74 and testing can be carried out as to whether or not ink is being ejected from the nozzles #1 to #180. However, since each of the particles passes the vicinity of the first detection member 72 or the second detection member 74 separately, an induced current of a waveform that is different than when ink is ejected properly can be obtained in the first detection members 72 and the second detection members 74. Specifically, for example, induced currents with peak values different than when ink is ejected properly can be obtained in the first detection members 72 and the second detection members 74. Therefore, by examining the magnitude of induced currents produced respectively in the first detection members 72 and the second detection members 74, it is possible to detect that ink from the nozzles #1 to #180 is ejected and dispersed.

Additionally, by examining the magnitude of induced currents produced respectively in the first detection members 72 and the second detection members 74, in addition to being able to detect whether or not ink from the nozzles #1 to #180 is ejected and dispersed, it is possible to detect various ejection conditions of the ink from the nozzles #1 to #180.

Other Cleaning Processes

In the foregoing embodiments, three varieties of cleaning processes were described, (1) the suction process, (2) the ink ejection operation (flushing), and (3) the wiping process. Here, (2) the ink ejection operation (flushing) includes the following process.

In this ink ejection operation (flushing), the amount of ink ejected from the nozzles #1 to #180 is reduced. Specifically, in the present embodiment, for example, rather than executing an ink ejection operation for forming large-sized dots (large dots), an ink ejection operation is executed for forming small-sized dots (small dots) as the cleaning process. It should be noted that an ink ejection operation for forming mid-sized dots (medium dots) may also be executed.

Figure 34A:
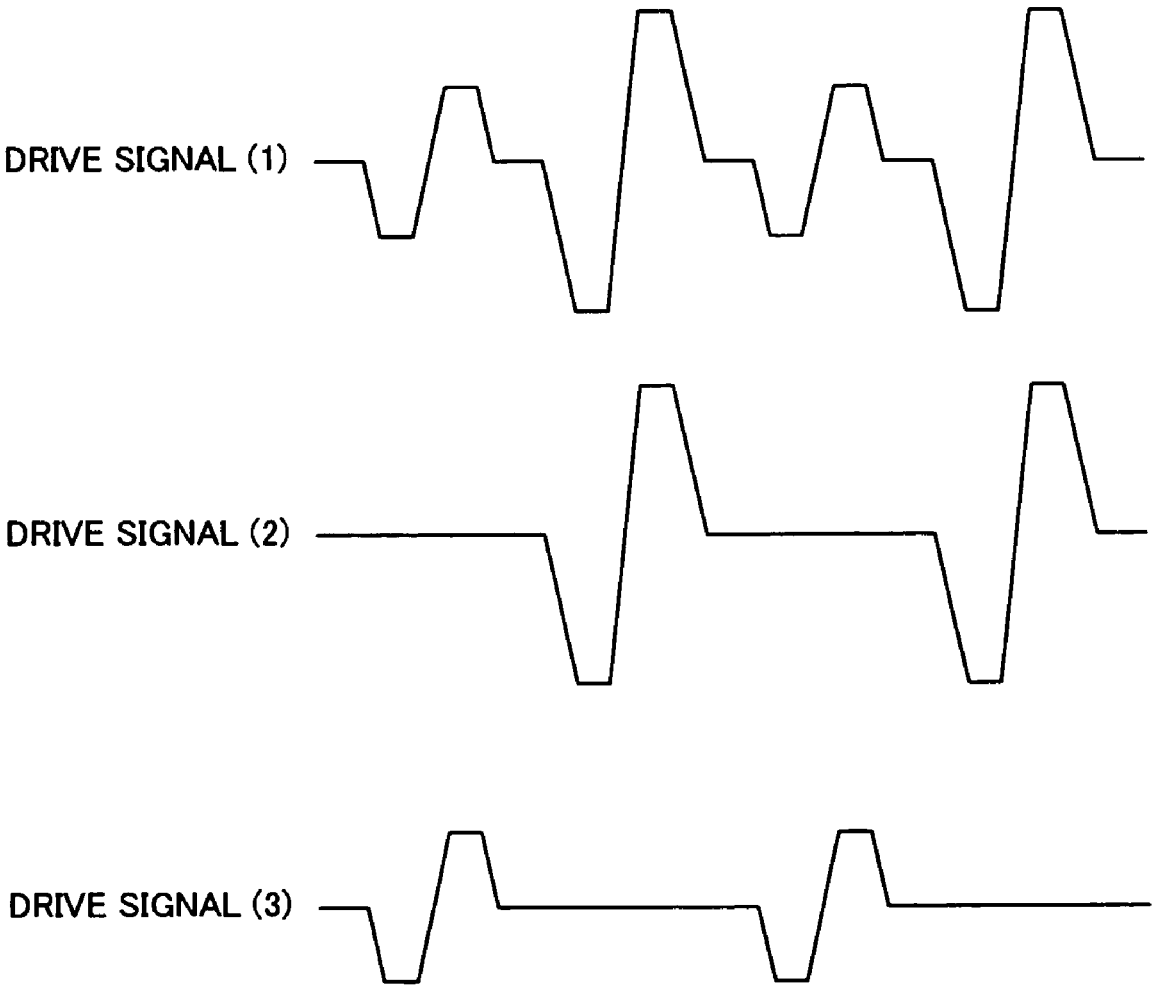
FIG. 34A is an explanatory diagram of an example of drive signals for carrying out an ink ejection operation.

FIG. 34A illustrates the drive signals for carrying out ink ejection operations for forming respectively the large-sized dots (large dots), the mid-sized dots (medium dots), and the small-sized dots (small dots). In this diagram, a drive signal (1) indicates a drive signal for carrying out the ink ejection operation for forming the large-sized dots (large dots). The drive signal (2) indicates a drive signal for carrying out the ink ejection operation for forming the mid-sized dots (medium dots). Further, the drive signal (3) indicates a drive signal for carrying out the ink ejection operation for forming the small-sized dots (small dots). The signal waveforms of each of the drive signals (1) to (3) are respectively different. When carrying out an ink ejection operation for forming the small-sized dot (small dot), the drive signal (3) is used, which has a low frequency compared to the drive signal (1) for forming the large-sized dots (large dots).

Figure 34B:
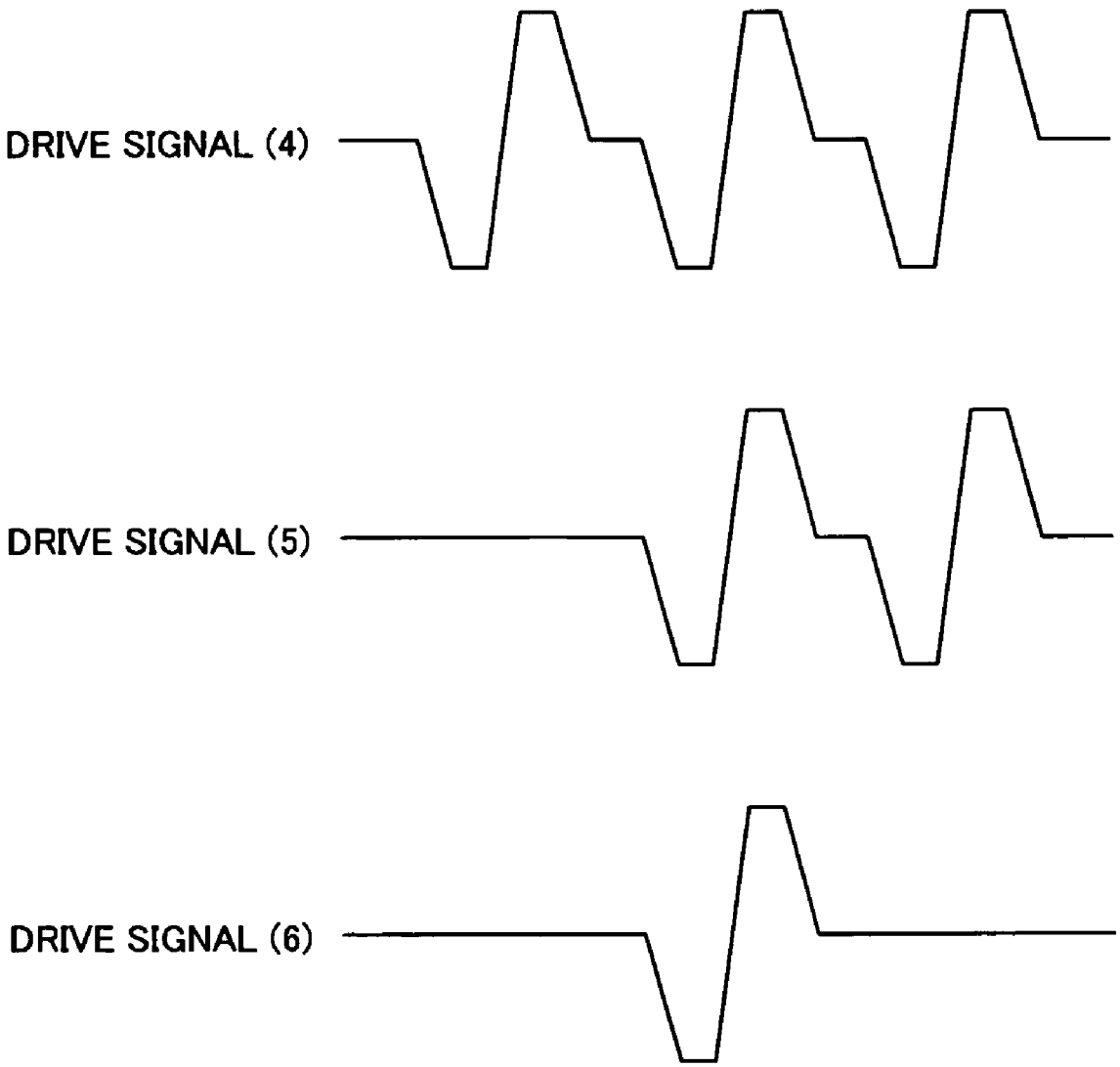
FIG. 34B is an explanatory diagram of another example of drive signals for carrying out an ink ejection operation.

FIG. 34B illustrates an example of when there are different drive signals. Here, as shown in the diagram, the drive signals have a plurality of pulses and each of the pulses have the same shape. When forming a small-sized dot (small dot), one pulse for example from among these plurality of pulses is selected and used (see drive signal (6)). Further, when forming a mid-sized dot (medium dot), two pulses for example from among these plurality of pulses are selected and used (see drive signal (5)). Further, when forming a large-sized dot (large dot), all of the plurality of pulses are selected and used (here there are three pulses, see drive signal (4)).

Then, when carrying out a cleaning process, the drive signal (6) for forming small-sized dots (small dots) or the drive signal (5) for forming mid-sized dots (medium dots) is used. That is to say, the drive signal (4) or the drive signal (5) is used, with these having lower frequencies compared to the drive signal (4) for forming the large-sized dots (large dots).

A reason for carrying out an ink ejection operation (flushing) using a reduced amount of ink as a cleaning process is as follows. Namely, problems such as clogging of the nozzles #1 to #180 may be solved by using an operation in which ink for forming large-sized dots (large dots) is ejected, and may be solved by using an operation in which ink for forming mid-sized dots (medium dots) is ejected, and moreover, may be solved by using an operation in which ink for forming small-sized dots (small dots) is ejected.

Some problems that are solved using an operation in which ink for forming mid-sized dots (medium dots) or small-sized dots (small dots) is ejected are not solved by using an operation in which ink for forming large-sized dots (large dots) is ejected. Furthermore, some problems that are not solved using an operation in which ink for forming mid-sized dots (medium dots) or small-sized dots (small dots) is ejected are solved by using an operation in which ink for forming large-sized dots (large dots) is ejected. Thus, problems such as clogging of the nozzles #1 to #180 respectively have appropriate solving methods. Therefore, it is necessary to execute each of the cleaning processes according to problems such as clogging of the nozzles #1 to #180 when performing cleaning processes for the nozzles #1 to #180.

Thus, by executing as the cleaning process an ink ejection operation (flushing) for forming dots of another size (medium dots, small dots) excluding the largest size, it is possible to solve problems such as clogging of the nozzles that are difficult to solve using an ink ejection operation (flushing) in which large-sized dots (large dots) are formed. Also, ink consumption can be reduced by the amount that the volume of ink ejection is made smaller.

Other Configuration Examples of Liquid Ejection Testing Device

<Item 1: Using Frictional Electrification>

Figure 35A:
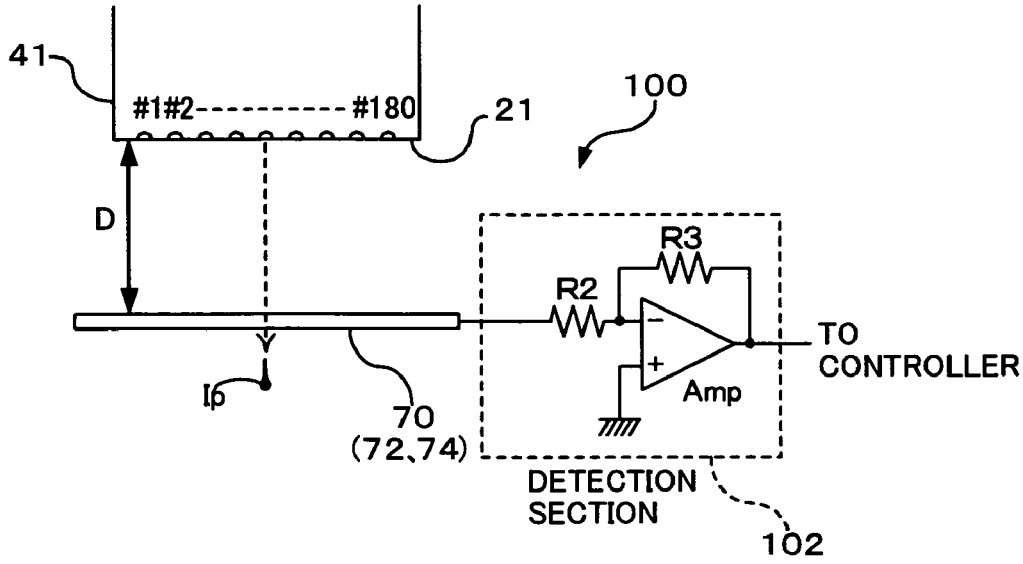
FIG. 35A is a diagram illustrating another embodiment of the liquid ejection testing device.

FIG. 35A illustrates another configuration example of the liquid ejection testing device according to the invention. As shown in the diagram, unlike the earlier described liquid ejection testing device (see FIG. 9) that charges the ink droplets Ip ejected from the nozzles #1 to #180 by applying a high voltage to the detection members 70 (first detection member 72 or the second detection member 74) in which an induced current is produced, the liquid ejection testing device 100 uses a so-called frictional electrification phenomenon in which charging occurs naturally when the ink droplets Ip ejected from the nozzles #1 to #180 move apart from the nozzles #1 to #180, thereby causing the ink droplets Ip to become charged. Therefore, a structure that applies a high voltage to the detection member 70 to charge the ink droplet Ip is omitted.

By using frictional electrification in this manner to charge the ink droplets Ip ejected from the nozzles #1 to #180, further simplification of the structure of the liquid ejection testing device 100 can be achieved.

It should be noted that since a high voltage is not applied here to the detection members 70 (the first detection member 72 or the second detection member 74), a detection section 102 (corresponding to the first detection section and the second detection section) that detects the induced currents produced in the detection members 70 (the first detection member 72 or the second detection member 74) is configured with the capacitor C omitted, compared to the structure of the detection section 80 of the earlier described liquid ejection testing device 62 (see the basic configuration 60 in FIG. 9).

<Item 2: Installation of an Electrode Section>

Figure 35B:
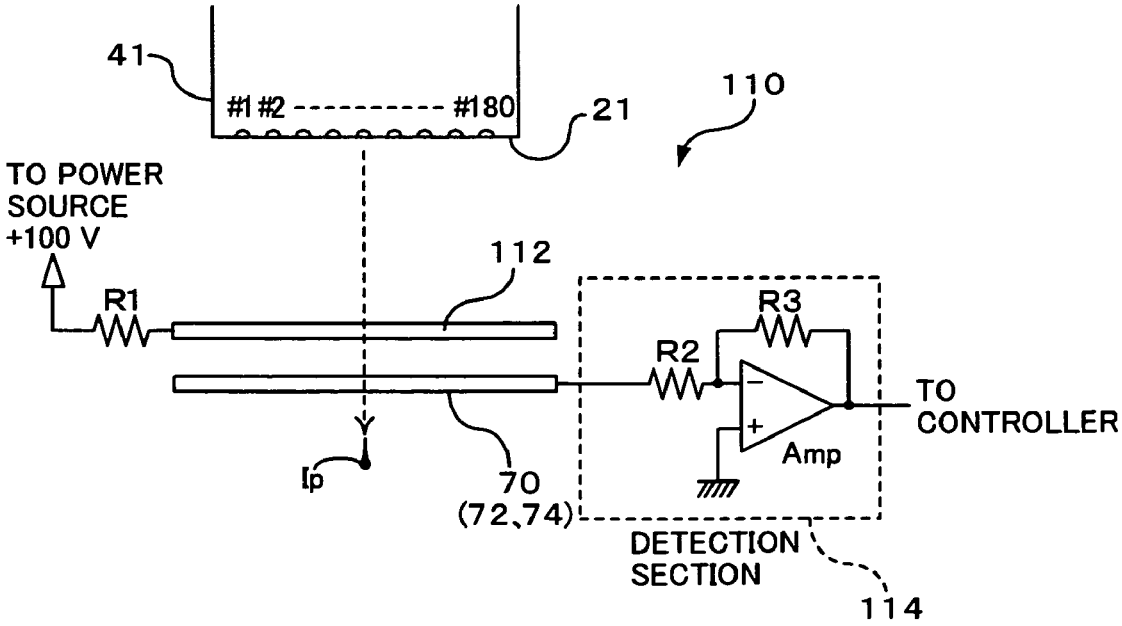
FIG. 35B is a diagram illustrating another embodiment of the liquid ejection testing device.

FIG. 35B illustrates another configuration example of the liquid ejection testing device according to the invention. As shown in the diagram, a liquid ejection testing device 110 is provided with an electrode section 112 separate from the detection member 70 (the first detection member 72 or the second detection member 74) and charges the ink droplet Ip ejected from the nozzles #1 to #180 using the electrode section 112. As shown in the diagram, the electrode section 112 is made of a wire rod having the conductivity of a metal or the like in the same manner as the detection member 70 (the first detection member 72 or the second detection member 74) and is arranged parallel to the head 21 extending in a tensioned state. A power source (not shown) is connected to the electrode section 112 via a protective resistor R1, and a high voltage of +100 V (volts), for example, is applied from the power source.

By providing this electrode section 112, an electric field is formed between the head 21 and the electrode section 112 and therefore charging can be achieved when the ink droplet Ip moves away from the nozzles #1 to #180.

It should be noted that in this case too, as in the above-described "Item 1," since a high voltage is not applied here to the detection members 70 (the first detection member 72 or the second detection member 74), a detection section 114 (corresponding to the first detection section and the second detection section) that detects the induced currents produced in the detection members 70 (the first detection member 72 or the second detection member 74) is configured with the capacitor C omitted, compared to the structure of the detection section 80 (the first detection section 82 or the second detection section 84) of the earlier described liquid ejection testing device 62 (see the basic configuration 60 in FIG. 9).

Further, it is preferable that the installation position of the electrode section 112 is as close as possible to the head 21. The closer the electrode section 112 is to the head 21, the stronger the electric field between the electrode section 112 and the head 21 can be made, thus the induced current can be even more easily produced in the detection member 70 (the first detection member 72 or the second detection member 74).

<Item 3: Other Embodiments of the Detection Member>

Figure 36A:
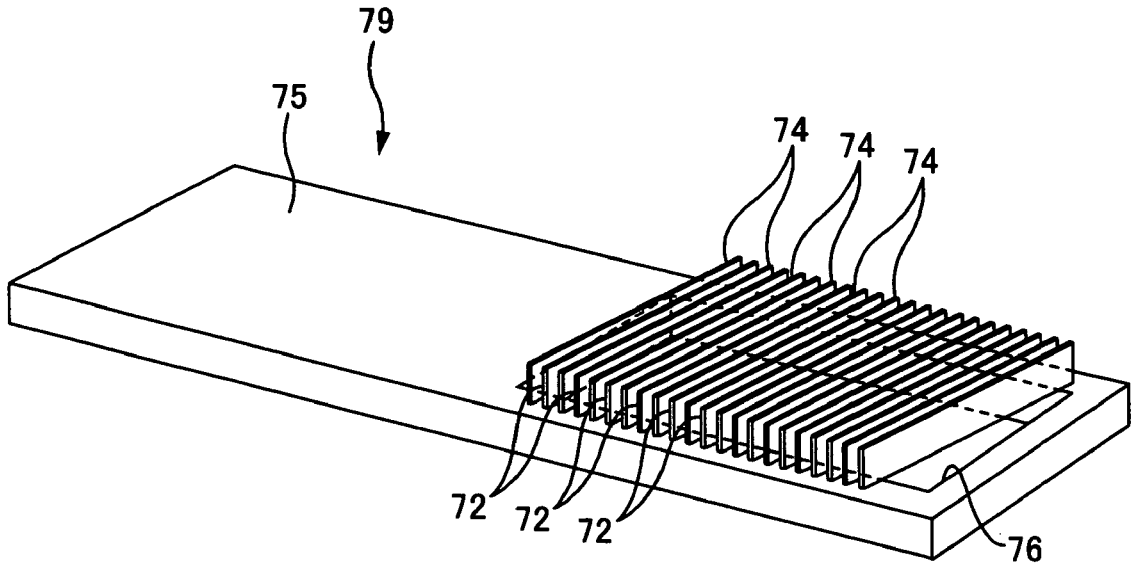
FIG. 36A is a perspective view showing another embodiment of the detection members.
Figure 36B:
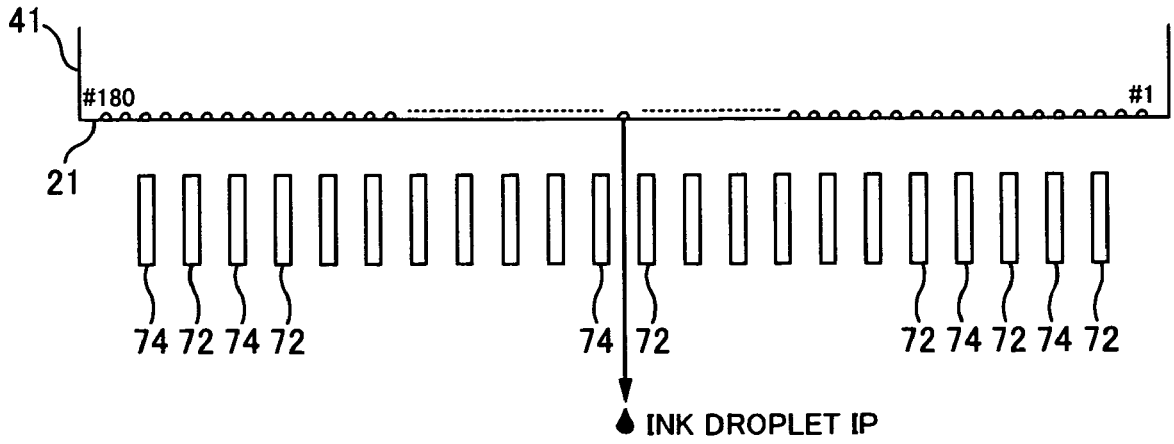
FIG. 36B is a lateral view showing another embodiment of the detection members.

FIGS. 36A and 36B illustrate another embodiment of the first detection members 72 and the second detection members 74. FIG. 36A shows an ejection testing unit 79 in which the first detection members 72 and the second detection members 74 are installed. FIG. 36B illustrates a condition when testing is performed using the first detection member 72 and the second detection member 74.

Here, as shown in FIG. 36A, the first detection members 72 and the second detection members 74 are formed by respective board shaped members. The thicknesses of the board shaped first detection member 72 and the second detection member 74 are set here at approximately 0.2 mm. Further, the heights of the board shaped first detection member 72 and the second detection member 74 are set here at approximately 3 mm. The board shaped first detection members 72 and the second detection members 74 are suspended diagonally across an opening 76 provided at a leading edge area of the substrate 75 of the ejection testing unit 79 so as to intersect the movement direction of the carriage 41. The board shaped first detection members 72 and the second detection members 74 are arranged in parallel to each other with an interval therebetween. Here, the intervals between the first detection members 72 and the second detection members 74 are respectively equivalent. Both of the end areas of the first detection members 72 and the second detection members 74 are fixed to an edge area of the opening 74. Each of the first detection members 72 and the second detection members 74 are installed corresponding respectively to the nozzles #1 to #180.

As shown in FIG. 36B, the ink droplets Ip ejected from the nozzles #1 to #180 of the head 21 pass through a gap between the first detection member 72 and the second detection member 74 and drop below. Thus, induced currents are produced respectively in the first detection members 72 and the second detection members 74.

Supplemental Matters

<Ink Recovery Section>

Figure 36C:
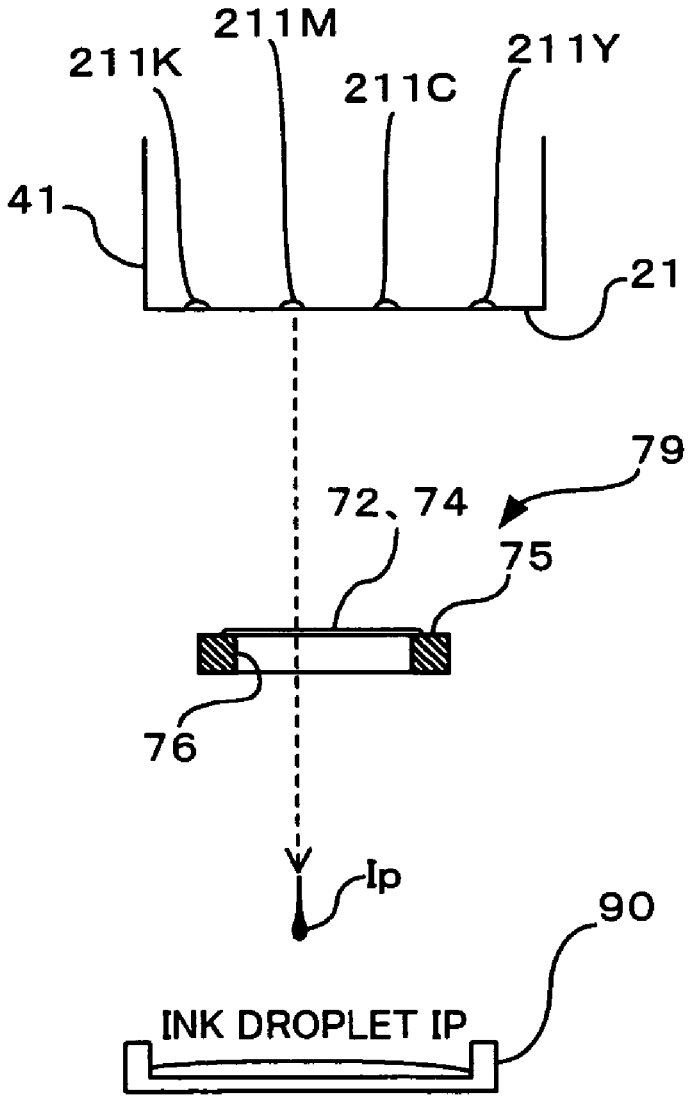
FIG. 36C is a diagram illustrating an example of an ink recovery section.

The inkjet printer 1 according to the present embodiment is provided with an ink recovery section 90 for recovering ink used in ejection testing. FIG. 36C illustrates the ink recovery section 90. As shown in the diagram, the ink recovery section 90 is arranged below the ejection testing unit 79, for example, and accommodates and recovers the ink droplets Ip that are ejected from the nozzles #1 to #180 of the head 21, pass beside the first detection members 72 and the second detection members 74, and drop through the opening 76 of the substrate 75. By recovering the ink used in ejection testing in the ink recovery section 90, the inside of the inkjet printer 1 can be kept from being soiled by ink.

It should be noted that in the present embodiment the ink recovery section 90 is formed as a concave container as shown in the diagram, but as long as it recovers ink used in the ejection testing, for example, a configuration may be provided such as a groove portion formed on the platen 14 having a concave cross section.

<Water Repellency Process>

A water repellency process may be executed on a front surface of the first detection member 72 or the second detection member 74. By executing a water repellency process on the front surface of the first detection member 72 or the second detection member 74 in this way, ink can be easily removed from the front surface of the first detection member 72 or the second detection member 74 even when the ink droplets Ip ejected from the nozzles #1 to #180 come in contact with the first detection member 72 or the second detection member 74.

Furthermore, a water repellency process may also be executed in the same manner on a front surface of the electrode section 112. By executing a water repellency process on the front surface of the electrode section 112 in this way, ink can be easily removed from the front surface of the electrode section 112 even when the ink droplets Ip ejected from the nozzles #1 to #180 adhere to the electrode section 112.

Methods of implementing a water repellency process include providing a water repellent layer or the like on the surface of the first detection member 72, the second detection member 74, or the electrode section 112 using coating or the like, and also include other commonly known methods.

Configuration of the Liquid Ejection System etc.

Figure 37:
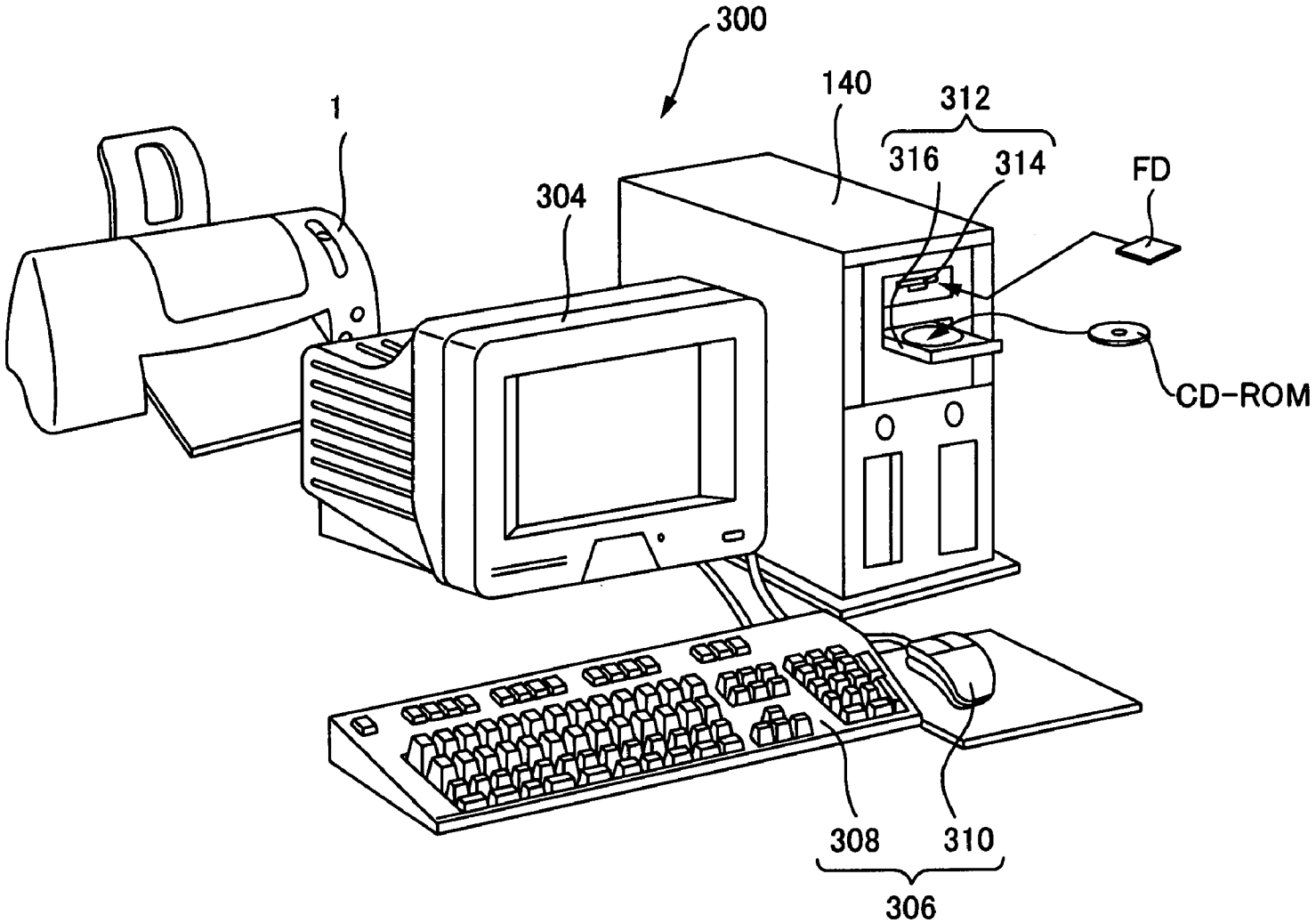
FIG. 37 is a perspective view showing an external view of an example of a liquid ejection system.

The following is a description concerning an example in which the inkjet printer 1 is provided as a liquid ejection apparatus, as a liquid ejection system according to an embodiment of the invention. FIG. 37 shows the external configuration of an embodiment of a liquid ejection system according to the invention. A liquid ejection system 300 is provided with the computer 140, a display device 304, and an input device 306. The computer 140 is configured by various computers such as a personal computer.

The computer 140 is provided with a reading device 312 such as an FD drive 314 and a CD-ROM drive 316. In addition to the above, the computer 140 can be provided with, for example, an MO (magnet optical) disk drive and a DVD drive. Furthermore, the display device 304 is achieved by various display devices such as a CRT display, a plasma display, and a liquid crystal display. The input device 306 is achieved by, for example, a key board 308 and a mouse 310.

Figure 38:
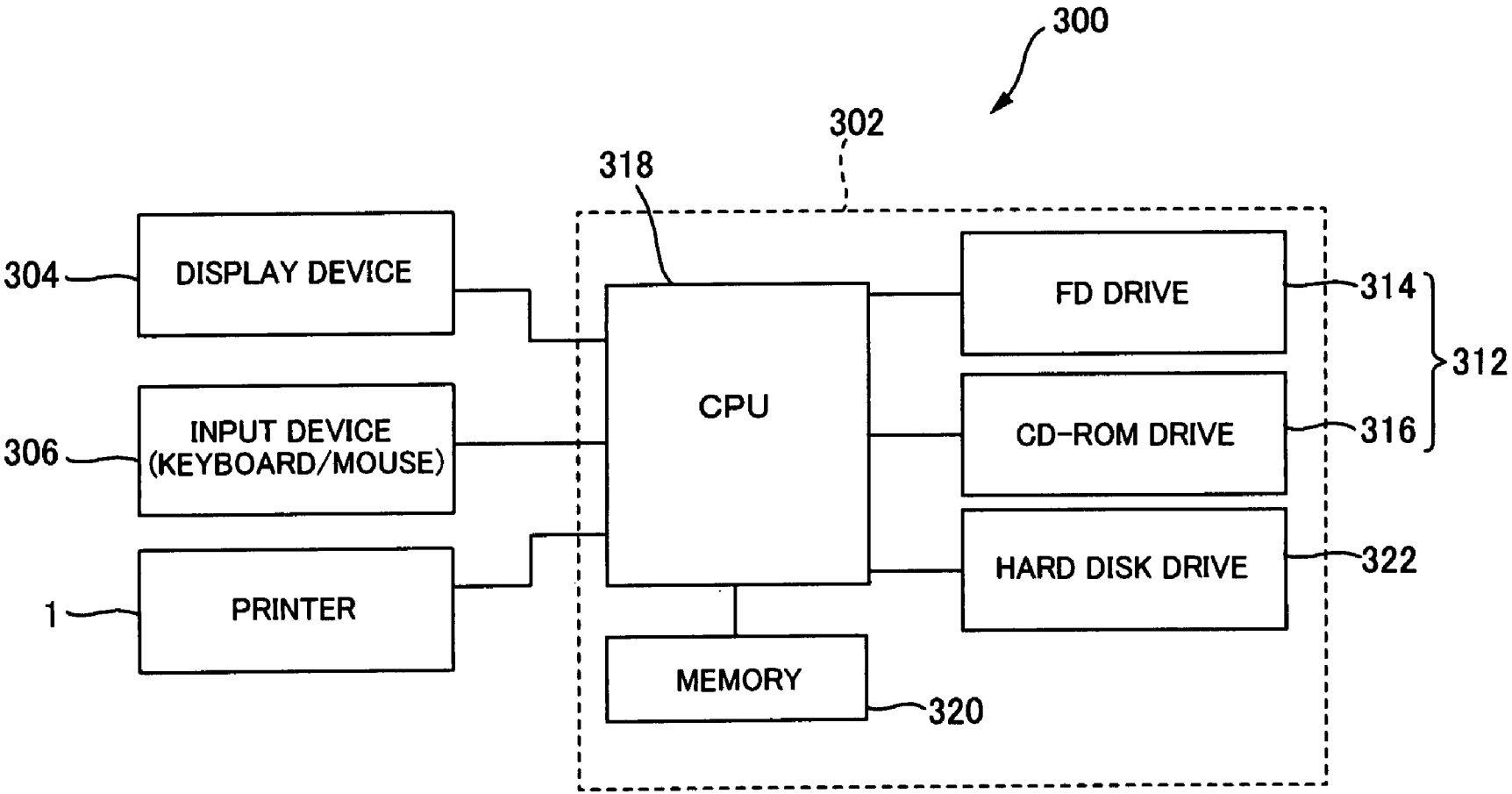
FIG. 38 is a block diagram showing the system configuration of an example of the liquid ejection system.

FIG. 38 is a block diagram showing an example of the system configuration of the liquid ejection system according to this embodiment. The computer 140 is provided with a CPU 318, a memory 320, and a hard disk drive 322, in addition to the reading device 312 such as the FD drive 314 and the CD-ROM drive 316.

The CPU 318 performs overall control of the computer 140. Further, various types of data is stored in the memory 320. A printer driver, for example, as a program for controlling a liquid ejection apparatus such as the inkjet printer 1 according to this embodiment is installed in the hard disk drive 322. The CPU 318 reads out a program such as the printer driver stored in the hard disk drive 322 and operates according to the program. Further, the CPU 318 is connected to, for example, the display device 304, the input device 306, and the inkjet printer 1 arranged outside the computer 140.

Note that, as an overall system, the liquid ejection system 300 that is thus achieved is a superior system to conventional systems.

Other Embodiments

In the foregoing embodiment, a nozzle cleaning device equipped in a liquid ejection apparatus (printing apparatus) such as an inkjet printer according to the invention was described. However, the foregoing embodiment is for the purpose of facilitating the understanding of the invention and is not to be interpreted as limiting the invention. The invention can of course be altered and improved without departing from the gist thereof, and includes functional equivalents. In particular, the embodiments described below are also included in the nozzle cleaning device according to the invention.

<Regarding the Liquid>

Ink was described as an example of the liquid in the above embodiment, but there is no limitation to ink, and various other liquids can be used instead of ink, for example, metallic material, organic material (for example, macromolecular material), magnetic material, conductive material, wiring material, film-formation material, electronic ink, various processed liquids, and genetic solutions.

<Regarding the Liquid Ejection Nozzles>

In the foregoing embodiment, the nozzles #1 to #180 that eject ink were described as an example of the "liquid ejection nozzles," but the "liquid ejection nozzles" are not limited to nozzles that eject ink. That is, as described above, nozzles that eject, as the "liquid", materials other than ink, namely, for example, various types of liquid such as metallic material, organic material (for example, macromolecular material), magnetic material, conductive material, wiring material, film-formation material, electronic ink, various processed liquids, and genetic solutions may be used.

Further, in the foregoing embodiment, the nozzles #1 to #180 that eject ink were described as an example in a case arranged linearly in a row with intervals therebetween along the carrying direction of the medium S as the "liquid ejection nozzles", but the "liquid ejection nozzles" are not necessarily arranged in that manner. That is, the "liquid ejection nozzles" may be arranged in forms other than this form, and the form of nozzle arrangement is of no particular concern.

<Regarding the First Determination Section and the Second Determination Section>

In the foregoing embodiment, the determination of whether or not ejection of ink from the nozzles #1 to #180 is proper is carried out by the controller 126 which controls the entire inkjet printer 1 (printing apparatus), but the determination of whether or not ejection of ink from the nozzles #1 to #180 is proper is not necessarily carried out by the controller 126. That is, the "first determination section" that determines whether or not there is ejection of ink (liquid) and the "second determination section" that determines whether or not there is an abnormality in the ejection direction of the ink (liquid) are not limited to the controller 126 and may be configured separately from the controller 126 and a special-purpose configuration may be provided for determining whether or not there is ejection of ink (liquid) and whether or not there is an abnormality in the ejection direction of the ink (liquid).

<Regarding the Detection Members>

In the foregoing embodiment, the first detection members 72 and the second detection members 74 were used as the "detection members", but the "detection members" are not limited to being formed by such a wire material. That is, for example, these may be formed using a plate shaped member of a slender band shape, and in addition to this may be formed using a member having a different shape.

Furthermore, in the foregoing embodiment, the first detection members and the second detection members were provided as the "detection members", but it is not absolutely necessary to provide a pair of detection members. That is to say, it is not necessary to provide a pair of detection members as long as an induced current is produced by ink ejected from the nozzle.

Further, in the foregoing embodiment, the first detection members 72 and the second detection members 74 were formed by a wire material having a diameter of approximately 0.2 mm, but there is no limitation to such a dimension.

Furthermore, in the foregoing embodiment, the first detection members 72 and the second detection members 74 were arranged extended across the opening 76 provided in the substrate 75, but the "detection members" are not necessarily arranged in such a form. That is, as long as they are capable of detecting ink ejected from the liquid ejection nozzles (the nozzles #1 to #180), they may be arranged in any form.

Furthermore, in the foregoing embodiment, the number of the first detection members 72 and the second detection members 74 was respectively eight each, but the number of the first detection members 72 and the second detection members 74 may be one, and may be from two to seven, and may be nine or more. It is not absolutely necessary to arrange the members in this number. Of course, it is preferable that the number of the first detection members 72 and the second detection members 74 is appropriately set as large as possible, according to the number of nozzles to be tested.

Further still, the first detection member 72 and the second detection member 74 are not necessarily arranged in alternation, and one of these may be arranged in a manner such as every other member or every two members. It is not absolutely necessary for the numbers of the first detection members 72 and the second detection members 74 to be in agreement.

<Regarding the Arrangement of the Detection Members>

The foregoing embodiment was described using an example of a plurality of the first detection members 72 and the second detection members 74 being provided and arranged parallel to each other with equivalent intervals, but the first detection members 72 and the second detection members 74 are not necessarily arranged in such a manner. That is, the first detection members 72 and the second detection members 74 are not necessarily arranged parallel to each other, and may be arranged along different directions, may be arranged without equivalent intervals, and may be arranged intersecting each other.

Further, in the foregoing embodiment, the first detection members 72 and the second detection members 74 were arranged along a direction intersecting the arrangement direction of the nozzles #1 to #180, but it is not necessary that they be arranged in this manner. That is, as long as an induced current can be produced by the ink ejected from the nozzles #1 to #180, they may be arranged parallel to the direction in which the nozzles #1 to #180 are arranged. That is, for example, a configuration in which the first detection members 72 and the second detection members 74 are arranged on either side having the nozzles #1 to #180 sandwiched between may also be used.

<Regarding the Detection Sections>

In the foregoing embodiment, the detection sections 80, 82, 84, 102, and 114 were described as the "detection sections", but there is no limitation to the detection sections 80, 82, 84, 102, and 114, and any type of detection section may be used as long as it can detect an induced current produced in the "detection member" by a charged liquid (ink) that has been ejected from a liquid ejection nozzle (here, the nozzles #1 to #180).

<Regarding the Electrode Section>

In the foregoing embodiment, the electrode section 112 formed by a wire material was described as the "electrode section", but the "electrode section" is not limited to the electrode section 112, and may be an electrode section of any form as long as it forms an electric field between it and the nozzles #1 to #180 (head 21).

<Regarding the Nozzle Cleaning Apparatus>

In the foregoing embodiment, the nozzle cleaning device as being equipped in a liquid ejection apparatus (printing apparatus) with the inkjet printer 1 being used as an example was described as the nozzle cleaning device, but the nozzle cleaning device is not limited to this apparatus. That is, the nozzle cleaning device may be an apparatus that is separate from the liquid ejection apparatus (printing apparatus) and that is capable of carrying out only liquid ejection testing independently, and further may be equipped in an apparatus other than the above-described liquid ejection apparatus.

<Regarding the Liquid Ejection Apparatus>

In the foregoing embodiment, an inkjet printer 1 was described as an example of the liquid ejection apparatus, but there is no limitation to the inkjet printer 1, and any apparatus may be used as long as it is an apparatus that ejects a liquid.

<Regarding the Ink>

The ink that is used may be pigment ink, or may be other various types of ink such as dye ink.

As for the color of the ink, it is also possible to use ink of other colors, such as light cyan (LC), light magenta (LM), dark yellow (DY), or red, violet, blue or green, in addition to the above-mentioned yellow (Y), magenta (M), cyan (C) and black (K).

<Regarding the Printing Apparatus>

In the foregoing embodiments, the above-described inkjet printer 1 was described as an example of a printing apparatus, but there is no limitation to such a printing apparatus, and an inkjet printer for ejecting ink in other modes also may be employed.

<Regarding the Medium>

The medium S may be any of plain paper, matte paper, cut paper, glossy paper, roll paper, print paper, photo paper, and roll-type photo paper or the like. In addition to these, the medium S may be a film material such as OHP film and glossy film, a cloth material, or a metal plate material or the like. In other words, any medium that can be printed on can be used.

What is claimed is:

1. A nozzle cleaning method, comprising:

a first determination of determining whether or not there is ejection of a liquid from a liquid ejection nozzle targeted for testing;

a second determination of determining whether or not there is an abnormality in an ejection direction of a liquid from the liquid ejection nozzle; and a cleaning of executing a cleaning process that is different between when a determination is made that there is no ejection of the liquid in the first determination and when a determination is made that there is an abnormality in the ejection direction of the liquid in the second determination on the liquid ejection nozzle that is subjected to determination, wherein a determination is made in the first determination based on a magnitude of an induced current produced in a detection member by the liquid that has been ejected from the liquid ejection nozzle and that has been charged, and wherein a determination is made in the second determination based on the magnitude of the induced current produced in the detection member by the liquid that has been ejected from the liquid ejection nozzle and that has been charged.

2. A nozzle cleaning method according to claim 1, wherein the second determination is executed when a determination is made that there is ejection of the liquid in the first determination.

3. A nozzle cleaning method according to claim 1, wherein a determination is made in the first determination or the second determination by comparing a magnitude of the induced current produced in a detection member and a predetermined reference value.

4. A nozzle cleaning method according to claim 1, wherein there is a-plurality of the liquid ejection nozzles.

5. A nozzle cleaning method according to claim 1, wherein a suction process of suctioning the liquid from the liquid ejection nozzle is executed as the cleaning process.

6. A nozzle cleaning method according to claim.1, wherein the suction process is executed as the cleaning process when a determination is made in the first determination that there is no ejection of the liquid.

7. A nozzle cleaning method according to claim 1, wherein a liquid ejection operation of ejecting the liquid from the liquid ejection nozzle toward a liquid recovery section is executed as the cleaning process.

8. A nozzle cleaning method according to claim 1, wherein a liquid ejection operation is executed as the cleaning process when a determination is made in the second determination that there is an abnormality in an ejection direction of the liquid.

9. A nozzle cleaning method according to claim 1, wherein a wiping process of wiping and removing extraneous matter adhering to an opening of the liquid ejection nozzle is executed as the cleaning process.

10. A nozzle cleaning method according to claim 9, wherein the wiping process is executed as the cleaning process when a determination is made in the second determination that there is an abnormality in an ejection direction of the liquid.

11. A nozzle cleaning method according to claim 1, wherein the liquid ejected from the liquid ejection nozzle is ink.

12. A nozzle cleaning method comprising:

a first determination of determining whether or not there is ejection of a liquid from a liquid ejection nozzle targeted for testing;

a second determination of determining whether or not there is an abnormality in an ejection direction of a liquid from the liquid ejection nozzle; and a cleaning of executing a cleaning process that is different between when a determination is made that there is no ejection of the liquid in the first determination and when a determination is made that there is an abnormality in the ejection direction of the liquid in the second determination on the liquid ejection nozzle that is subjected to determination, wherein a determination is made in the first determination based on a magnitude of an induced current produced in a detection member by the liquid that has been ejected from the liquid ejection nozzle and that has been charged.

wherein a determination is made in the second determination based on the magnitude of the induced current produced in the detection member by the liquid that has been ejected from the liquid ejection nozzle and that has been charged, wherein a liquid ejection operation of ejecting the liquid from the liquid ejection nozzle toward a liquid recovery section is executed as the cleaning process.

wherein the liquid ejection nozzle is a nozzle that forms dots of at least two or more different sizes on a medium by ejection of the liquid, and executing as the cleaning process the liquid ejection operation of ejecting the liquid from the liquid ejection nozzle toward the liquid recovery section to form a dot of a smaller size than a largest size.

13. A nozzle cleaning method, comprising:

a first determination of determining whether or not there is ejection of a 1liquid from a liquid ejection nozzle targeted for testing;

a second determination of determining whether or not there is an abnormality in an ejection direction of a liquid from the liquid ejection nozzle; and a cleaning of executing a cleaning process that is different between when a determination is made that there is no ejection of the liquid in the first determination and when a determination is made that there is an abnormality in the ejection direction of the liquid in the second determination on the liquid ejection nozzle that is subjected to determination, wherein a determination is made in the first determination based on a magnitude of an induced current produced in a detection member by the liquid that has been ejected from the liquid ejection nozzle and that has been charged, wherein a determination is made in the second determination based on the magnitude of the induced current produced in the detection member by the liquid that has been ejected from the liquid ejection nozzle and that has been charged, wherein a liquid ejection operation of ejecting the liquid from the liquid ejection nozzle toward a liquid recovery section is executed as the cleaning process, wherein the liquid ejection nozzle is a nozzle that carries out an operation of ejecting the liquid based on drive signals of at least two different frequencies, and executing as the cleaning process the liquid ejection operation of ejecting the liquid from the liquid ejection nozzle toward the liquid recovery section based on a drive signal of another frequency excluding a highest frequency.

14. A nozzle cleaning device, comprising:

a first determination section that determines whether or not there is ejection of a liquid from a liquid ejection nozzle targeted for testing;

a second determination section that determines whether or not there is an abnormality in an ejection direction of a liquid from the liquid ejection nozzle; and a controller that executes a cleaning process that is different between when a determination is made by the first determination section that there is no ejection of the liquid and when a determination is made by the second determination section that there is an abnormality in the ejection direction of the liquid on the liquid ejection nozzle that is subjected to determination, wherein a determination is made by the first determination section based on a magnitude of an induced current produced in a detection member by the liquid that has been ejected from the liquid ejection nozzle and that has been charged, and wherein a determination is made by the second determination section based on the magnitude of the induced current produced in the detection member by the liquid that has been ejected from the liquid ejection nozzle and that has been charged.

15. A nozzle cleaning method, comprising:

a first determination of determining whether or not there is ejection of a liquid from a liquid ejection nozzle targeted for testing;

a second determination of determining whether or not there is an abnormality in an ejection condition of a liquid from the liquid ejection nozzle; and a cleaning of executing a cleaning process that is different between when a determination is made that there is no ejection of the liquid in the first determination and when a determination is made that there is an abnormality in the ejection condition of the liquid in the second determination on the liquid ejection nozzle that is subjected to determination, wherein a determination is made in the first determination based on a magnitude of an induced current produced in a detection member by the liquid that has been ejected from the liquid ejection nozzle and that has been charged, and wherein a determination is made in the second determination based on the magnitude of the induced current produced in the detection member by the liquid that has been ejected from the liquid ejection nozzle and that has been charged.

16. A nozzle cleaning device, comprising: a first determination section that determines whether or not there is ejection of a liquid from a liquid ejection nozzle targeted for testing;

a second determination section that determines whether or not there is an abnormality in an ejection condition of a liquid from the liquid ejection nozzle; and a controller that executes a cleaning process that is different between when a determination is made by the first determination section that there is no ejection of the liquid and when a determination is made by the second determination section that there is an abnormality in the ejection condition of the liquid on the liquid ejection nozzle that is subjected to determination, wherein a determination is made by the first determination section based on a magnitude of an induced current produced in a detection member by the liquid that has been ejected from the liquid ejection nozzle and that has been charged, and wherein a determination is made by the second determination section based on the magnitude of the induced current produced in the detection member by the liquid that has been ejected from the liquid ejection nozzle and that has been charged.

17. A liquid ejection apparatus, comprising:

a nozzle that ejects a liquid;

a first determination section that determines whether or not there is ejection of the liquid from the nozzle;

a second determination section that determines whether or not there is an abnormality in an ejection direction of the liquid from the nozzle; and a controller that executes a cleaning process that is different between when a determination is made by the first determination section that there is no ejection of the liquid and when a determination is made by the second determination section that there is an abnormality in the ejection direction of the liquid on the nozzle that is subjected to determination, wherein a determination is made by the first determination section based on a magnitude of an induced current produced in a detection member by the liquid that has been ejected from the liquid ejection nozzle and that has been charged, and wherein a determination is made by the second determination section based on the magnitude of the induced current produced in the detection member by the liquid that has been ejected from the liquid ejection nozzle and that has been charged.

18. A liquid ejection apparatus, comprising:

a nozzle that ejects a liquid;

a first determination section that determines whether or not there is ejection of the liquid from the nozzle;

a second determination section that determines whether or not there is an abnormality in an ejection condition of the liquid from the nozzle; and a controller that executes a cleaning process that is different between when a determination is made by the first determination section that there is no ejection of the liquid and when a determination is made by the second determination section that there is an abnormality in the ejection condition of the liquid on the nozzle that is subjected to determination, wherein a determination is made by the first determination section based on a magnitude of an induced current produced in a detection member by the liquid that has been ejected from the liquid ejection nozzle and that has been charged, and wherein a determination is made by the second determination section based on the magnitude of the induced current produced in the detection member by the liquid that has been ejected from the liquid ejection nozzle and that has been charged.

19. A printing apparatus comprising:

a nozzle that carries out printing by ejecting ink toward a medium;

a first determination section that determines whether or not there is ejection of the ink from the nozzle;

a second determination section that determines whether or not there is an abnormality in an ejection direction of the ink from the nozzle; and a controller that executes a cleaning process that is different between when a determination is made by the first determination section that there is no ejection of the ink and when a determination is made by the second determination section that there is an abnormality in the ejection direction of the ink on the nozzle that is subjected to determination, wherein a determination is made by the first determination section based on a magnitude of an induced current produced in a detection member by the liquid that has been ejected from the liquid ejection nozzle and that has been charged, and wherein a determination is made by the second determination section based on the magnitude of the induced current produced in the detection member by the liquid that has been ejected from the liquid ejection nozzle and that has been charged.

20. A printing apparatus comprising:

a nozzle-that carries out printing by ejecting ink toward a medium;

a first determination section that determines whether or not there is ejection of the ink from the nozzle;

a second determination section that determines whether or not there is an abnormality in an ejection condition of the ink from the nozzle; and a controller that executes a cleaning process that is different between when a determination is made by the first determination section that there is no ejection of the ink and when a determination is made by the second determination section that there is an abnormality in the ejection condition of the ink on the nozzle that is subjected to determination, wherein a determination is made by the first determination section based on a magnitude of an induced current produced in a detection member by the liquid that has been ejected from the liquid ejection nozzle and that has been charged, and wherein a determination is made by the second determination section based on the magnitude of the induced current produced in the detection member by the liquid that has been ejected from the liquid ejection nozzle and that has been charged.

21. A computer-readable medium for enabling operation of a nozzle cleaning device comprises the following codes:

a code for determining whether or not there is ejection of a liquid from a liquid ejection nozzle targeted for testing;

a code for determining whether or not there is an abnormality in an ejection direction of a liquid from the liquid ejection nozzle; and a code for executing a cleaning process that is different between when a determination is made that there is no ejection of the liquid in a first determination and when a determination is made that there is an abnormality in the ejection direction of the liquid in a second determination on the liquid ejection nozzle that is subjected to determination, wherein a determination is made by the code for determining whether or not there is the ejection based on a magnitude of an induced current produced in a detection member by the liquid that has been ejected from the liquid ejection nozzle and that has been charged, and wherein a determination is made by the code for determining whether or not there is the abnormality based on the magnitude of the induced current produced in the detection member by the liquid that has been ejected from the liquid ejection nozzle and that has been charged.

22. A computer-readable medium for enabling operation of a nozzle cleaning device comprises the following codes:

a code for determining whether or not there is ejection of a liquid from a liquid ejection nozzle targeted for testing;

a code for determining whether or not there is an abnormality in an ejection condition of a liquid from the liquid ejection nozzle; and a code for executing a cleaning process that is different between when a determination is made that there is no ejection of the liquid in a first determination and when a determination is made that there is an abnormality in the ejection condition of the liquid in a second determination on the liquid ejection nozzle that is subjected to determination, wherein a determination is made by the code for determining whether or not there is the ejection based on a magnitude of an induced current produced in a detection member by the liquid that has been ejected from the liquid ejection nozzle and that has been charged, and wherein a determination is made by the code for determining whether or not there is the abnormality based on the magnitude of the induced current produced in the detection member by the liquid that has been ejected from the liquid ejection nozzle and that has been charged.

* * * * *